US009352925B2

(12) United States Patent
Komatsu

(10) Patent No.: US 9,352,925 B2
(45) Date of Patent: May 31, 2016

(54) POSITION ADJUSTMENT DEVICE AND PAPER SHEET PROCESSING DEVICE

(71) Applicant: Oki Electric Industry Co., Ltd., Tokyo (JP)

(72) Inventor: Hirokazu Komatsu, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/441,512

(22) PCT Filed: Oct. 7, 2013

(86) PCT No.: PCT/JP2013/077264
§ 371 (c)(1),
(2) Date: May 7, 2015

(87) PCT Pub. No.: WO2014/077050
PCT Pub. Date: May 22, 2014

(65) Prior Publication Data

US 2015/0291381 A1 Oct. 15, 2015

(30) Foreign Application Priority Data

Nov. 13, 2012 (JP) ..... 2012-249636

(51) Int. Cl.
*B65H 1/00* (2006.01)
*B65H 31/20* (2006.01)
*A47F 5/00* (2006.01)

(52) U.S. Cl.
CPC ..... *B65H 31/20* (2013.01); *A47F 5/0093* (2013.01); *B65H 2402/10* (2013.01); *B65H 2402/30* (2013.01); *B65H 2402/61* (2013.01); *B65H 2405/11* (2013.01); *B65H 2701/1912* (2013.01)

(58) Field of Classification Search
CPC ..... A47F 5/0093; A47F 5/0846; B65H 1/00; B65H 1/04; B65H 31/20; B65H 2402/30; B65H 2402/61; B65H 2405/1134; B65H 2701/1912
USPC ..... 194/206, 350; 271/145, 164, 171, 226; 248/274.1, 316.8, 670; 269/266, 279
See application file for complete search history.

(56) References Cited

U.S. PATENT DOCUMENTS 3,199,068 A * 8/1965 Neenan ..... H01R 9/22 174/58
2012/0292849 A1 11/2012 Komatsu et al.

FOREIGN PATENT DOCUMENTS

| | | | |
|---|---|---|---|
| JP | H03-72562 | U | 7/1991 |
| JP | 2007-206768 | A | 8/2007 |
| JP | 2008-021113 | A | 1/2008 |
| JP | 2011-129043 | A | 6/2011 |
| JP | 2011-148599 | A | 8/2011 |

* cited by examiner

*Primary Examiner* — Mark Beauchaine
(74) *Attorney, Agent, or Firm* — Rabin & Berdo, P.C.

(57) ABSTRACT

Position adjustment device including adjustment body having row of fitting portions with specifically shaped fitting portions disposed every specific fitting cycle along a specific direction. A holder holds that body in one of plural holding modes, such that the row faces in a specific holding direction. An adjustable body's position with respect to the holder is determined by fitting with one of the row's fitting portions a fitted portion fittable with the fitting portions. The row is disposed with minimum distance between the adjustable body with the fitted portion fitted with one fitting portion in the row within a fittable range when that body is held in a first holding mode, and the body with the fitted portion fitted with one of the fitting portions in the row within the fittable range when the adjustment body is held in a second holding mode, being shorter than the specific cycle.

11 Claims, 43 Drawing Sheets

POSITION ADJUSTMENT DEVICE AND PAPER SHEET PROCESSING DEVICE

TECHNICAL FIELD

The present invention relates to a position adjustment device and a paper sheet processing device, well-suited to applications such as an automated teller machine (ATM) that performs desired transactions on an inserted paper sheet shaped medium such as banknotes.

BACKGROUND ART

An automated teller machine employed in a financial institution, for example, performs cash deposits of banknotes and coins by a customer, pays out cash to a customer, and so on, according to contents of a transaction with the customer.

Existing automated teller machines include, for example, a banknote pay-in/pay-out port that receives and dispenses banknotes for a customer, a conveyance section that conveys banknotes internally, a classification section that classifies inserted banknotes by denomination, authenticity, degree of wear, and the like, a temporary holding section that temporarily holds inserted banknotes, and banknote cassettes that store banknotes by denomination.

When a customer inserts banknotes into the banknote pay-in/pay-out port during a pay-in transaction, such an automated teller machine conveys the inserted banknotes using the conveyance section, and holds banknotes classified by the classification section as normal banknotes in the temporary holding section, and returns banknotes classified as unsuitable for transaction to the banknote pay-in/pay-out port for return to the customer. Then, when the customer has confirmed the pay-in amount, the automated teller machine reclassifies the banknotes held in the temporary holding section in the classification section by denomination, and uses the conveyance section to convey the banknotes to the banknote cassettes to be stored by denomination.

Such banknote cassettes include banknote cassettes internally formed with a space, within which banknotes are collected and stored with sheet faces of the banknotes facing up and down (see for example Japanese Patent Application Laid-Open (JP-A) No. 2007-206768).

As illustrated in the side view of FIG. 32, for example, a banknote cassette 917 is formed with a collection space CS, for collecting banknotes BL serving as a paper sheet shaped medium, interposed between a reverse guide 24 and a front guide 26 to the front and rear, at a portion to the upper side of a stage 28 that moves up and down.

In the banknote cassette 917, banknotes BL conveyed up by the conveyance section with the short edge direction along the direction of travel are nipped between a feed roller 32 and a reverse roller 33, and discharged into the collection space CS by rotation driving thereof.

The discharged banknotes BL strike bill stoppers 27 which absorb the impact, before being patted downward by paddle wheels 34 and stacked at an uppermost portion of the already-collected banknotes BL.

SUMMARY OF INVENTION

Technical Problem

In the banknote cassette 917, supposing a guide separation L1 that is the separation between the reverse guide 24 and the front guide 26 was unsuitable for a short edge length L2 that is the length of the short direction edges of the banknotes BL, there is a concern of being unable to collect the banknotes BL neatly, causing collection problems.

For example, in the banknote cassette 917, there is a concern of a banknote BL entering a gap between the collected banknotes BL and a side wall as illustrated in FIG. 33A, and a concern of banknotes BL jamming between the reverse guide 24 and the front guide 26, and of banknotes BL creasing as illustrated in FIG. 33B.

The banknote cassette 917 is therefore provided with a collar 951 and an attachment screw 952 with length adjusted to the short edge length L2 of the banknotes BL, and the front guide 26 is fixed to an external wall by the attachment screw 952 through the collar 951.

However, banknotes come in various different sizes depending on the country, region, and denomination. There is accordingly a need to adjust the guide separation L1 appropriately to the short edge length L2 according to the banknotes BL to be stored in the banknote cassette 917.

Accordingly, in the banknote cassette 917, as illustrated in FIGS. 34A and 34B, the guide separation L1 can be changed to accommodate banknotes BL by changing the collar 951 and attachment screw 952 length to precisely adjust the position of the front guide 26 so as to be appropriate for the short edge length L2 of the banknotes BL to be accommodated.

However, in the banknote cassette 917, collars 951 and attachment screws 952 are required in different lengths, corresponding in number to the various short edge lengths L2 of any banknotes BL desired to be stored, with effort required for the production and management thereof.

In consideration of the above circumstances, the present invention proposes a position adjustment device enabling easy and precise positional adjustment, and a paper sheet processing device enabling easy and precise adjustment of the size of a space for collecting a paper shaped medium.

Solution to Problem

In order to address the above issue, a position adjustment device of the present invention includes: an adjustment body including a row of fitting portions in which plural fitting portions of a specific shape are disposed every specific fitting cycle along a specific direction; a holder that holds the adjustment body in one of plural holding modes, such that any of the fitting portion rows faces in a specific holding direction and is positioned within a fittable range set running along a specific adjustment direction; and an adjustable body whose position with respect to the holder is determined by fitting a fitted portion that is fittable with the fitting portions together with one of the fitting portions in the fitting portion row within the fittable range, wherein the fitting portion row is disposed such that the minimum distance between a position of the adjustable body with the fitted portion fitted together with one fitting portion in the fitting portion row within the fittable range when the adjustment body is held in a first holding mode by the holder, and a position of the adjustable body with the fitted portion fitted together with one of the fitting portions in the fitting portion row within the fittable range when the adjustment body is held in a second holding mode by the holder, is shorter than the specific fitting cycle.

The position adjustment device of the present invention enables the position of the adjustable body to be adjusted in the adjustment direction in steps of the specific cycle by fitting the fitted portion of the adjustable body together with one of the fitting portions within the fittable range of the adjustment body held by the holder, and enables the position of the adjustable body to be made to differ by a distance shorter than the specific fitting cycle by switching the holding mode of the adjustment body by the holder. This thereby enables the position of the adjustable body to be adjusted in units shorter than the specific fitting cycle as a result.

A paper sheet processing device of the present invention includes: a fixed side portion that is one side face of a collection space in which a paper sheet shaped medium is collected; an adjustment body including a row of fitting portions, in which plural fitting portions of a specific shape are disposed every specific fitting cycle along a specific direction; a holder that holds the adjustment body in one of plural holding modes such that any of the fitting portion rows faces in a specific holding direction and is positioned within a fittable range set running along an adjustment direction that is a direction heading toward and away from the fixed side portion; an adjustable body whose position with respect to the holder is determined by fitting a fitted portion that is fittable with the fitting portions together with one of the fitting portions in the fitting portion row that is within the fittable range; and a movable side portion that is attached to the adjustable body, and that is a side face of the collection space facing the fixed side portion, wherein the fitting portion row is disposed such that the minimum distance between a position of the adjustable body with the fitted portion fitted together with one fitting portion in the fitting portion row within the fittable range when the adjustment body is held in a first holding mode by the holder, and a position of the adjustable body with the fitted portion fitted together with one of the fitting portions in the fitting portion row within the fittable range when the adjustment body is held in a second holding mode by the holder, is shorter than the specific fitting cycle.

The paper sheet processing device of the present invention enables the position of the adjustable body to be adjusted in the adjustment direction in steps of the specific cycle by fitting the fitted portion of the adjustable body together with one of the fitting portions within the fittable range of the adjustment body held by the holder, and enables the position of the adjustable body to be made to differ by a distance shorter than the specific fitting cycle by switching the holding mode of the adjustment body by the holder. This thereby enables the distance between the movable side portion attached to the adjustable body, and the fixed side portion, to be adjusted in units shorter than the specific fitting cycle as a result.

Advantageous Effects of Invention

The present invention enables the position of the adjustable body to be adjusted in the adjustment direction in steps of the specific cycle by fitting the fitted portion of the adjustable body together with one of the fitting portions within the fittable range of the adjustment body held by the holder, and enables the position of the adjustable body to be made to differ by a distance shorter than the fitting cycle by switching the holding mode of the adjustment body by the holder. This thereby enables the position of the adjustable body to be adjusted in units shorter than the specific fitting cycle as a result. The present invention enables a position adjustment device enabling easy and precise positional adjustment.

The present invention enables the position of the adjustable body to be adjusted in the adjustment direction in steps of the specific cycle by fitting the fitted portion of the adjustable body together with one of the fitting portions within the fittable range of the adjustment body held by the holder, and enables the position of the adjustable body to be made to differ by a distance shorter than the fitting cycle by switching the holding mode of the adjustment body by the holder. This thereby enables the distance between the movable side portion attached to the adjustable body, and the fixed side portion, to be adjusted in units shorter than the specific fitting cycle as a result. The present invention enables realization of a paper sheet processing device capable of easy and precise adjustment of the size of a space for collecting a paper shaped medium.

DESCRIPTION OF EMBODIMENTS

Explanation follows regarding embodiments of the present invention (referred to below as exemplary embodiments), with reference to the drawings.

Figure 1:
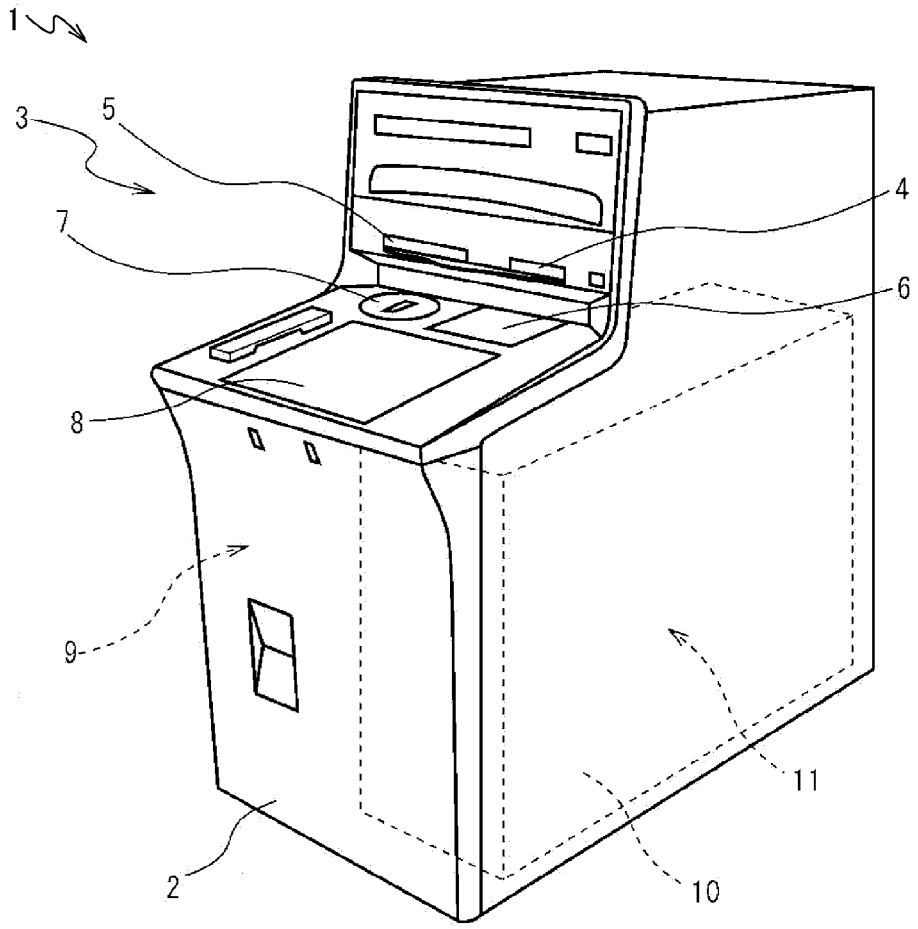
FIG. 1 is a schematic perspective view illustrating an external configuration of an automated teller machine.

1. First Exemplary Embodiment 1-1. Overall Configuration of Automated Teller Machine As illustrated in the external view of FIG. 1, an automated teller machine 1 serving as a paper sheet processing device is configured centered on a box shaped casing 2, and is installed in, for example, a financial institution to perform cash transactions such as pay-in transactions and pay-out transactions with a customer.

The casing 2 is configured with a partially cut-away shape at a location enabling easy banknote insertion and easy operation of a touch panel, etc. by a customer facing the front side of the casing 2, namely at a portion spanning from a front face upper portion to the top face, with a customer interface 3 provided at this portion.

The customer interface 3 is configured to directly handle cash and passbook interactions, etc. with a customer, as well as to notify transaction-related information and receive operation instructions. The customer interface 3 is provided with a card insertion/removal port 4, a passbook insertion/removal port 5, a banknote pay-in/pay-out port 6, a coin pay-in/pay-out port 7, and a display and operation section 8.

The card insertion/removal port 4 is a section for insertion and return of various cards, such as cash cards. A card processor (described later) that reads account numbers, etc. magnetically recorded on the various cards is provided behind the card insertion/removal port 4.

The passbook insertion/removal port 5 is a section for insertion and return of passbooks. A passbook processor (described later) that reads magnetic data recorded in the passbook, and prints transaction details, etc. is provided behind the passbook insertion/removal port 5.

The banknote pay-in/pay-out port 6 is a section into which banknotes for paying in are inserted by a customer, and where banknotes for paying out to a customer are dispensed. The banknote pay-in/pay-out port 6 is opened up and closed off by driving a shutter.

The coin pay-in/pay-out port 7 is a section into which coins for paying in are inserted by a customer, and where coins for paying out to a customer are dispensed. Similarly to the banknote pay-in/pay-out port 6, the coin pay-in/pay-out port 7 is opened up and closed off by driving a shutter.

The display and operation section 8 is a touch panel configured by a Liquid Crystal Display (LCD) that displays operation screens during transactions, integrated with a touch sensor that is input with, for example, a transaction type selection, a PIN, and a transaction amount.

In the following explanation of the automated teller machine 1, the front side is defined as the front face side that a customer faces, and the opposite side thereto is defined as the rear side. The left side, right side, upper side and lower side are each defined from the perspective of left and right as seen by a customer facing the front side.

A main controller 9 that performs integrated control of the overall automated teller machine 1, and a banknote pay-in/pay-out device 10 that performs various processing relating to banknotes BL, etc. are provided inside the casing 2.

The main controller 9 is configured around a Central Processing Unit (CPU). The main controller 9 reads and executes specific programs from ROM, flash memory, or the like to perform various processing in pay-in transactions and pay-out transactions, etc.

Inside the main controller 9 is a storage section configured by, for example, Random Access Memory (RAM), a hard disk drive, and flash memory. The main controller 9 stores various data in the storage section.

Figure 2:
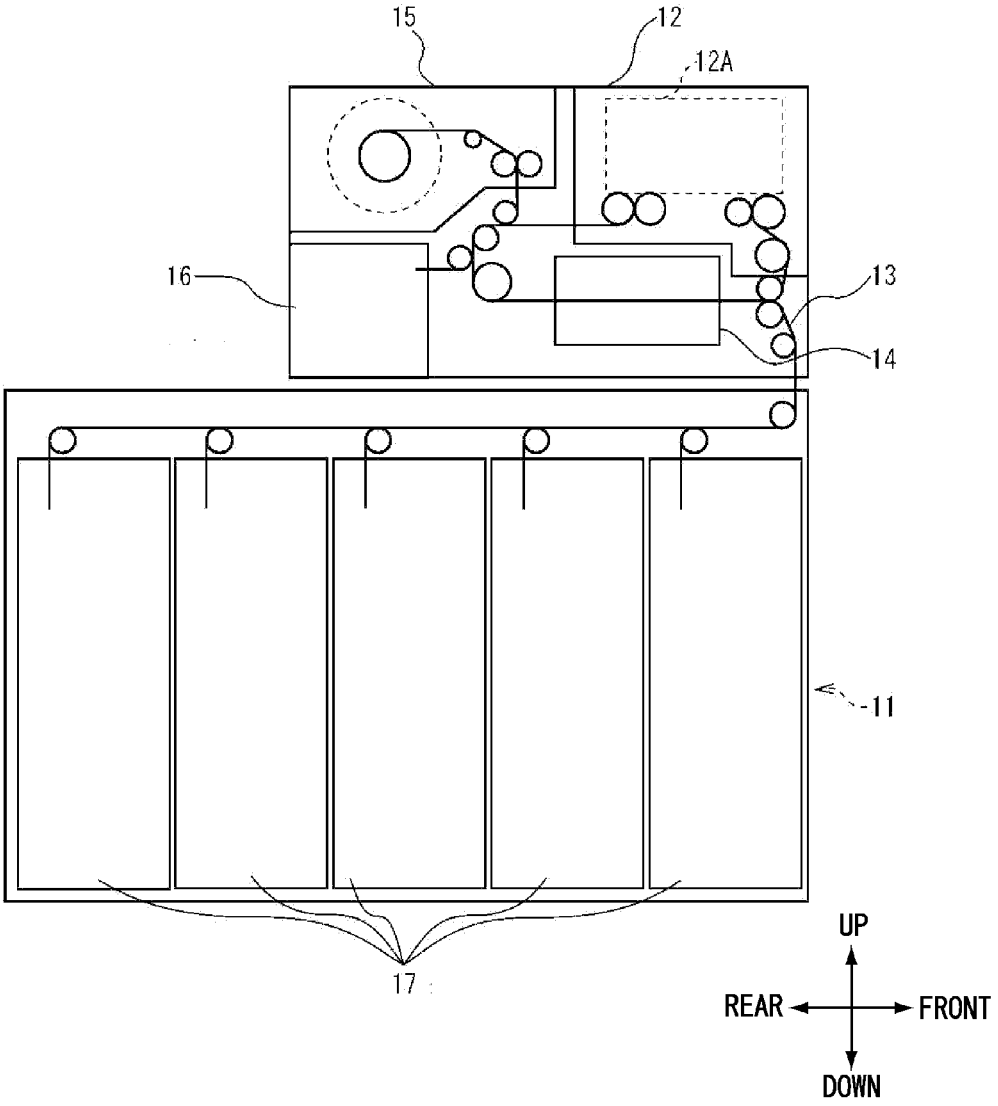
FIG. 2 is a schematic view illustrating a configuration of a banknote pay-in/pay-out device.

As illustrated in the side view of FIG. 2, the banknote pay-in/pay-out device 10 incorporates together plural sections that perform various processing relating to banknotes BL. Each section of the banknote pay-in/pay-out device 10 is controlled by a banknote controller 11.

The banknote controller 11 is configured around a CPU, similarly to the main controller 9. The banknote controller 11 reads and executes specific programs from ROM, flash memory or the like, in order to perform various processing, such as processing to decide the conveyance destination of a banknote BL.

For example, in a pay-in transaction where a customer pays in banknotes, after receiving specific operation input through the display and operation section 8 (FIG. 1), the banknote controller 11 opens the shutter of the banknote pay-in/pay-out port 6 (FIG. 1) to allow insertion of banknotes into a pay-in/pay-out section 12

When the banknotes have been inserted into a receptacle 12A, the pay-in/pay-out section 12 closes the banknote pay-in/pay-out port 6 shutter and takes the banknotes out of the receptacle 12A one note at a time, passing the banknotes to a conveyance section 13. The conveyance section 13 conveys the banknotes, these being rectangular shaped sheets of paper, to a classification section 14, with the short edge direction of the banknotes along the direction of travel.

As the banknotes are being conveyed inside the classification section 14, the banknotes are classified according, for example, to denomination, authenticity, and degree of wear, and the classification results are notified to the banknote controller 11. The banknote controller 11 decides the conveyance destination of a banknote based on the acquired classification results.

At this point, the conveyance section 13, for example, conveys banknotes that the classification section 14 has classified as normal (referred to as normal notes) to a temporary holding section 15 where they are temporarily held. The conveyance section 13 conveys banknotes classified as unsuitable for transaction use (referred to as, for example, damaged or counterfeit notes) to the pay-in/pay-out section 12 for return to the customer.

The banknote controller 11 then prompts the customer to approve the pay-in amount using the display and operation section 8, and the conveyance section 13 conveys the banknotes held in the temporary holding section 15 to the classification section 14 for classification according to, for example, denomination and degree of wear, and the classification results are acquired.

The banknote controller 11 then uses the conveyance section 13 to convey banknotes with a heavy degree of wear to a reject cassette 16 for storage as banknotes that are unsuitable for reuse. The banknote controller 11 moreover uses the conveyance section 13 to convey banknotes with a light degree of wear to be stored by denomination in banknote cassettes 17 as reusable banknotes.

In a pay-out transaction in which, for example, banknotes BL are paid out to a customer, after receiving specific operation input through the operation section 8 (FIG. 1), the banknote controller 11 feeds out banknotes BL according to the amount to be paid out from the banknote cassettes 17, and conveys the banknotes BL to the classification section 14 using the conveyance section 13.

Next, the banknote controller 11 conveys the banknotes BL to the pay-in/pay-out section 12 after classification by the classification section 14, and opens the shutter of the banknote pay-in/pay-out port 6 (FIG. 1) to allow removal by the customer.

In this manner, the banknote cassettes 17 take in and store banknotes BL that have been conveyed there by the conveyance section 13, and feed out and pass banknotes BL from inside to the conveyance section 13.

1-2. Banknote Cassette Configuration

The banknote cassettes 17 take in and collect banknotes BL inside a rectangular box shaped casing 21, as schematically illustrated in FIG. 3, FIG. 4A, FIG. 4B, and FIG. 5.

Figure 3:
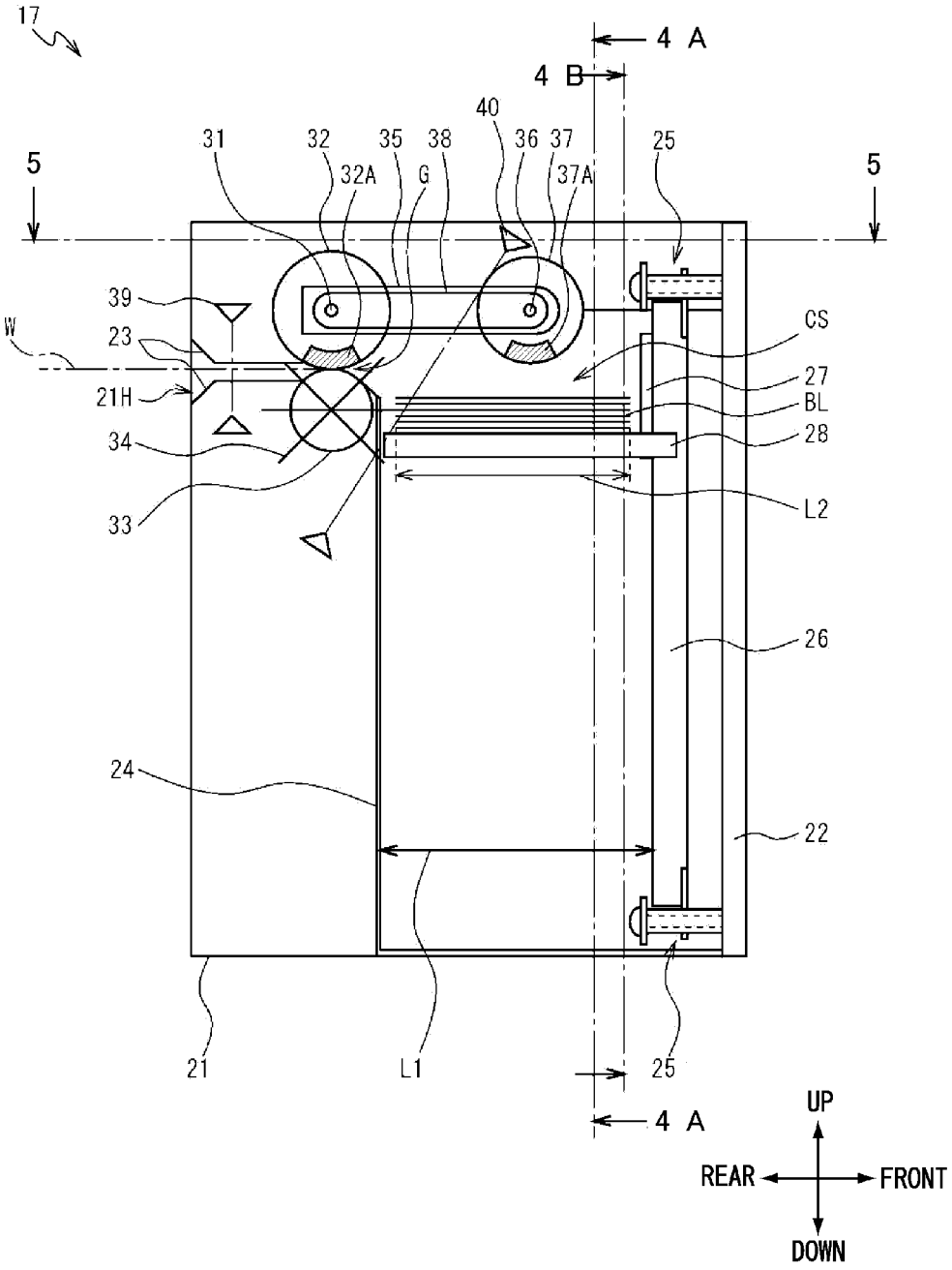
FIG. 3 is a schematic view illustrating a configuration of a banknote cassette.
Figure 4A:
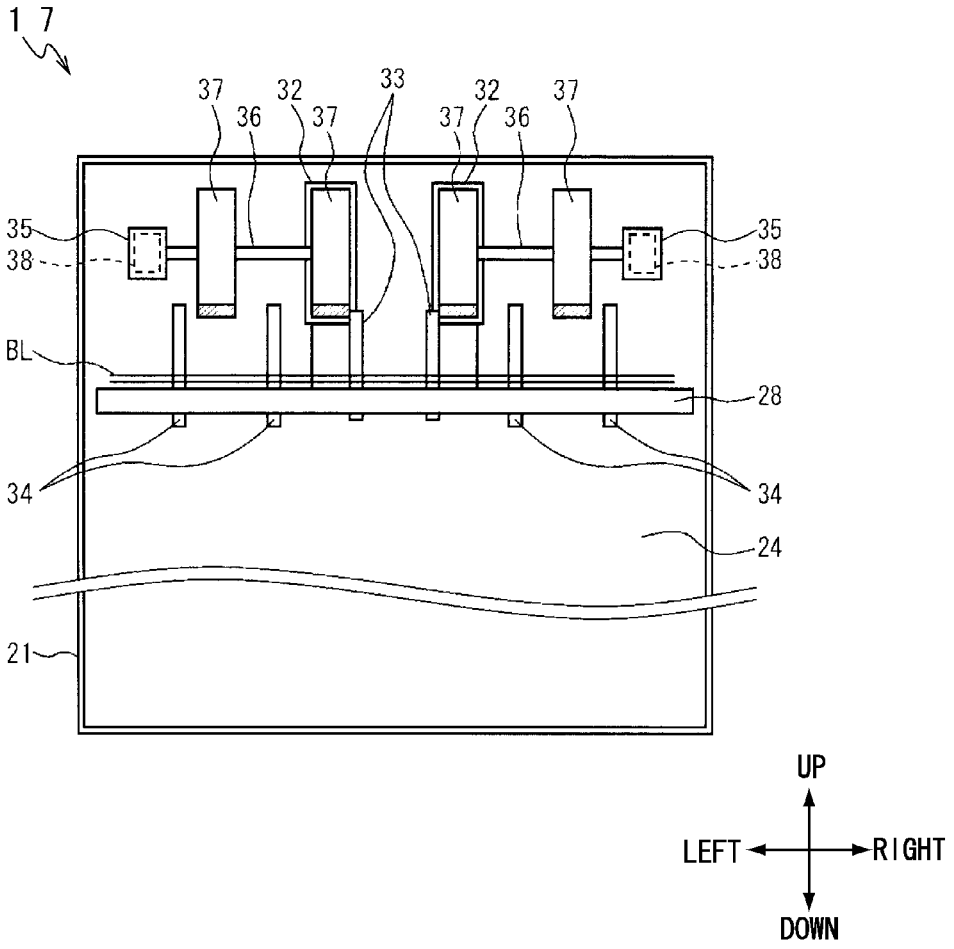
FIG. 4A is a schematic view illustrating a configuration of a banknote cassette.
Figure 4B:
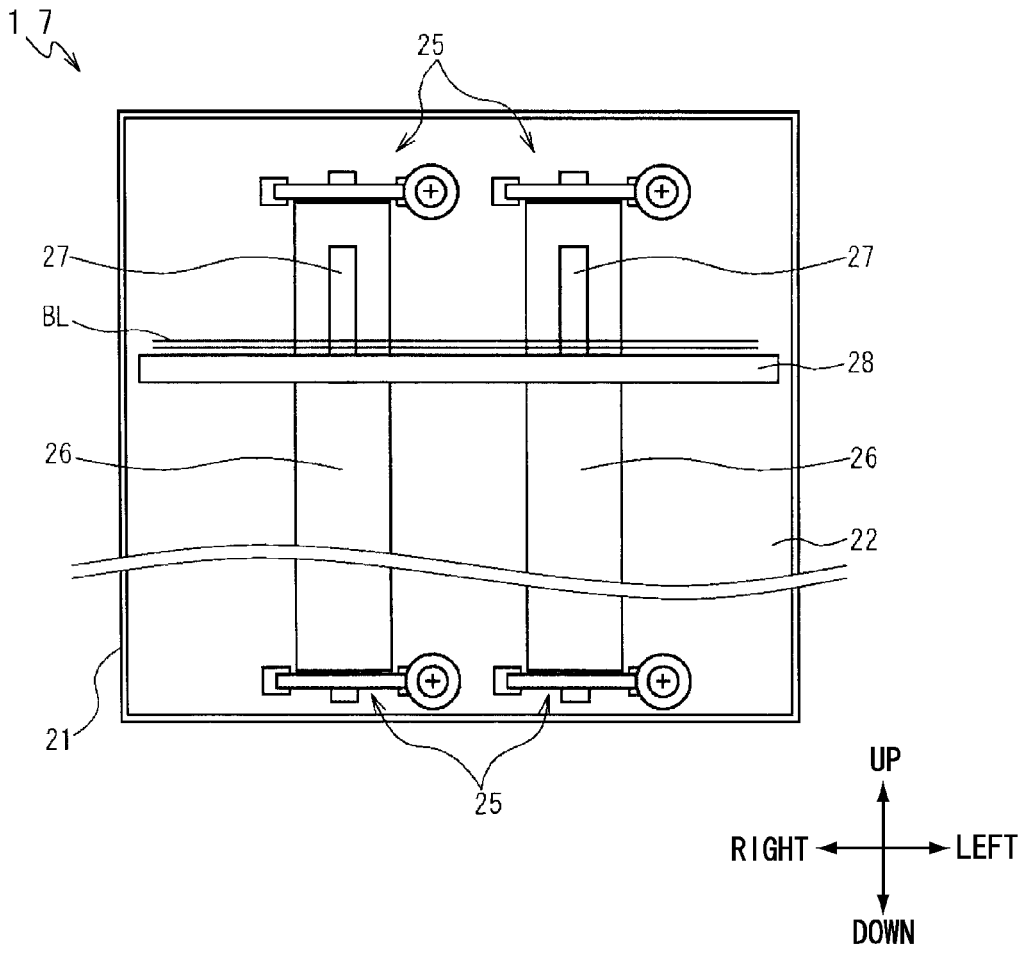
FIG. 4B is a schematic view illustrating a configuration of a banknote cassette.
Figure 5:
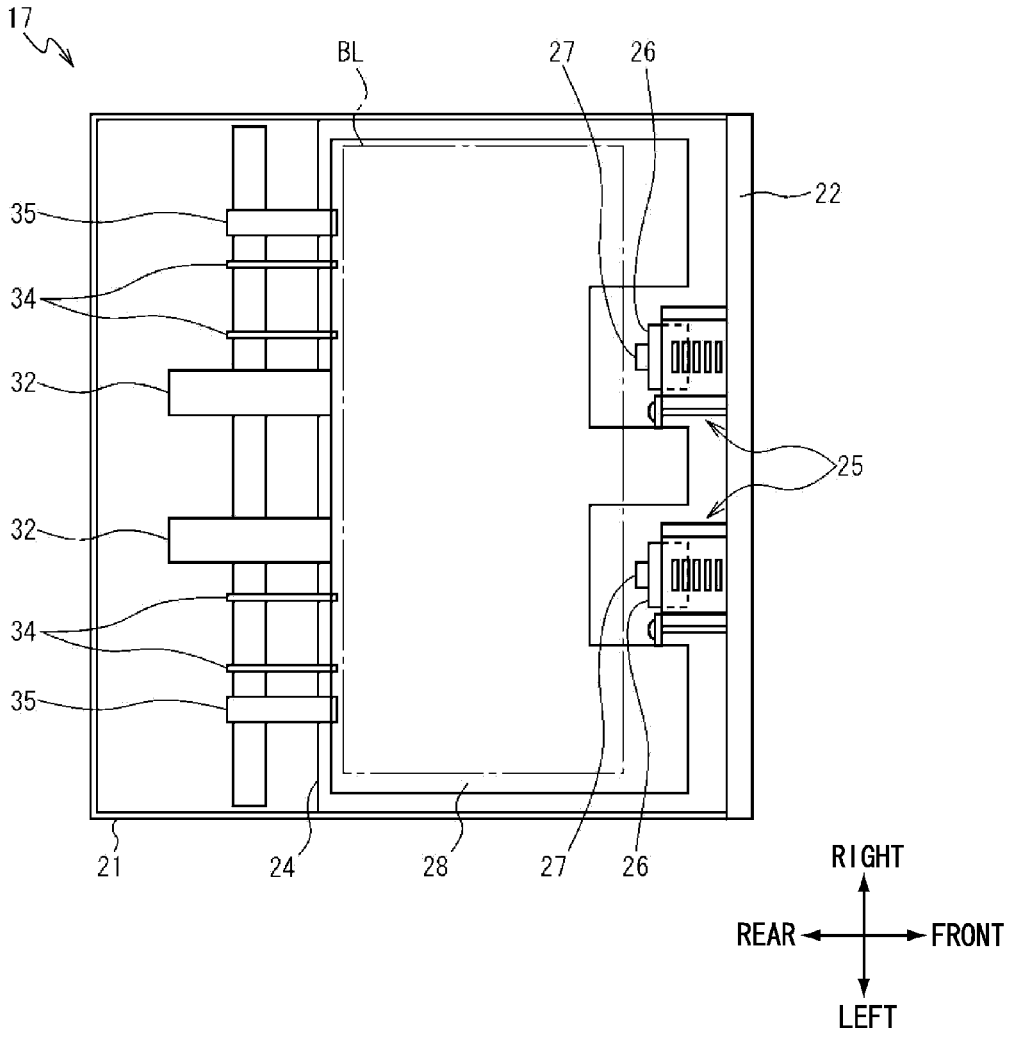
FIG. 5 is a schematic view illustrating a configuration of a banknote cassette.

FIG. 3 is a side view from the left. FIG. 4A is a cross-section taken along 4A-4A in FIG. 3, namely a view toward a rear inside face. FIG. 4B is a cross-section taken along 4B-4B in FIG. 3, namely a view toward a front inside face. FIG. 5 is a cross-section taken along 5-5 in FIG. 3, namely a plan view. Some components have been simplified or omitted for ease of explanation.

The casing 21 is substantially closed off at each of its front, rear, left, right, upper, and lower faces, protecting the collected banknotes BL and various components, etc. inside. A front side plate 22 with a uniform flat plate shape is provided at a front side portion of the casing 21.

A banknote entry/exit hole 21H that is long from left to right and short from top to bottom is formed at a location toward the top of a rear side plate of the casing 21. Banknotes BL travel into the casing 21 and out of the casing 21 with their respective faces facing up and down and the short edge direction along the direction of travel.

In front of the banknote entry/exit hole 21H, namely inside the casing 21, a conveyance guide 23 is provided to advance the banknotes BL in the front-rear direction along a conveyance path W. The conveyance guide 23 is configured by two plate shaped members respectively disposed above and below the conveyance path W.

A plate shaped reverse guide 24, thin from front to rear, is provided to the lower side a short distance in front of the conveyance guide 23. The reverse guide 24 reaches a bottom portion of the casing 21.

At the rear side of the front side plate 22, namely at a front inside face of the casing 21, front guides 26 are attached with one each on the left and right, with position adjustment sections 25 interposed between the front guides 26 and the front inside face.

The front guides 26 are formed in rectangular block shapes, and are long in the up-down direction and short in the front-rear direction and the left-right direction. The front guides 26 extend from the vicinity of the upper end to the vicinity of the lower end of the casing 21, and are formed from a strong material that does not readily deform.

The position adjustment sections 25 are respectively provided at upper ends and lower ends of each of the front guides 26, and fix the positions of the front guides 26 with respect to the front side plate 22.

The position adjustment sections 25 adjust the positions of, and hold, the front guides 26 in the front-rear direction such that the separation between the front guides 26 and the reverse guide 24 is a guide separation L1 slightly longer than a length L2 of the short edge direction of the banknotes BL (this will be described in detail later).

Bill stoppers 27 are provided at a location toward the top of the rear faces of the front guides 26. The bill stoppers 27 are each formed in a rectangular block shape smaller than that of the front guides 26, and are attached to the respective front guides 26 through a resilient body.

A stage 28 is provided between the reverse guide 24 and the front side plate 22 inside the casing 21. The stage 28 is formed in a plate shape thin in the up-down direction. Banknotes BL ( ) can be placed on an upper face of the stage 28.

The stage 28 is formed with rectangular shaped cutaways to avoid the front guides 26. The stage 28 can be moved up and down by a drive mechanism.

A collection space CS for collecting banknotes BL is formed inside the casing 21, in a space between the reverse guide 24 and the front guides 26 in the front-rear direction, and at the upper side of the stage 28.

At a front upper side of the conveyance guide 23, feed rollers 32 through which a feed shaft 31 is inserted, are provided with one disposed on the left and right, respectively. The feed rollers 32 are formed from a low friction material, in circular column shapes that are thin from left to right. Catch portions 32A configured from a high friction material are provided to part of the outer circumference of the feed rollers 32.

Banknotes BL are advanced toward the rear direction or the front direction by rotation driving the feed rollers 32 in the clockwise direction or the counterclockwise direction in FIG. 3 using a drive transmission system.

Respective thin circular column shaped reverse rollers 33 are provided at the front lower side of the conveyance guide 23, at locations only partially contacting circumferential side faces of the left and right feed rollers 32, namely at locations slightly offset in the left-right direction. The locations where the feed rollers 32 contact the reverse rollers 33 are also referred to as a gate G below.

Using the drive transmission system, the reverse rollers 33 are rotation driven in the clockwise direction of FIG. 3 only. Two paddle wheels 34, disposed at a specific separation, are provided at each of two locations on the left and right at the outsides of the respective reverse rollers 33.

Holes of a specific shape are formed to the reverse guide 24 at respective portions corresponding to the reverse rollers 33 and the paddle wheels 34. Part of the respective reverse rollers 33 and paddle wheels 34 are thereby exposed inside the collection space CS.

The paddle wheels 34 include projections configured from a resilient, high friction material and extending in a radiating pattern from a central portion. The paddle wheels 34 are driven by a drive mechanism. The projections of the paddle wheels 34 can be temporarily retracted from inside the collection space CS by being moved downwards and toward the front by a retractor mechanism.

Respective picker arms 35, through which the feed shaft 31 is inserted, extend out toward the front are provided on the left and right at the outside of the feed rollers 32. Picker shafts 36 pass through front ends of the respective picker arms 35, and plural picker rollers 37 are provided to each picker shaft 36.

The picker rollers 37 are configured in thin circular column shapes, similarly to the feed rollers 32, and are positioned substantially directly above the collection space CS. The picker rollers 37 can move up and down by swinging, together with the picker arms 35 and picker shafts 36, about the feed shaft 31.

Drive belts 38 span between the feed shaft 31 and the picker shafts 36. The drive belts 38 transmit drive force to the picker shafts 36 by running accompanying rotation of the feed shaft 31.

This thereby enables the picker rollers 37, through which the picker shafts 36 are inserted, to rotate in synchronization with the feed rollers 32, through which the feed shaft 31 is inserted.

A run sensor 39 is provided above and below the conveyance guide 23. The run sensor 39 is configured by a light emitting portion that is disposed at the lower side of the conveyance guide 23 and emits a specific detection light, and a light receiving portion that is disposed at the upper side of the conveyance guide 23 and receives the detection light, and supplies a light reception signal expressing a light reception result to the banknote controller 11 (FIG. 2). The conveyance guide 23 is appropriately provided with through-holes to allow passage of the detection light.

When a banknote BL is present in the conveyance guide 23, the detection light of the run sensor 39 is blocked by the banknote BL, and so the detection light is not received by the light receiving portion. When there is no banknote BL present in the conveyance guide 23, the run sensor 39 receives the detection light.

The banknote controller 11 is accordingly able to recognize whether or not there is a banknote BL present in the conveyance guide 23 based on the light reception signal from the run sensor 39.

An upper face sensor 40 is installed above the picker rollers 37 and below the reverse rollers 33. Similarly to the run sensor 39, the upper face sensor 40 is configured by a light emitting portion and a light receiving portion, and is disposed such that detection light passes through the inside of the collection space CS and the upper face of the stage 28. The stage 28 is appropriately provided with through-holes to allow passage of the detection light of the upper face sensor 40.

When a banknote BL is present on the stage 28, the detection light of the upper face sensor 40 is blocked by the banknote BL, and so the detection light is not received by the light receiving portion. When there is no banknote BL present on the stage 28, the detection light is received by the light receiving portion of the upper face sensor 40.

The banknote controller 11 is accordingly able to recognize whether or not there is a banknote BL present on the stage 28 based on a light reception signal from the upper face sensor 40.

When storing banknotes BL inside the thus configured banknote cassette 17, first the stage 28 is moved slightly downward, widening the separation between the uppermost face of any banknotes BL already collected on the stage 28 and the picker rollers 37, so as to form a sufficiently large collection space CS.

In the banknote cassette 17, the feed rollers 32 are rotated in the counterclockwise direction in FIG. 3, and the reverse rollers 33 and the paddle wheels 34 are rotated in the clockwise direction.

When a banknote BL is conveyed to the banknote cassette 17 by the conveyance section 13 (FIG. 2), the banknote BL is advanced toward the front through the conveyance guide 23 along the conveyance path W, and the banknote BL is nipped between the feed rollers 32 and the reverse rollers 33.

The feed rollers 32 and the reverse rollers 33 are rotated in the counterclockwise direction and the clockwise direction respectively, thereby discharging the banknote BL toward the front into the collection space CS through the gate G. When this is performed, the discharged banknote BL glides through the collection space CS toward the front, and strikes the bill stoppers 27.

The bill stoppers 27 deform the resilient body and move slightly toward the front, thereby absorbing the kinetic energy of the banknote BL, after which the recovery action of the resilient body pushes the banknote BL back slightly toward the rear.

The paddle wheels 34 then pat down a rear side edge of the banknote BL, stacking the banknote BL on top of the already collected banknotes BL on the stage 28.

When this is performed, the banknotes BL can be neatly collected since the separation between the front guides 26 and the reverse guide 24 in the banknote cassette 17 has been adjusted to the appropriate guide separation L1 slightly longer than the short edge length L2 of the banknotes BL.

The height of the collection space CS in the banknote cassette 17 is kept substantially uniform due to moving the stage 28 gradually downward accompanying the increase in the number of collected banknotes BL.

When feeding out a banknote BL stored inside the banknote cassette 17, first the stage 28 is moved slightly upward, such that the uppermost face of the banknotes BL already collected on the stage 28 contacts the picker rollers 37.

The banknote cassette 17 then rotates the feed rollers 32 and the picker rollers 37 coordinated therewith, as well as the reverse rollers 33, in the clockwise direction in FIG. 3, and moves the paddle wheels 34 toward the front and downward to temporarily retract the projections from inside the collection space CS.

The banknote cassette 17 then conveys the uppermost banknote BL out of the banknotes BL collected on the stage 28 toward the rear by rotating the picker rollers 37. The rear side edge of the banknote BL reaches the gate G, and is nipped by the feed rollers 32 and the reverse rollers 33.

Note that the banknote cassette 17 rotates both the feed rollers 32 and the reverse rollers 33 in the clockwise direction, and circumferential side faces of the feed rollers 32 are provided with the high friction catch portions 32A.

If two or more banknotes BL are conveyed out by the picker rollers 37 in an overlapping state, the banknotes BL are thereby separated into individual notes by advancing only the uppermost banknote BL toward the rear and leaving any other banknotes BL in the collection space CS. The banknote BL then advances toward the rear through the conveyance guide 23, and is conveyed into the banknote pay-in/pay-out device 10 by the conveyance section 13 (FIG. 2).

The banknote cassette 17 can accordingly neatly collect banknotes BL inside the collection space CS by adjusting the separation between the front guides 26 and the reverse guide 24 to the guide separation L1 that is slightly longer than the short edge length L2 of the banknotes BL.

1-3. Configuration of the Position Adjustment Sections

Next, explanation follows regarding configuration of the position adjustment sections 25. As illustrated in FIG. 4B, although the position adjustment sections 25 of the banknote cassettes 17 are respectively provided at the upper side and lower side of each of the front guides 26, the following explanation is centered on the single position adjustment section 25 provided at the upper side of a single front guide 26.

Note that the position adjustment sections 25 provided at the lower side of the front guides 26 have an up-down inverted symmetrical configuration to the position adjustment sections 25 provided at the upper side of the front guides 26.

Figure 6:
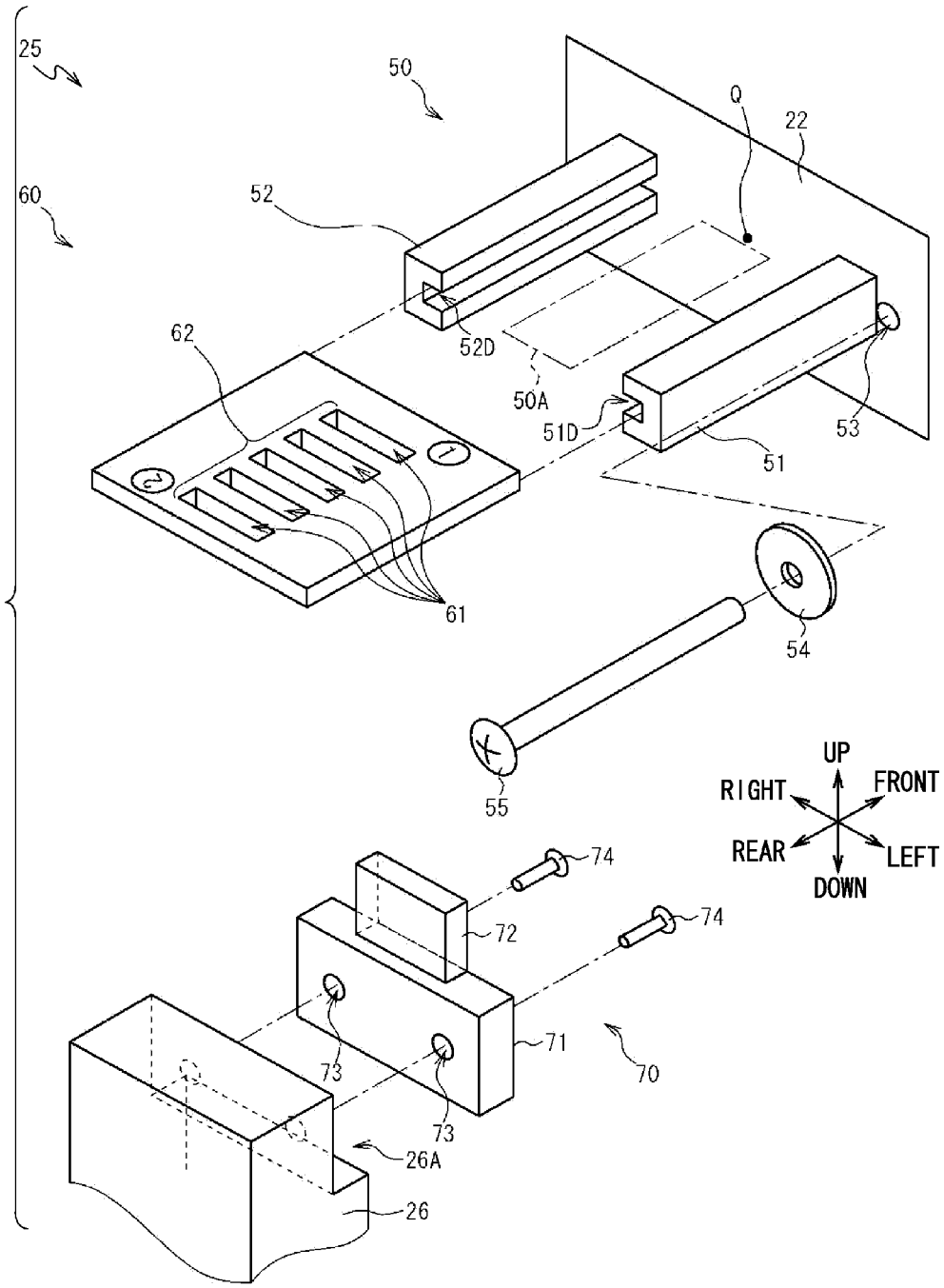
FIG. 6 is a schematic perspective view illustrating a configuration of a position adjustment section according to a first exemplary embodiment.

As illustrated in the schematic exploded perspective view of FIG. 6, the position adjustment section 25 is configured, broadly speaking, from a holder 50, an adjustment plate 60, and an insertion portion 70.

1-3-1. Holder Configuration

Configuration of the holder 50 centers on two holding arms 51 and 52 that are provided projecting out from the front side plate 22 toward the front.

The holding arm 51 is configured in a rectangular block shape that is long in the front-rear direction and short in the up-down direction and left-right direction. A groove 51D that runs along the front-rear direction and is recessed further toward the left direction than the periphery, is formed at an up-down central portion of a right side face of the holding arm 51.

The holding arm 52 is provided on the right side of the holding arm 51, at a location separated from the holding arm 51 by a specific separation that is longer than the left-right direction length of the front guide 26. The holding arm 52 is configured with left-right symmetry to the holding arm 51, and is formed with a groove 52D corresponding to the groove 51D.

For ease of explanation, in the following description a point on the rear face of the front side plate 22 substantially in the middle between the holding arm 51 and the holding arm 52 is referred to as a holder reference point Q, this being a position reference point in the holder 50. A range with length running from front to rear behind the holder reference point Q and between the groove 51D and the groove 52D is referred to as an insertable range 50A.

A screw hole 53 is formed to the front side plate 22 at the left side of the holding arm 51. A fixing screw 55 passes through a washer 54 and is screwed together with the screw hole 53.

1-3-2. Adjustment Plate Configuration

The adjustment plate 60 serving as an adjustment body is configured from a specific metal material, and is formed in a flattened rectangular block shape that is thin from top to bottom, in other words, in a rectangular plate shape with the plate faces facing in the up-down direction.

Insertion holes 61 serving as fitting portions are formed to the adjustment plate 60. The insertion holes 61 are flattened angular holes that are long from left to right, and short from front to rear, and pass through the adjustment plate 60 in the thickness direction. Plural of the insertion holes 61 are formed at every specific separation in the front-rear direction, this being the adjustment direction, thereby configuring an insertion hole row 62 serving as a fitting portion row.

Figure 7:
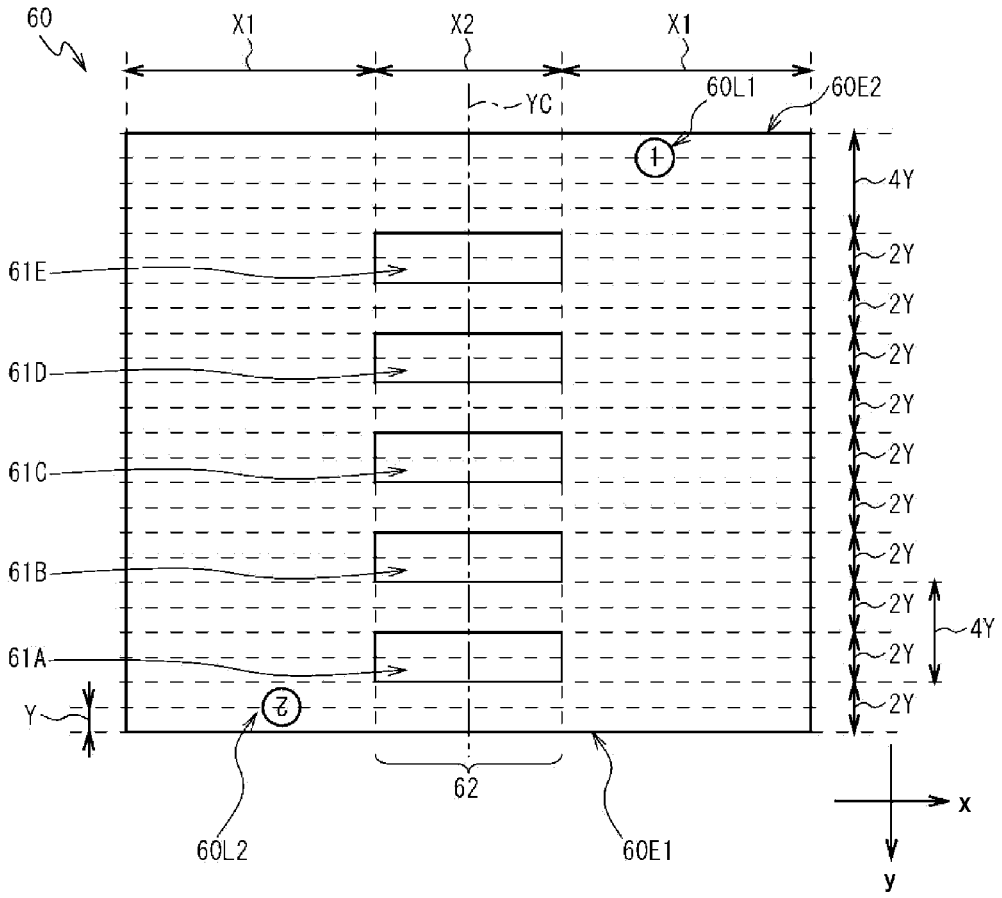
FIG. 7 is a schematic view illustrating a configuration of an adjustment plate according to the first exemplary embodiment.

As illustrated in FIG. 7, in the adjustment plate 60, the insertion holes 61 have a specific length X2 and are positioned at central portions separated from both respective ends of the adjustment plate 60 by a length X1 along an x direction corresponding to the left-right direction in FIG. 6.

Moreover, in the adjustment plate 60, five of the insertion holes 61 (61A, 61B, 61C, 61D, and 61E) are positioned so as to be aligned with a scale with units of a specific small length Y along a y direction corresponding to the front-rear direction in FIG. 6. The length Y is, for example, between approximately 0.3 mm and 2 mm.

The insertion hole 61A is an angular hole of length X2 in the x direction and of length 2Y (namely twice the length Y) in the y direction, formed at a location separated by length 2Y from a first edge 60E1. Namely, the insertion hole 61A has a rectangular shape in the xy plane, the rectangular shape maintaining the length X2 in the x direction and length 2Y in the y direction even when rotated by a half turn.

The insertion hole 61B is formed as an angular hole of length X2 in the x direction and of length 2Y in the y direction, similarly to the insertion hole 61A, at a location separated from the insertion hole 61A by length 2Y in the y direction, namely at a location separated from the first edge 60E1 by length 6Y in the y direction.

Similarly, the insertion holes 61C, 61D, and 61E are each formed as an angular hole of length X2 in the x direction and of length 2Y in the y direction, and at mutual separations of 2Y in the y direction, thereby giving a sequential array running along a straight line in the y direction.

The distance between the insertion holes 61A, 61B, 61C, 61D and 61E, and the first edge 60E1 are thus respectively lengths 2Y, 6Y, 10Y, 14Y, and 18Y, or 2Y+n×4Y when expressed as a formula (wherein n is an integer from 0 to 4).

A separation between the insertion hole 61E and a second edge 60E2 is length 4Y. The separations between the insertion holes 61E, 61D, 61C, 61B and 61A, and the second edge 60E2 are thus respectively lengths 4Y, 8Y, 12Y, 16Y, and 20Y, or n×4Y when expressed as a formula (wherein n is an integer from 1 to 5).

Namely, in the adjustment plate 60 the insertion holes 61A to 61E are arrayed at even separations in a cycle of length 4Y along the y direction, and the separations from the insertion holes 61 to the first edge 60E1 and the second edge 60E2 respectively differ by length 2Y.

From the perspectives of manufacturing time and cost, the respective insertion holes 61 in the adjustment plate 60 are formed by a punch process (known as punching) as a manufacturing process enabling mass production. This means that the minimum length of holes that can be formed in the adjustment plate 60 is 2Y, and the minimum separation between adjacent holes is also 2Y.

The adjustment plate 60 is engraved with an engraving 60L1 configured by the number 1 enclosed in a circle in the vicinity of the second edge 60E2, and engraved with an engraving 60L2 configured by the number 2 enclosed in a circle in the vicinity of the first edge 60E1.

The overall adjustment plate 60 is formed with line symmetry about a y axis line YC running through the x direction center of the adjustment plate 60 in the y direction. This thereby enables the same overall shape of the adjustment plate 60, as well as the shapes and positions of the insertion holes 61A to 61E, to be maintained as before being rotated by a half turn, even when the plate face is rotated by a half turn about the y axis line YC.

The adjustment plate 60 is accordingly engraved on the back side with an engraving 60L1 similar to the engraving 60L1 in the vicinity of the second edge 60E2, and engraved on the back side with an engraving 60L2 similar to the engraving 60L2 in the vicinity of the first edge 60E1. This enables the adjustment plate 60 to be handled in the same manner regardless of the face.

As illustrated in FIG. 6, the left and right edge portions of the adjustment plate 60 are respectively inserted into the grooves 51D and 52D of the holding arms 51 and 52 of the holder 50, and the fixing screw 55 that passes through the washer 54 is screwed together with the screw hole 53, thereby holding the adjustment plate 60 in the holder 50 with the insertion holes 61 facing in the downward direction, this being the holding direction.

Figure 8A:
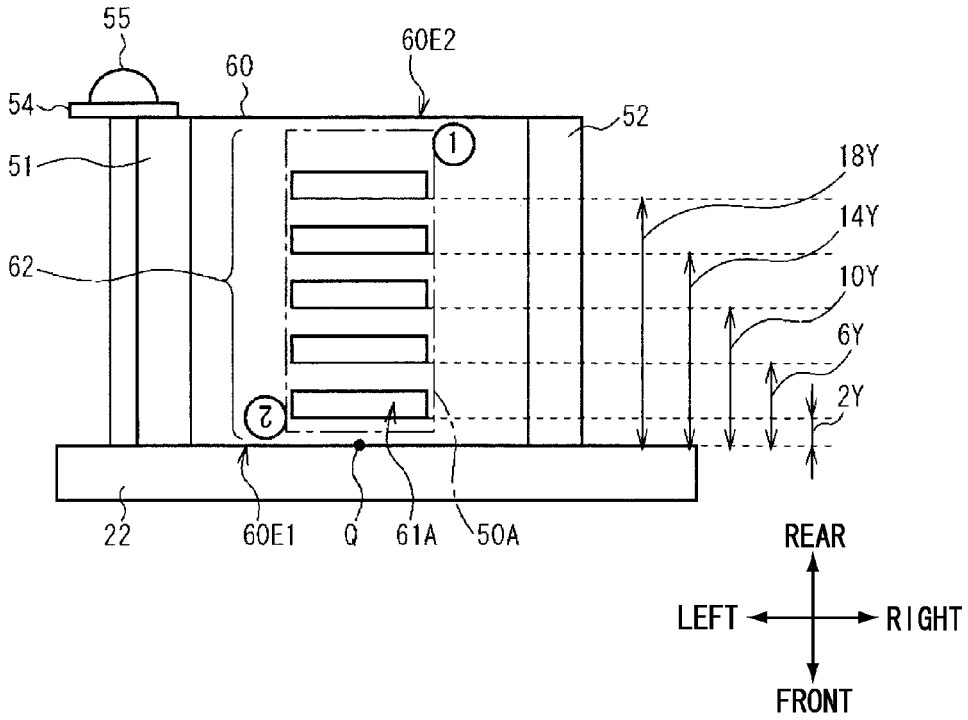
FIG. 8A is a schematic view illustrating a holding mode of the first exemplary embodiment.
Figure 8B:
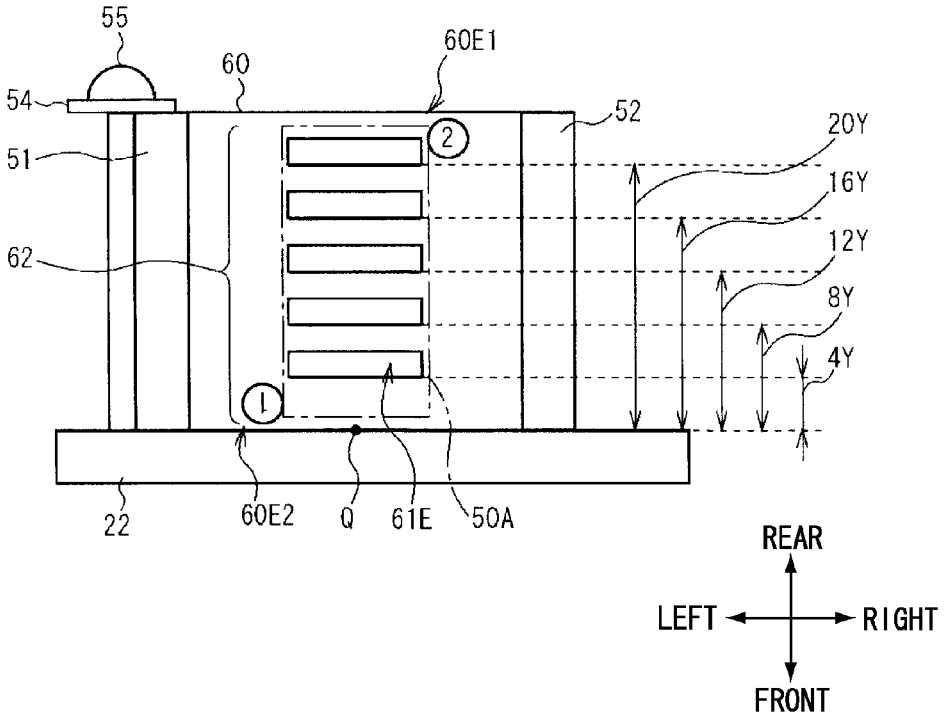
FIG. 8B is a schematic view illustrating a holding mode of the first exemplary embodiment.

Note that as illustrated in FIG. 8A and FIG. 8B, the adjustment plate 60 is holdable by the holder 50 in two holding modes.

Whichever the holding mode, the insertion hole row 62 of the adjustment plate 60 is positioned within the insertable range 50A serving as a fittable range.

FIG. 8A illustrates a holding mode in which the first edge 60E1 of the adjustment plate 60 faces toward the front and is in contact with the holder reference point Q of the front side plate 22, and the second edge 60E2 faces toward the rear. This holding mode is referred to as the first holding mode in the following explanation.

In the first holding mode, the distance from the holder reference point Q to the respective insertion holes 61A to 61E is respectively lengths 2Y, 6Y, and so on, up to 18Y.

FIG. 8B illustrates a holding mode in which the second edge 60E2 of the adjustment plate 60 faces toward the front and is in contact with the holder reference point Q of the front side plate 22, and the first edge 60E1 faces toward the rear. This holding mode is referred to as the second holding mode in the following explanation.

In the second holding mode, the distance from the holder reference point Q to the respective insertion holes 61E to 61A is respectively lengths 4Y, 8Y, and so on, up to 20Y.

In this manner, the insertion holes 61A to 61E of the insertion hole row 62 of the adjustment plate 60 are positioned in a cycle of length 4Y along the y direction, with the distance from the first edge 60E1 to the insertion hole 61A and the distance from the second edge 60E2 to the insertion hole 61E differing by length 2Y.

Accordingly, when the adjustment plate 60 is held by the holder 50 in either the first holding mode or the second holding mode, the respective distances from the holder reference point Q to each of the insertion holes 61A to 61E form equal cycles of length 4Y, and differ from each other by a length 2Y, this being half a cycle.

1-3-3. Insertion Portion Configuration

Configuration of the insertion portion 70 (FIG. 6), serving as an adjustable body, centers around a base 71 and an insertion projection 72. The base 71 is formed in a rectangular block shape that is thin in the front-rear direction, and is formed with two screw holes 73 piercing through in the front-rear direction.

The insertion projection 72, serving as a fitted portion, is formed in a rectangular block shape that is thin from front to rear, and is installed upright so as to project out upward from an upper face of the base 71. As illustrated in the plan view of FIG. 9, the insertion projection 72 is provided at a position somewhat offset toward the front side with respect to the base 71, such that the front face thereof is aligned with that of the base 71.

The insertion projection 72 has a length 2Y in the front-rear direction, and has a length X2 in the left-right direction. This enables insertion of the insertion projection 72 into the insertion holes 61A to 61E of the adjustment plate 60.

As illustrated in FIG. 6, attachment portions 26A are formed in the vicinity of the upper ends of the front guides 26 by partially removing the front face side. Screw holes are formed at two locations in a rear face of the attachment portions 26A. Attachment portions 26A are also formed with top-bottom inverted symmetry in the vicinity of lower ends of the front guides 26.

Each of the insertion portions 70 is attached to the respective front guide 26 by inserting two attachment screws 74 through the screw holes 73 at two locations of the insertion portion 70, and screwing into the respective screw holes of the attachment portion 26A.

Figure 10A:
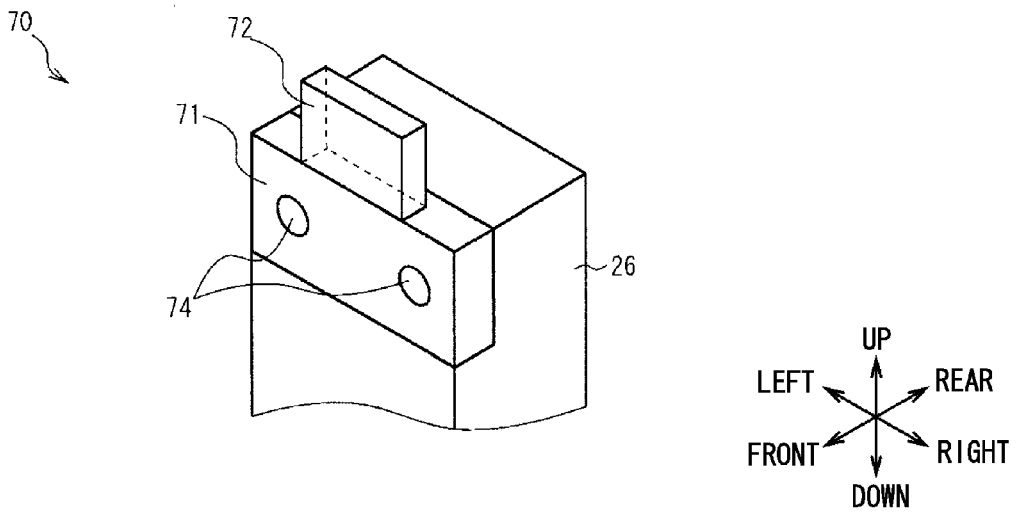
FIG. 10A is a schematic view illustrating attachment of an insertion portion to a front guide in the first exemplary embodiment.
Figure 10B:
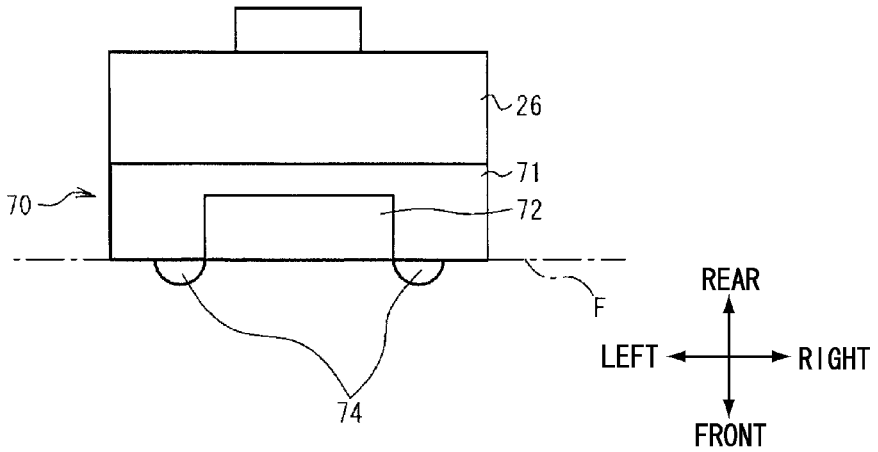
FIG. 10B is a schematic view illustrating attachment of an insertion portion to a front guide in the first exemplary embodiment.

As illustrated in FIG. 10A and FIG. 10B, when each of the insertion portions 70 is attached to the front guides 26, the front faces of the bases 71 and the insertion projections 72 are substantially aligned with the front faces of the front guides 26.

For ease of explanation, a line representing the front faces of the front guide 26, the bases 71 and the insertion projections 72 is referred to below as the front face line F.

In the insertion portion 70, the insertion projection 72 is thus integrated with the front guide 26 by attaching to the front guide 26.

1-4. Operation and Advantageous Effects

In the position adjustment sections 25 in the banknote cassette 17 of the first exemplary embodiment configured as described above, the insertion projections 72 of the insertion portions 70 attached to the front guides 26 at both the upper side and lower side of the front guides 26 are inserted into given insertion holes 61 in the insertion hole rows 62 of the adjustment plates 60.

In each holder 50, the adjustment plate 60 is inserted between the grooves 51D and 52D of the holding arms 51 and 52, and the fixing screw 55 is inserted through the washer 54 and screwed together with the screw hole 53, thereby holding the adjustment plate 60 with the insertion hole row 62 positioned in the insertable range 50A.

This thereby enables the position adjustment sections 25 to fix the position of the front guides 26 to which the insertion portions 70 are attached.

Note that in cases in which the position adjustment sections 25 are in the first holding mode (FIG. 8A) in which the first edge 60E1 of the adjustment plate 60 contacts the holder reference point Q, the front guide 26 and the front face line F of the insertion portion 70 can be positioned at discrete locations away from the holder reference point Q at a cycle of length 4Y, namely at lengths of 2Y, 6Y, 10Y, 14Y, and 18Y.

In cases in which the position adjustment sections 25 are in the second holding mode (FIG. 8B) in which the second edge 60E2 of the adjustment plate 60 contacts the holder reference point Q, the front guide 26 and the front face line F of the insertion portion 70 can be positioned at discrete locations away from the holder reference point Q at a cycle of length 4Y, namely at lengths of 4Y, 8Y, 12Y, 16Y, and 20Y.

Note that when the respective distances from the holder reference point Q to the front guide 26 and the front face line F of the insertion portion 70, namely the positions with respect to the holder reference point Q, such as lengths 2Y and 4Y, are compared between the first holding mode and the second holding mode, the smallest distance between the two positions is a length 2Y, this being shorter than the length 4Y that is the cycle of the insertion holes 61 along the y direction.

Thus in the position adjustment section 25, combining the first holding mode and the second holding mode, between which the orientation direction of the adjustment plate 60 differs with respect to the holder 50, enables the front guide 26 and the front face line F of the insertion portion 70 to be positioned at discrete locations at intervals of length 2Y, namely at 2Y, 4Y, 6Y, and so on, up to 18Y or 20Y.

To look at it from another perspective, due to the limitations of the manufacturing process, etc. described above, it is unavoidable that the cycle of the insertion holes 61 of the adjustment plate 60 along the y direction will be a length 4Y or greater.

The position of the front guide 26 and the front face line F of the insertion portion 70 can therefore only be adjusted in intervals of length 4Y if the insertion position of the insertion projection 72 is simply adjusted with respect to the insertion hole row 62 of the adjustment plate 60 in the position adjustment section 25.

Accordingly, in the position adjustment section 25, making the distance from the first edge 60E1 to the insertion hole 61A and the distance from the second edge 60E2 to the insertion hole 61E differ by a length 2Y enables the adjustment plate 60 to be switched between two holding modes by using the holder 50.

By switching between the first holding mode and the second holding mode as appropriate, the position adjustment section 25 thereby enables the position of the front guide 26 and the front face line F of the insertion portion 70 to be adjusted in intervals of length 2Y, this being shorter than the length 4Y that is the cycle of the respective insertion holes 61 in the insertion hole row 62.

Specifically, in an adjustment operation of the position adjustment section 25, the front guide 26 can be adjusted to the desired position in units of 2Y simply by removing the fixing screw 55 of the holder 50, taking out the adjustment plate 60 from the grooves 51D and 52D and reversing the front-rear direction of the adjustment plate 60 as required, varying the insertion position of the insertion projection 72 with respect to the insertion hole row 62, and reattaching the fixing screw 55.

Figure 11A:
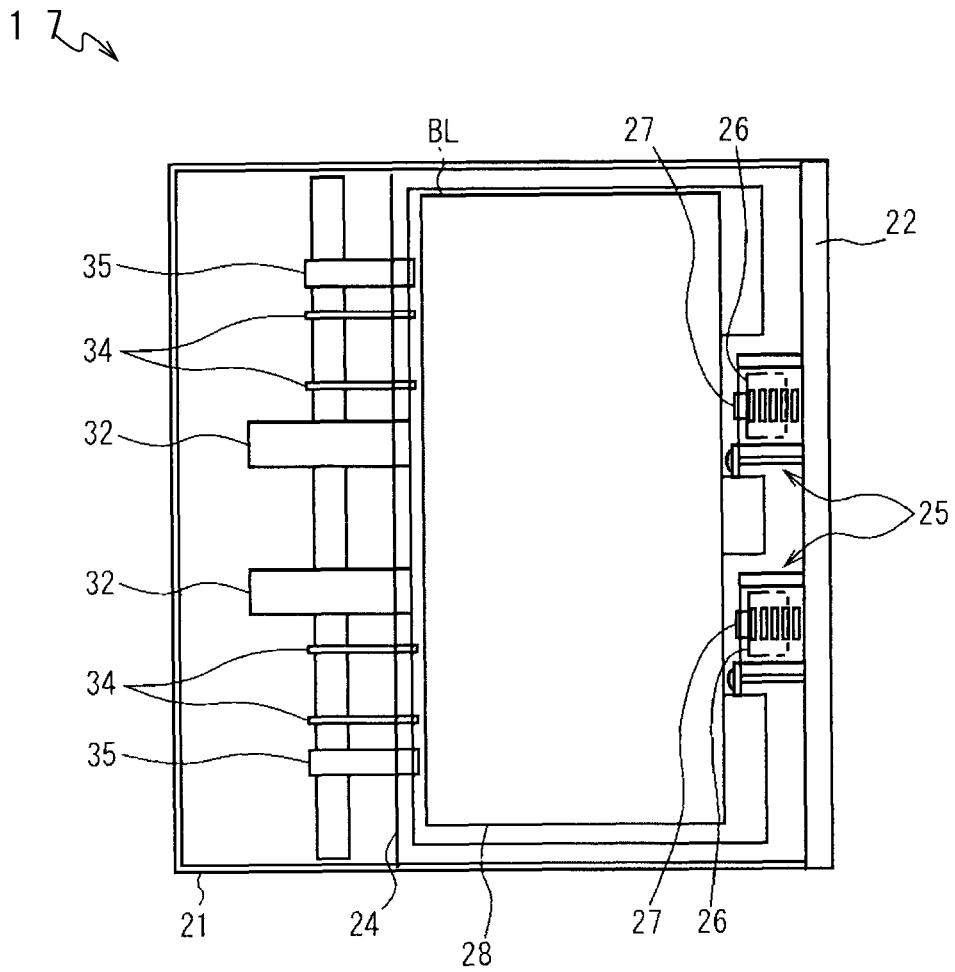
FIG. 11A is a schematic view illustrating positional adjustment of a front guide in the first exemplary embodiment.
Figure 11B:
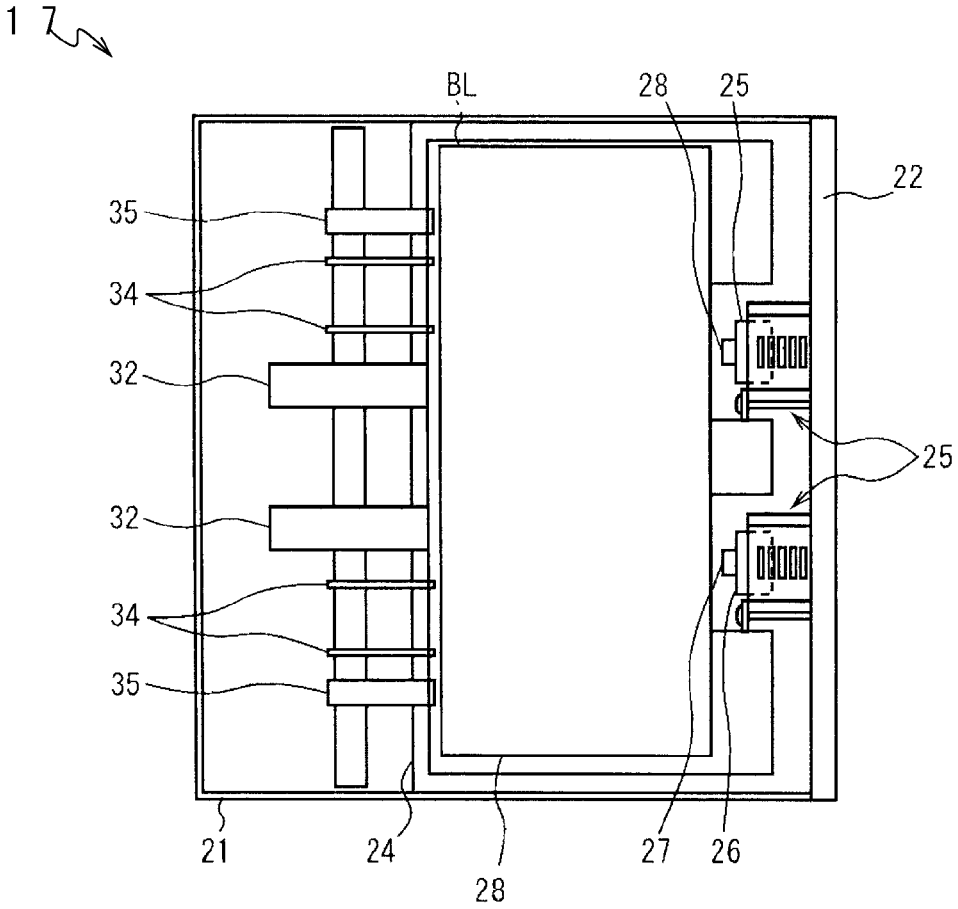
FIG. 11B is a schematic view illustrating positional adjustment of a front guide in the first exemplary embodiment.
Figure 34A:
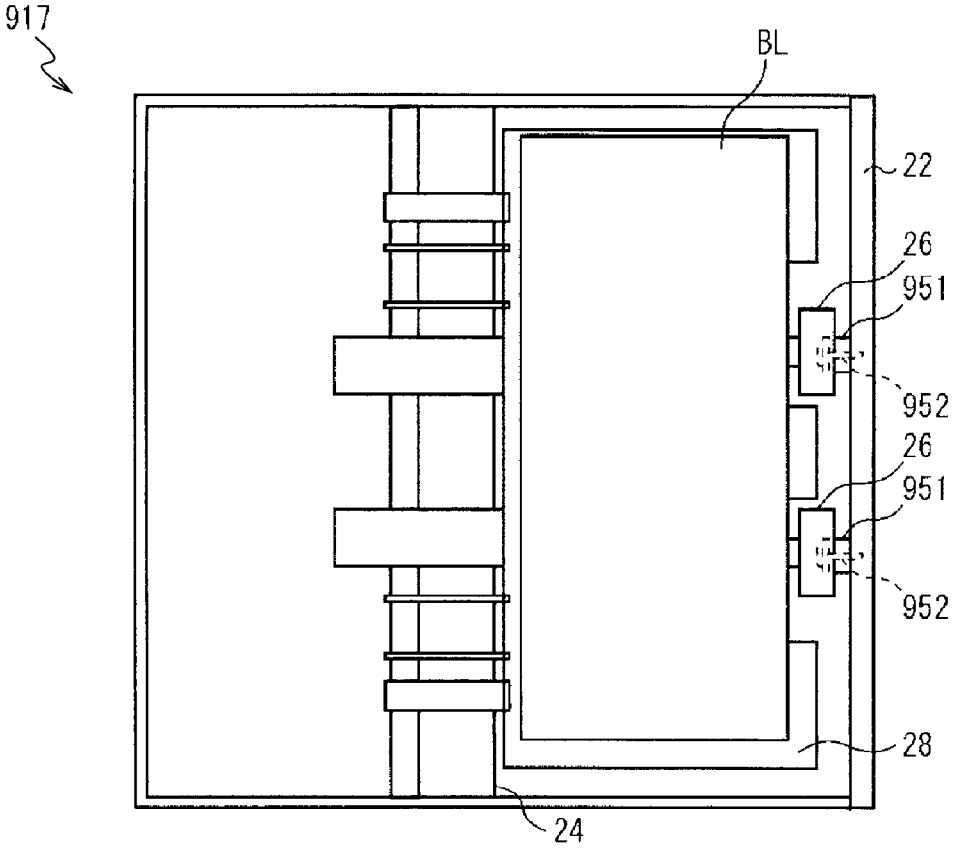
FIG.34A RELATED ART
FIG. 34A is a schematic view illustrating positional adjustment of a front guide in a banknote cassette of related technology.
Figure 34B:
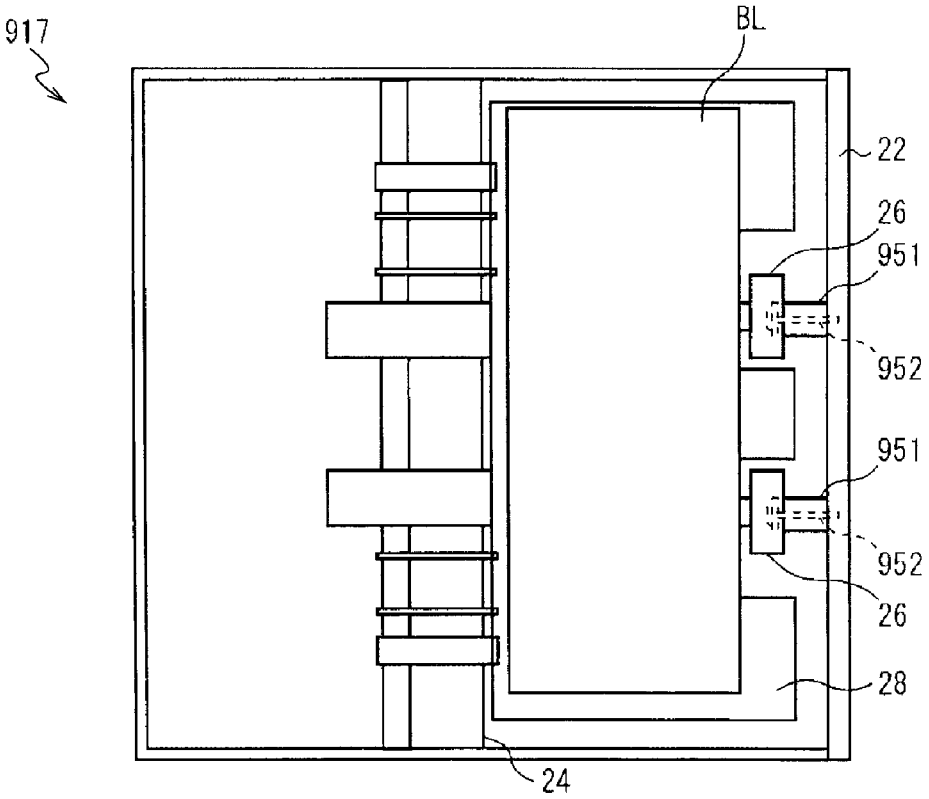
FIG.34B RELATED ART
FIG. 34B is a schematic view illustrating positional adjustment of a front guide in a banknote cassette of related technology.

As a result, as illustrated in FIG. 11A and FIG. 11B, respectively corresponding to FIG. 34A and FIG. 34B, in the banknote cassette 17 the position of the front guides 26 in the front-rear direction can be adjusted without replacing any components of the position adjustment sections 25.

The position adjustment section 25 accordingly does not require the production of any replacement components such as plural types of collars 951 and attachment screws 952 of different lengths.

Even if there is a change in the type of banknotes BL to be stored in the banknote cassette 17 after the automated teller machine 1 has been brought into operation and the short edge length L2 changes, there is no need to arrange for additional components, and the front guide 26 can be moved to the desired position straight away to vary the guide separation L1.

The adjustment plate 60 also maintains sufficient strength due to leaving a separation of 2Y in the y direction between each of the insertion holes 61 of the insertion hole row 62 (FIG. 7).

In an inserted state of the insertion projection 72 of the insertion portion 70 attached to the front guide 26 into the insertion holes 61, the adjustment plate 60 does not sustain damage to the insertion holes 61 even when imparted with external shocks accompanying transportation of the banknote cassette 17 or the like, enabling the position of the insertion projection 72 and the front guide 26 to be maintained.

Figure 9:
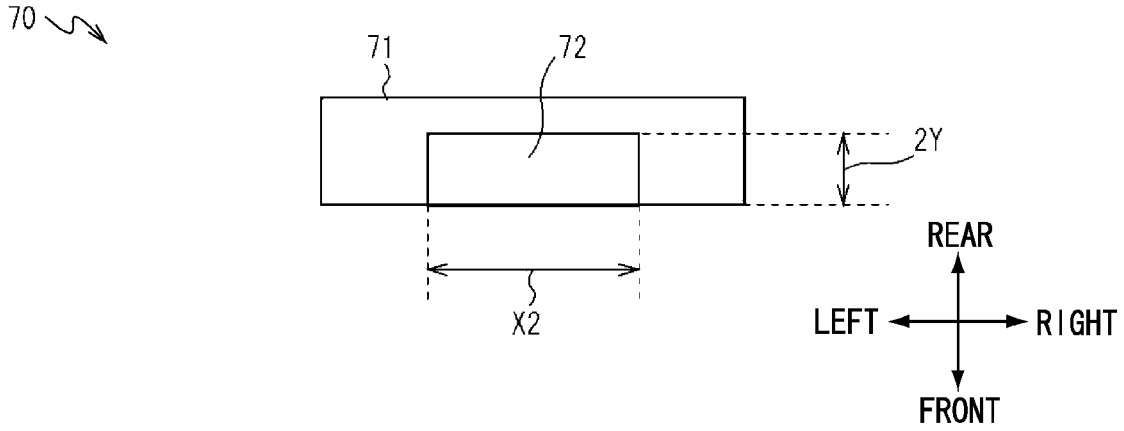
FIG. 9 is a schematic view illustrating a configuration of an insertion portion of the first exemplary embodiment.

In particular, the shapes of the respective insertion holes 61 of the adjustment plate 60 are rectangular shapes in the xy plane, configuring angular holes with symmetry in the x direction and the y direction (FIG. 6, FIG. 7). The shape of the insertion projection 72 of the insertion portion 70 is a rectangular block shape of a size enabling insertion into the insertion holes 61 (FIG. 6, FIG. 9).

The position adjustment section 25 accordingly enables insertion of the insertion projection 72 of the insertion portion 70 in either the first holding mode or the second holding mode without changing the shape of the insertion holes 61, regardless of which out of the first edge 60E1 and the second edge 60E2 of the adjustment plate 60 is facing the front.

The adjustment plate 60 is moreover formed with the insertion hole row 62 in which the respective insertion holes 61 are disposed along the y direction at the x direction center.

The position adjustment section 25 thereby enables the insertion hole row 62 to be positioned in the insertable range 50A substantially in the middle between the holding arms 51 and 52, regardless of which out of the second edge 60E2 and the second edge 60E2 of the adjustment plate 60 held by the holder 50 is facing the front.

Namely, the position adjustment section 25 enables common application of the respective insertion holes 61 of the insertion hole row 62 in both the first holding mode and the second holding mode, obviating the need to form two or more insertion hole rows 62 in the adjustment plate 60, and enabling the time and effort involved in manufacture, namely manufacturing costs, to be suppressed to a minimum.

The position adjustment section 25 enables the insertion hole row 62 to be positioned in the insertable range 50A in both the first holding mode and the second holding mode, thereby enabling the position of the front guide 26 to be adjusted in steps of 2Y in the front-rear direction alone, without varying the positions of the front guide 26 in the left-right direction and the up-down direction with respect to other components of the banknote cassette 17.

Accompanying this, the bill stoppers 27 attached to the front guides 26 also change position in the front-rear direction only. This thereby enables the position of the bill stoppers 27 in the left-right direction and the up-down direction to be maintained with respect to the gate G (FIG. 3), enabling the bill stoppers 27 to absorb the impact at an appropriate position when struck by a discharged banknote BL.

The length of the insertion projection 72 of the insertion portion 70 in the up-down direction is configured sufficiently longer than the thickness of the adjustment plate 60 (FIG. 6) in the position adjustment section 25, enabling the insertion projection 72 to pierce through the adjustment plate 60 when inserted into the insertion holes 61 (FIG. 3).

Accordingly, even supposing that the positioning precision of the holder 50 with respect to the front side plate 22 was low, with a degree of play in the up-down direction between the front guide 26 to which the insertion portion 70 is attached and the banknote cassette 17 in an inserted state of the insertion projection 72 into the insertion holes 61 of the adjustment plate 60 held in the holder 50, the position adjustment section 25 is still capable of preventing the insertion projection 72 from coming out from the insertion holes 61, and of maintaining the position of the front guide 26 in the front-rear direction.

The adjustment plate 60 is moreover engraved with the engravings 60L2 and 60L1 in the vicinity of the first edge 60E1 and the second edge 60E2 respectively (FIG. 6, FIG. 7, FIG. 8A, FIG. 8B).

This thereby enables the adjustment plate 60 to be inserted into the grooves 51D and 52D of the holder 50 in the correct direction for the desired adjustment position of the front guide 26, by looking at the engravings 60L2 and 60L1 as a mark when a maintenance technician switches the holding mode of the adjustment plate 60 by the holder 50.

In the position adjustment section 25 of the first exemplary embodiment configured as described above, the insertion holes 61A to 61E of the insertion hole row 62 of the adjustment plate 60 are disposed at a cycle of length 4Y along the y direction, and the distance from the first edge 60E1 to the insertion hole 61A and the distance from the second edge 60E2 to the insertion hole 61E is made to differ by length 2Y. The holder 50 is configured to hold the adjustment plate 60 in two holding modes with the orientation direction of the adjustment plate 60 in mutually opposite directions, namely the first holding mode and the second holding mode, in which either the first edge 60E1 or the second edge 60E2 is in contact with the holder reference point Q. By switching between the first holding mode and the second holding mode as appropriate, the position adjustment section 25 is able to adjust the position of the front face line F in units of length 2Y when the insertion projection 72 of the insertion portion 70 attached to the front guide 26 is inserted into one of the insertion holes 61 of the insertion hole row 62.

2. Second Exemplary Embodiment

In a second exemplary embodiment, the position of the front guides 26 is adjusted using position adjustment sections 125 in place of the position adjustment sections 25 of the first exemplary embodiment.

2-1. Position Adjustment Section Configuration

Figure 12:
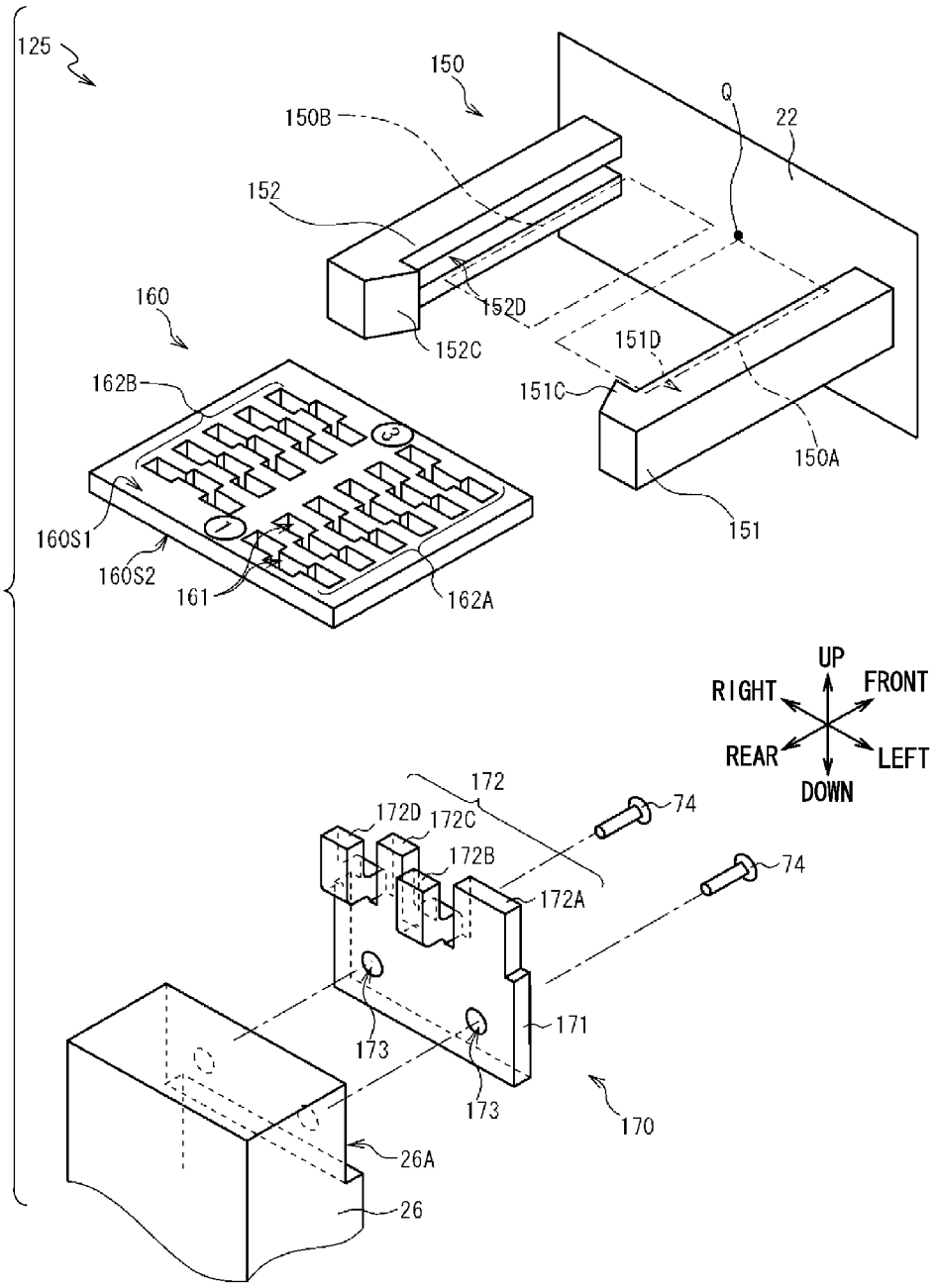
FIG. 12 is a schematic perspective view illustrating a configuration of a position adjustment section according to a second exemplary embodiment.

As illustrated in FIG. 12, corresponding to FIG. 6, each position adjustment section 125 is configured by a holder 150, an adjustment plate 160, and an insertion portion 170, respectively corresponding to the holder 50, the adjustment plate 60, and the insertion portion 70.

2-1-1. Holder Configuration

Figure 13A:
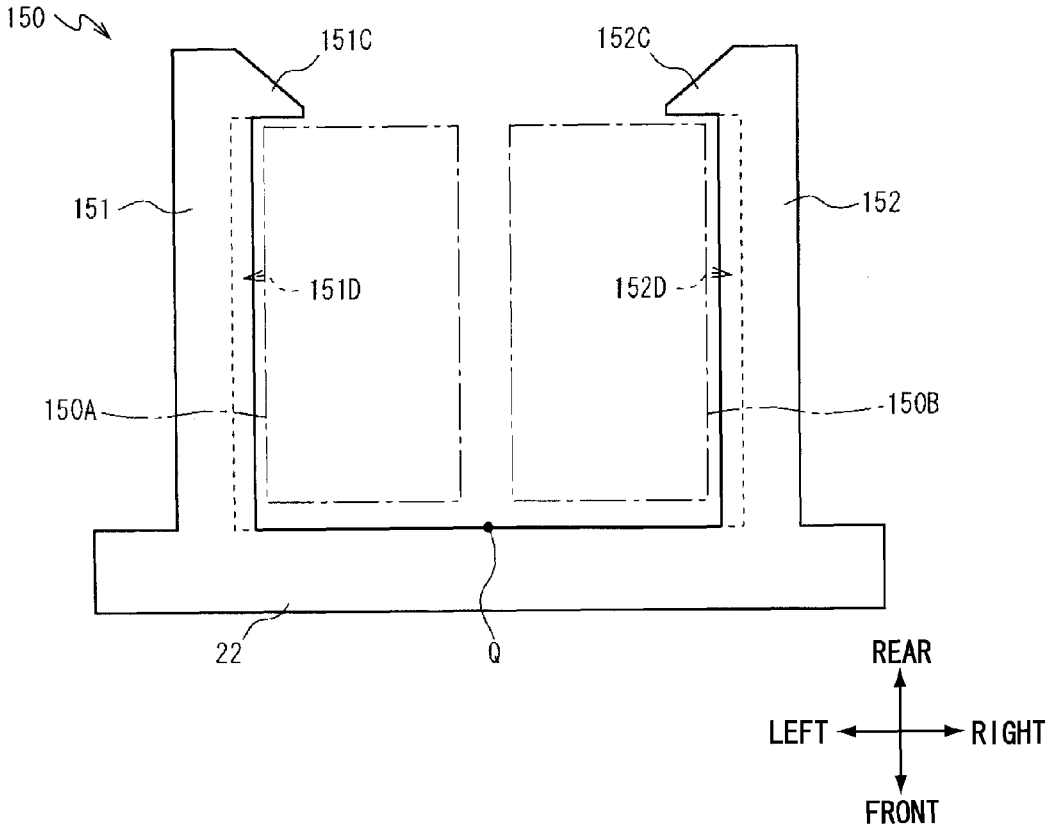
FIG. 13A is a schematic view illustrating a configuration of a holder according to the second exemplary embodiment.

As illustrated in the plan view of FIG. 13A, the holder 150 differs from the holder 50 of the first exemplary embodiment in the provision of holding arms 151 and 152 in place of the holding arms 51 and 52, and in not including the screw hole 53, the washer 54, or the fixing screw 55.

The holding arm 151 is configured from a flexible material, and includes a groove 151D similar to the groove 51D of the holding arm 51, and is also provided with a holding claw 151C at a rear end of the holding arm 151.

The holding claw 151C is configured by bending into a hook shape toward the right direction where a rear end portion of the holding arm 151 extends slightly further to the rear than the holding arm 51 (FIG. 6). The holding claw 151C closes off the rear end of the groove 151D.

A front face of the holding claw 151C projecting out toward the right direction is formed in a flat plane shape substantially parallel to the rear face of the front side plate 22. A rear side portion of the holding claw 151C forms an inclined face inclined in the rear direction toward the right.

The holding arm 152 is configured with left-right symmetry to the holding arm 151, includes a groove 152D similar to the groove 52D, and is also provided with a holding claw 152C bent into a hook shape toward the left direction at a rear end portion of the holding arm 152.

For ease of explanation, in the second exemplary embodiment, behind the holder reference point Q, ranges with their lengths along the front-rear direction at the left side and the right side of the center of a space between the grooves 151D and 152D are referred to as a first insertable range 150A and second insertable range 150B, respectively.

Since the respective holding arms 151 and 152 are flexible, they each flex so as to widen a separation between the holding claws 151C and 152C when external force toward the left and right outsides, namely in a moving apart direction, is temporarily applied in the vicinity of the rear ends thereof.

Then, when the applied external force is released, the holding arms 151 and 152 return to their original positions, to give a state in which the separation between the holding claws 151C and 152C is shorter than the separation between the grooves 151D and 152D.

2-1-2. Adjustment Plate Configuration

The adjustment plate 160 (FIG. 12) is similar to the adjustment plate 60 (FIG. 6) overall, and is configured from a specific metal material in a flattened rectangular block shape that is thin from top to bottom. However, plural insertion holes 161 are formed in place of the insertion holes 61.

Figure 14A:
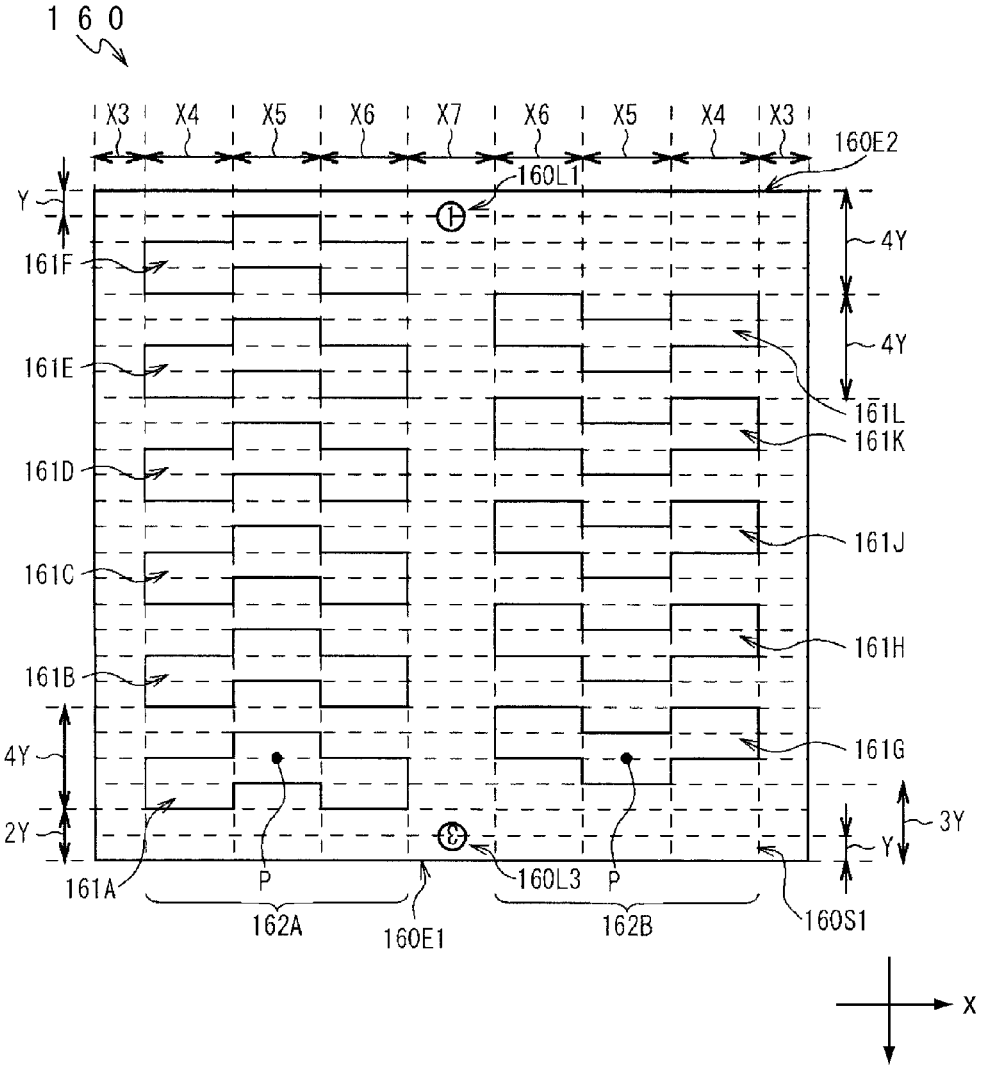
FIG. 14A is a schematic view illustrating a configuration of an adjustment plate according to the second exemplary embodiment.

As illustrated in FIG. 14A corresponding to FIG. 7, the adjustment plate 160 is provided with a first insertion hole row 162A of six insertion holes 161A, 161B, 161C, 161D, 161E and 161F in a row along the y direction, and a second insertion hole row 162B of five insertion holes 161G, 161H, 161J, 161K, and 161L in a row along the y direction.

For ease of explanation, in the following, the plate face of the adjustment plate 160 that faces upward in FIG. 12 and out of the page in FIG. 14A, is referred to as a first face 160S1, and the opposite face thereto is referred to as a second face 160S2.

Figure 14B:
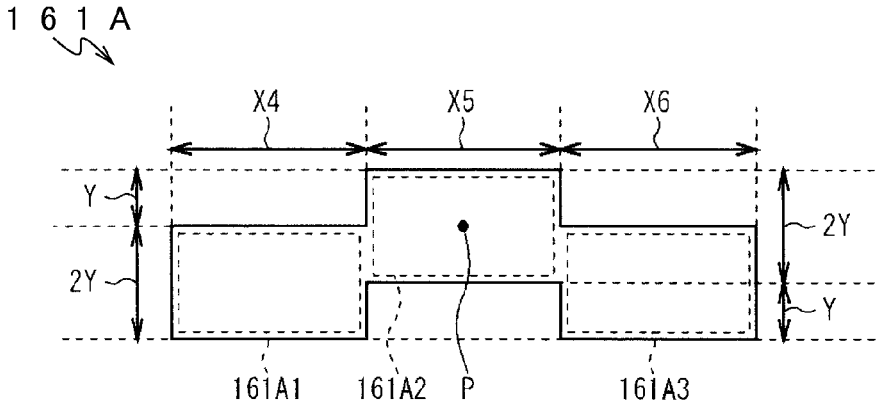
FIG. 14B is a schematic view illustrating a configuration of an adjustment plate according to the second exemplary embodiment.

As illustrated in the enlarged FIG. 14B, the insertion holes 161A are different in shape to the insertion holes 61A (FIG. 7) of the first exemplary embodiment, and three angular hole shaped hole portions 161A1, 161A2, and 161A3 are linked together with each other in a snaking pattern along the x direction, to form a crank shape.

The hole portion 161A1 is an angular hole with a length X4 in the x direction and a length 2Y in the y direction. The hole portion 161A2 is an angular hole with a length X4 in the x direction and a length 2Y in the y direction, and is provided linked to the hole portion 161A1 in the x direction, at a position offset with respect to the hole portion 161A1 by a distance Y in the y direction.

The hole portion 161A3 is an angular hole with a length X6 in the x direction and a length 2Y in the y direction, and is provided linked to the hole portion 161A2, on the opposite side to the hole portion 161A1 in the x direction, at a position offset with respect to the hole portion 161A2 by the distance Y in the y direction, toward the direction approaching the hole portion 161A1. The length X6 is substantially the same as the length X4.

In other words, the hole width of the insertion hole 161A is a uniform length 2Y along the y direction; however the portion of length X5 at the center in the x direction is at a position shifted by the length Y in the y direction relative to the two adjacent portions, namely the length X4 portion and length X6 portion.

Figure 14C:
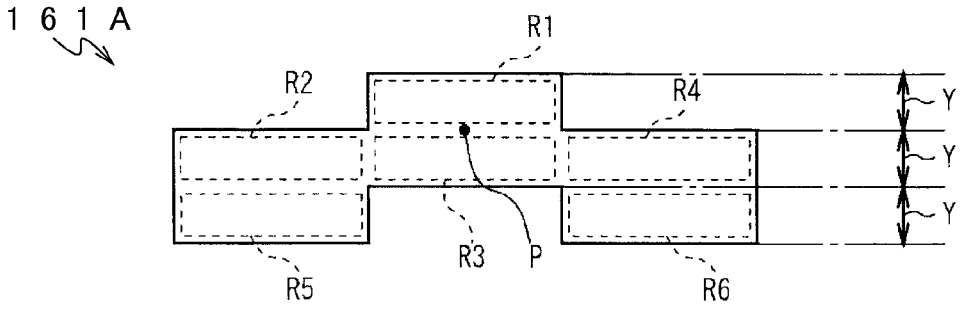
FIG. 14C is a schematic view illustrating a configuration of an adjustment plate according to the second exemplary embodiment.

For ease of explanation, a point at the center of the hole portion 161A2 is referred to below as the insertion hole center point P. As illustrated in FIG. 14C, respective regions formed when the hole portions 161A1, 161A2, and 161A3 are divided up by the length Y in the y direction are referred to as regions R1, R2, R3, R4, R5, and R6.

As viewed from the region R1 of the insertion hole 161A, the regions R5 and R6 are at a separation of the distance Y in the y direction.

As illustrated in FIG. 14A, the insertion hole 161A is separated from one x direction edge of the adjustment plate 160 (the left edge in the drawing) by a length X3, and is positioned at a location separated from a first edge 160E1, this being one y direction edge (the bottom edge in the drawing), by the length 2Y.

The insertion hole 161B is formed in a similar shape to the insertion hole 161A, with respective portions of length X4, X5, and X6 each separated from the insertion hole 161A by length 2Y in the y direction.

The insertion hole 161B is thus separated from the insertion hole 161A by exactly length 2Y, and is at a distance of length 6Y from the first edge 160E1.

As viewed from the region R1 (FIG. 14C) of the insertion hole 161A, the regions R5 and R6 of the insertion hole 161B are separated by the distance Y on the opposite side to the regions R5 and R6 of the insertion hole 161A in the y direction.

Similarly to the insertion hole 161B, the insertion holes 161C, 161D, 161E, and 161F are each formed in a similar shape to the insertion hole 161A, in a sequential array in a straight line along the y direction so as to be at mutual separations of exactly length 2Y in the y direction. The separation between the insertion hole 161F and the second edge 160E2 is the length Y.

Focusing on the regions R1 (FIG. 14C) of each of the insertion holes 161A to 161F, the distances (separations) from the first edge 160E1 are respectively lengths 4Y, 8Y, 12Y, 16Y, 20Y, and 24Y, or 4Y+n×4Y when expressed as a formula (wherein n is an integer from 0 to 5).

The distances (separations) from the second edge 160E2 to the regions R1 of the respective insertion holes 161F to 161A are respectively lengths Y, 5Y, 9Y, 13Y, 17Y, and 21Y, or Y+n×4Y when expressed as a formula (wherein n is an integer from 0 to 5).

The insertion holes 161A to 161F of the first insertion hole row 162A are thus arrayed at equal separations in a cycle of length 4Y in the y direction.

The insertion hole 161G of the second insertion hole row 162B is separated from the other x direction edge (the right edge in the drawings) of the adjustment plate 160 by a length X3 in the x direction, and is disposed at a location separated from the first edge 160E1 by a length 3Y. The insertion hole 161G is formed in a shape rotated by a half turn in the xy plane with respect to the insertion hole 161A.

The insertion hole 161G is disposed at a separation of length X7 from the insertion hole 161A in the x direction.

Focusing on the insertion holes 161A and 161G, each has a distance of length 4Y from the first edge 160E1 to the insertion hole center point P.

Accordingly in the adjustment plate 160, the region R1 of the insertion hole 161G and the regions R2, R3, and R4 of the insertion hole 161A are each at a separation of the length 3Y as viewed from the first edge 160E1. Moreover in the adjustment plate 160, the regions R2, R3, and R4 of the insertion hole 161G and the region R1 of the insertion hole 161A are each at a separation of the length 4Y as viewed from the first edge 160E1.

The insertion holes 161H to 161L are each formed in a similar shape to the insertion hole 161G, in a sequential array in a straight line along the y direction so as to be at mutual separations of exactly length 2Y in the y direction. The separation between the insertion hole 161L and the second edge 160E2 is the length 4Y.

Focusing on the regions R1 (FIG. 14C) of each of the insertion holes 161G to 161L, the distances (separations) from the first edge 160E1 are respectively lengths 3Y, 7Y, 11Y, 15Y, and 19Y, or 3Y+n×4Y when expressed as a formula (wherein n is an integer from 0 to 4).

The distances (separations) from the second edge 160E2 to the regions R1 of the respective insertion holes 161L to 161G are respectively lengths 6Y, 10Y, 14Y, 18Y, and 22Y, or 6Y+n×4Y when expressed as a formula (wherein n is an integer from 0 to 4).

The insertion holes 161G to 161L of the second insertion hole row 162B are thus arrayed at equal separations in a cycle of length 4Y in the y direction.

Focusing on the insertion holes 161A and 161L, the length 2Y that is the distance from the first edge 160E1 to the insertion hole 161A, and the length 4Y that is the distance from the second edge 160E2 to the insertion hole 161L, differ by the length 2Y, this being half a cycle.

Focusing on the insertion holes 161G and 161F, the length 3Y that is the distance from the first edge 160E1 to the insertion hole 161G, and the length Y that is the distance from the second edge 160E2 to the insertion hole 161F, differ by the length 2Y, this being half a cycle.

In this manner, in the adjustment plate 160 the six insertion holes 161A to 161F of the first insertion hole row 162A are disposed at a cycle of length 4F along the y direction, and the five insertion holes 161G to 161L of the second insertion hole row 162B are disposed at a cycle of length 4F along the y direction.

In the adjustment plate 160, the first insertion hole row 162A and the second insertion hole row 162B are formed in directions in which the respective insertion holes 161 have been rotated by a half turn in the xy plane with respect to the other. The separations between the first edge 160E1 and the second edge 160E2 and the respective insertion holes 161 differ by length 2Y between the first insertion hole row 162A and the second insertion hole row 162B.

The first face 160S1 of the adjustment plate 160 is engraved with an engraving 160L1 configured by the number 1 enclosed in a circle in the vicinity of the second edge 160E2, and engraved with an engraving 160L3 configured by the number 3 enclosed in a circle in the vicinity of the first edge 160E1.

As will be described later, the second face 160S2 of the adjustment plate 160 is engraved with an engraving 160L2 configured by the number 2 enclosed in a circle in the vicinity of the second edge 160E2, and engraved with an engraving 160L4 configured by the number 4 enclosed in a circle in the vicinity of the first edge 160E1.

The holder 150 (FIG. 13A) is capable of releasing the adjustment plate 160 from the grooves 151D and 152D by temporarily flexing when external force to pull the holding claws 151C and 152C apart in the left-right direction is applied to the holding arms 151 and 152 as described above.

Figure 13B:
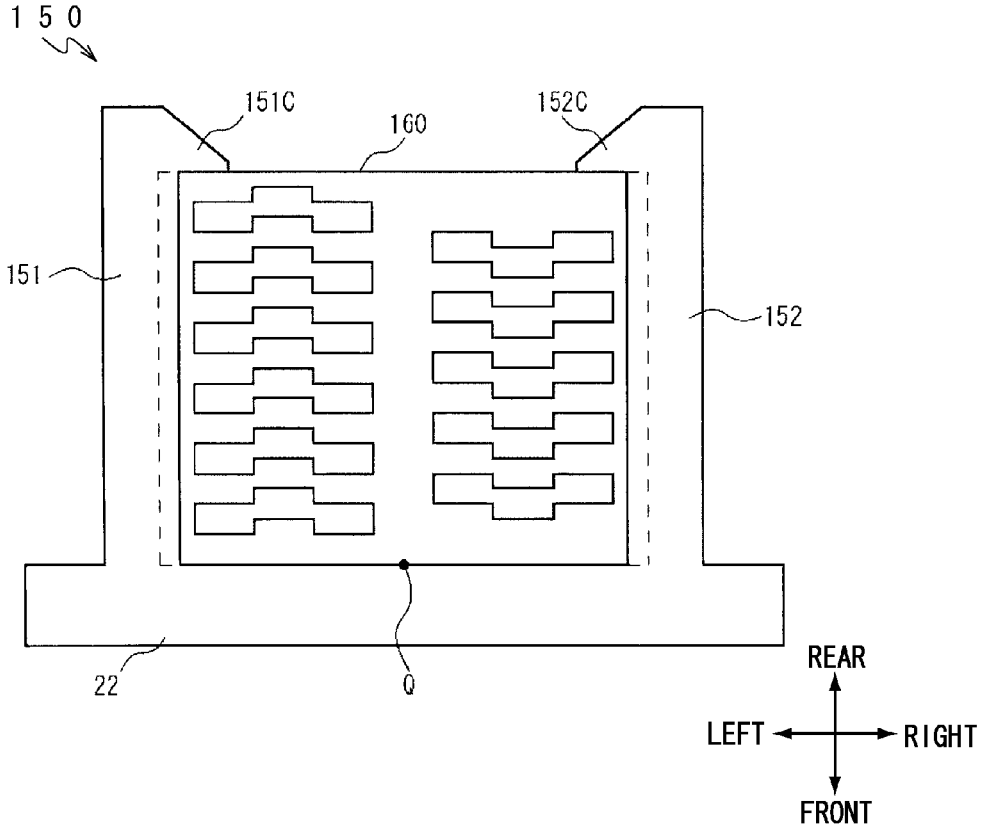
FIG. 13B is a schematic view illustrating a configuration of a holder according to the second exemplary embodiment.

In the holder 150, the adjustment plate 160 is inserted in a flexed state of the holding arms 151 and 152 applied with external force to pull the holding claws 151C and 152C apart in the left-right direction, and the adjustment plate 160 is held as illustrated in FIG. 13B due to the holding arms 151 and 152 returning to their original shape when the external force is released.

As illustrated in FIGS. 15A, 15B, 15C, and 15D, the holder 150 can hold the adjustment plate 160 in four holding modes.

Figure 15A:
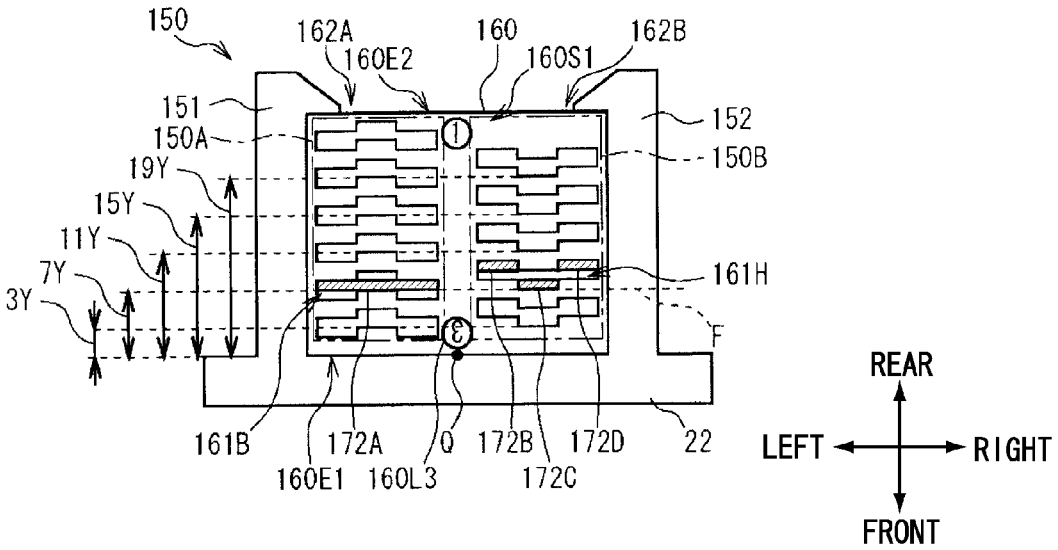
FIG. 15A is a schematic view illustrating a holding mode in the second exemplary embodiment.

FIG. 15A illustrates a holding mode in which the first face 160S1 of the adjustment plate 160 faces upward (out of the page in the drawing) and the first edge 160E1 faces toward the front and contacts the holder reference point Q of the front side plate 22, with the second edge 160E2, in the vicinity of which with the engraving 160L1 is engraved, facing toward the rear. In this state, the first insertion hole row 162A is positioned within the first insertable range 150A, and the second insertion hole row 162B is positioned within the second insertable range 150B. This holding mode is referred to below as the first holding mode of the present exemplary embodiment.

In the first holding mode, the respective distances from the holder reference point Q to the regions R1 (FIG. 14C) of the respective insertion holes 161G to 161L in the second insertable range 150B are lengths 3Y, 7Y, and so on, up to 19Y.

Figure 15B:
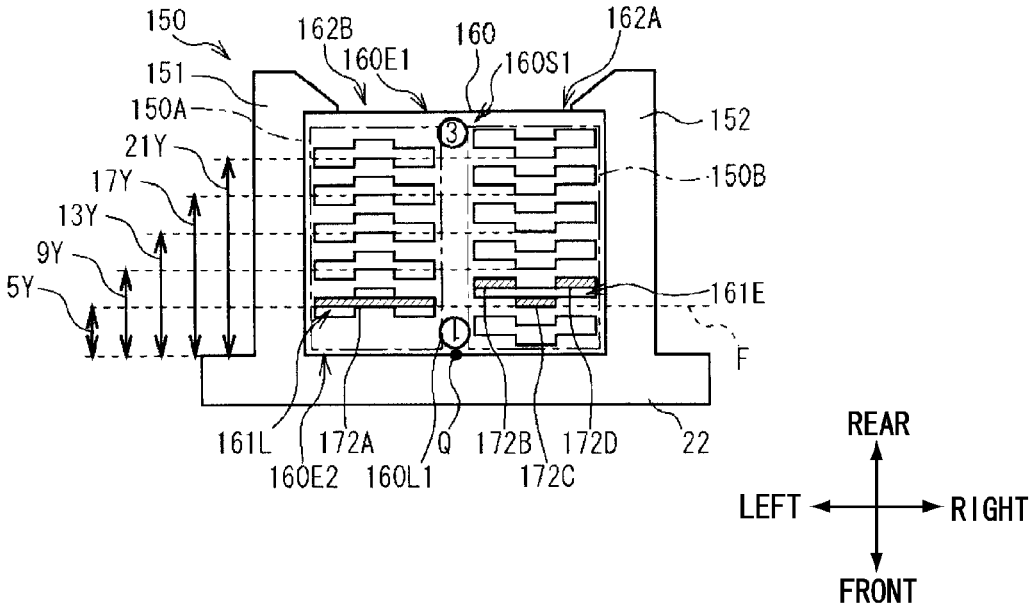
FIG. 15B is a schematic view illustrating a holding mode in the second exemplary embodiment.

FIG. 15B illustrates a holding mode in which the first face 160S1 of the adjustment plate 160 faces upward and the second edge 160E2 faces toward the front and contacts the holder reference point Q of the front side plate 22, with the first edge 160E1, in the vicinity of which the engraving 160L3 is engraved, facing toward the rear. In this state, the second insertion hole row 162B is positioned within the first insertable range 150A, and the first insertion hole row 162A is positioned within the second insertable range 150B. This holding mode is referred to below as the second holding mode of the present exemplary embodiment.

In the second holding mode, the adjustment plate 160 is in a state rotated by a half turn in the horizontal direction with respect to the first holding mode (FIG. 15A).

In the second holding mode, the respective distances from the holder reference point Q to the regions R1 (FIG. 14C) of the respective insertion holes 161B to 161F in the second insertable range 150B are lengths 5Y, 9Y, and so on, up to 21Y.

Figure 15C:
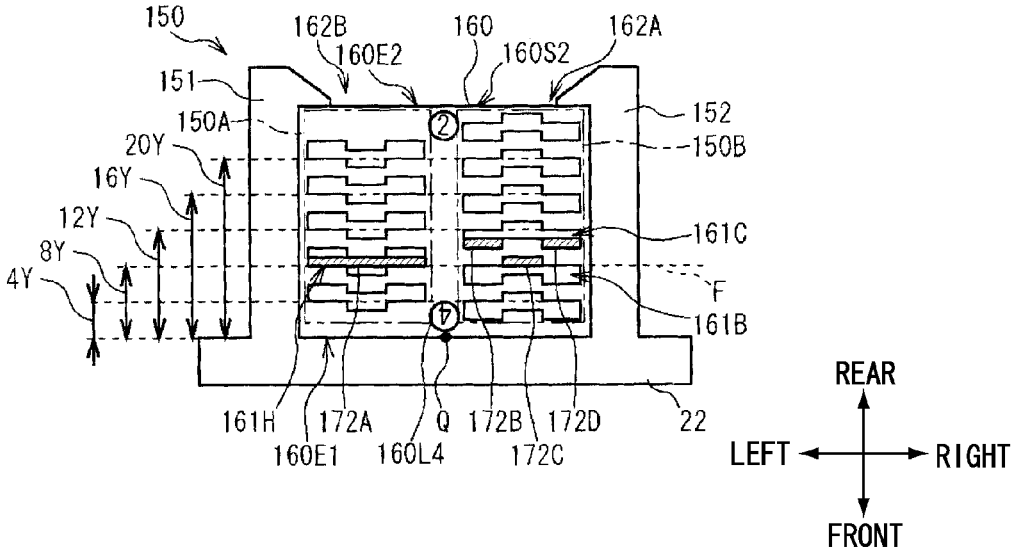
FIG. 15C is a schematic view illustrating a holding mode in the second exemplary embodiment.

FIG. 15C illustrates a holding mode in which the second face 160S2 of the adjustment plate 160 faces upward and the first edge 160E1 faces toward the front and contacts the holder reference point Q of the front side plate 22, with the second edge 160E2, in the vicinity of which the engraving 160L2 is engraved, facing toward the rear. In this state, the second insertion hole row 162B is positioned within the first insertable range 150A, and the first insertion hole row 162A is positioned within the second insertable range 150B. This holding mode is referred to below as the third holding mode of the present exemplary embodiment.

In the third holding mode, the adjustment plate 160 is in a state rotated by a half turn about a rotation axis running along the front-rear direction with respect to the first holding mode (FIG. 15A).

In the third holding mode, the respective distances from the holder reference point Q to the regions R1 (FIG. 14C) of the respective insertion holes 161B to 161F in the second insertable range 150B are lengths 4Y, 8Y, and so on, up to 20Y.

Figure 15D:
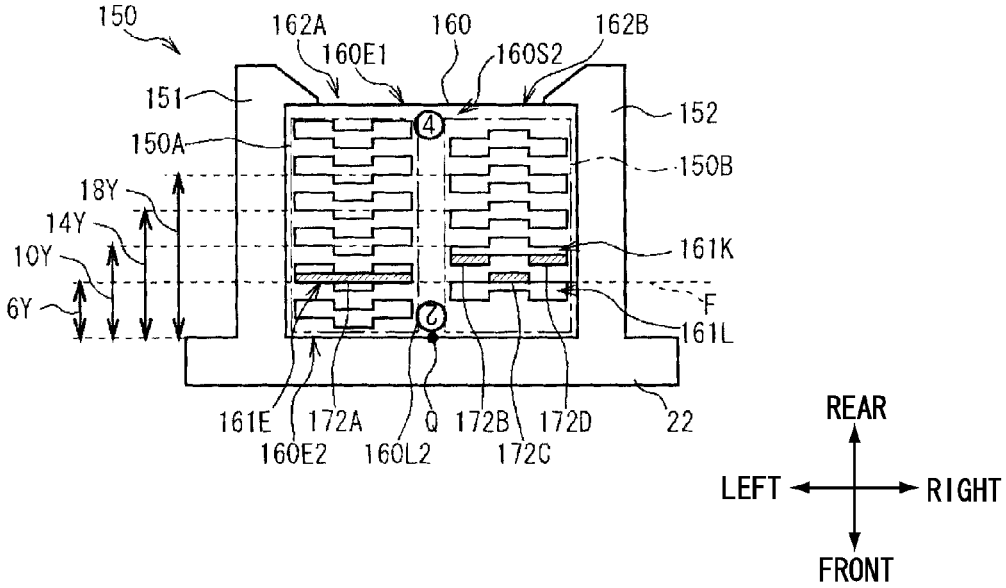
FIG. 15D is a schematic view illustrating a holding mode in the second exemplary embodiment.

FIG. 15D illustrates a holding mode in which the second face 160S2 of the adjustment plate 160 faces upward and the second edge 160E2 faces toward the front and contacts the holder reference point Q of the front side plate 22, with the first edge 160E1, in the vicinity of which the engraving 160L4 is engraved, facing toward the rear. In this state, the first insertion hole row 162A is positioned within the first insertable range 150A, and the second insertion hole row 162B is positioned within the second insertable range 150B. This holding mode is referred to below as the fourth holding mode of the present exemplary embodiment.

In the fourth holding mode, the adjustment plate 160 is in a state rotated by a half turn about a rotation axis running along the left-right direction with respect to the first holding mode (FIG. 15A).

In the fourth holding mode, the respective distances from the holder reference point Q to the regions R1 (FIG. 14C) of the respective insertion holes 161G to 161K in the second insertable range 150B are lengths 6Y, 10Y, 14Y, and 18Y.

In the adjustment plate 160, the six insertion holes 161A to 161F of the first insertion hole row 162A are disposed at a cycle of length 4Y in the y direction, and the five insertion holes 161G to 161L of the second insertion hole row 162B are disposed at a cycle of length 4Y in the y direction.

The respective insertion holes 161 of the adjustment plate 160 face in mutually opposite directions between the first insertion hole row 162A and the second insertion hole row 162B, and the distances from the first edge 160E1 and the second edge 160E2 to the respective insertion holes 161 differ by 2Y between the insertion hole rows 162A and 162B.

When the adjustment plate 160 is held in the holder 150 in the first holding mode, the second holding mode, the third holding mode, and the fourth holding mode, the respective distances from the holder reference point Q to the regions R1 of the respective insertion holes 161 in the second insertable range 150B each have cycles of equal length 4Y, and differ by length Y between each of the holding modes.

2-1-3. Insertion Portion Configuration

Configuration of the insertion portion 170 (FIG. 12) centers around a base 171 and an insertion projection 172. The base 171 is formed in a rectangular block shape that is thinner in the front-rear direction than the base 71 of the first exemplary embodiment, and is formed with two screw holes 173 piercing through in the front-rear direction. The thickness of the base 171 in the front-rear direction is length Y.

Figure 16:
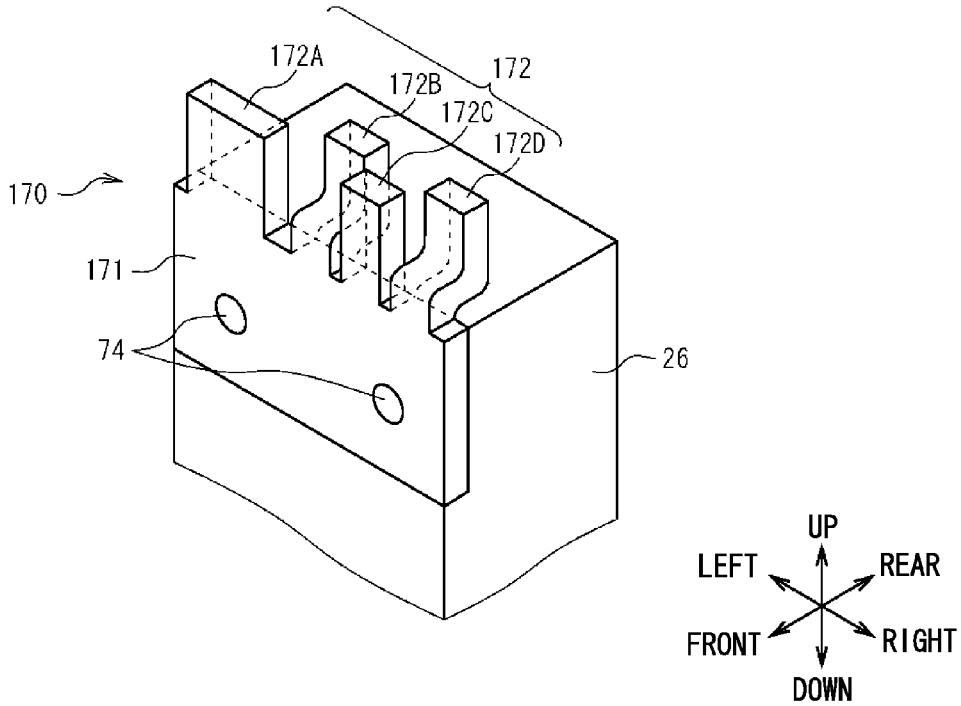
FIG. 16 is a schematic perspective view illustrating attachment of an insertion portion to a front guide according to the second exemplary embodiment.

As illustrated in FIG. 16, the insertion projection 172 is configured by four insertion projections 172A, 172B, 172C, and 172D.

The insertion projection 172A is installed upright so as to project upward from a portion toward the left of an upper face of the base 171, and is formed in a rectangular block shape that is thin from front to rear, and long from top to bottom.

Figure 17:
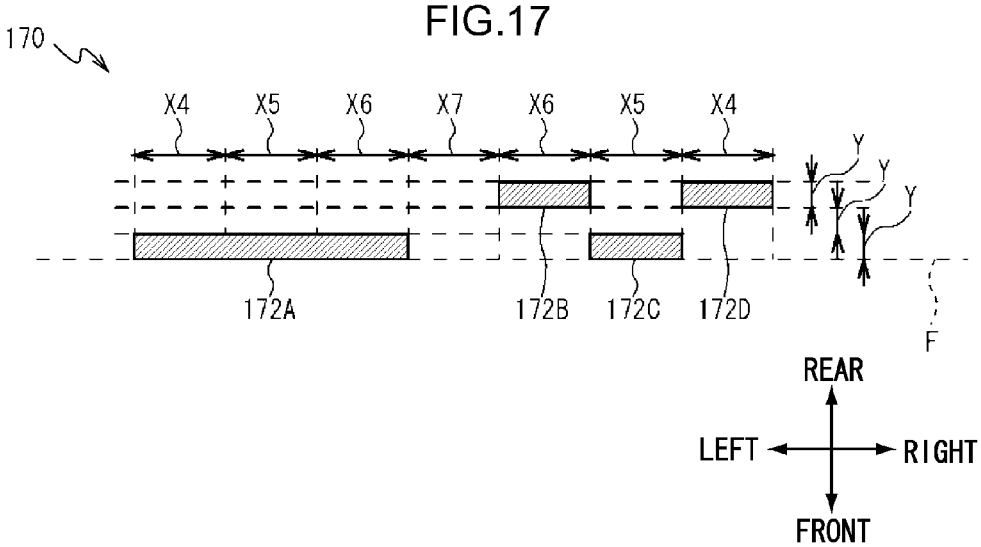
FIG. 17 is a schematic view illustrating a configuration of an insertion portion in the second exemplary embodiment.

As illustrated in the plan view of FIG. 17, the insertion projection 172A has a length in the left-right direction corresponding to the sum of lengths X4, X5, and X6, and a length Y in the front-rear direction.

The insertion projection 172B is installed upright so as to project upward from a portion to the right of the left-right center of the upper face of the base 171, is thin in thickness from front to rear, and is a long thin shape running from top to bottom. The insertion projection 172B is bent so as to extend slightly upward from the upper face of the base 171, then bends around toward the rear, before bending around to face upright again.

As illustrated in FIG. 17, the insertion projection 172B has a left-right direction length of length X6, and has a the front-rear direction length of length Y. The insertion projection 172B is positioned so as to be separated toward the right direction by length X7 and separated toward the rear direction by length Y as viewed from the insertion projection 172A.

The insertion projection 172C is installed upright so as to project upward from the upper face of the base 171, adjacent to the right side of the insertion projection 172B, and is formed in a rectangular block shape that is thin in thickness from front to rear, and is a long thin shape running from top to bottom.

As illustrated in FIG. 17, the insertion projection 172C has a left-right direction length of length X5, and has a front-rear direction length of length Y. The insertion projection 172C is positioned so as to be separated by length Y toward the front direction as viewed from the insertion projection 172B, and is at a position aligned with the insertion projection 172A in the front-rear direction.

The insertion projection 172D is installed upright so as to project from the upper face of the base 171, adjacent to the right side of the insertion projection 172B, and is formed in a shape that is thin in thickness from front to rear, and is a long thin shape running from top to bottom. Similarly to the insertion projection 172B, the insertion projection 172D is bent so as to extend slightly upward from the upper face of the base 171, then bends around toward the rear, before bending around to face upright again.

As illustrated in FIG. 17, the insertion projection 172D has a left-right direction length of length X4, and has a front-rear direction length of length Y. The insertion projection 172D is positioned so as to be separated by length Y toward the rear direction as viewed from the insertion projection 172C, and is at a position aligned with the insertion projection 172B in the front-rear direction.

As illustrated in FIG. 16, similarly to the insertion portion 70 of the first exemplary embodiment, the insertion portion 170 is attached to the front guide 26 by inserting two attachment screws 74 through the respective two screw holes 173, and screwing together with the respective screw holes in the attachment portions 26A.

When each of the insertion portions 170 are attached to the front guide 26, front faces of the base 171 and the insertion projections 172A and 172C are substantially aligned with the front face of the front guide 26.

For ease of explanation, a line representing the front faces of the front guide 26, the base 171 and the insertion projections 172A and 172C is referred to below as the front face line F in the present exemplary embodiment (FIG. 17).

In the insertion portion 170, similarly to in the first exemplary embodiment, the four insertion projections 172A to 172D are thus integrated with the front guide 26 by attaching to the front guide 26.

2-2. Operation and Advantageous Effects

In the position adjustment section 125 of the second exemplary embodiment configured as described above, the insertion projections 172A to 172D of each of the insertion portions 170 attached to the front guides 26 are inserted into one of the insertion holes 161 of the first insertion hole row 162A or the second insertion hole row 162B of the adjustment plate 160 at both the upper side and the lower side of the front guides 26.

The adjustment plate 160 is inserted between the grooves 151D and 152D in a state in which the holder 150 has been temporarily applied with external force so as to move apart the holding claws 151C and 152C of the holding arms 151 and 152 in the left-right direction, and the external force is then released.

The holder 150 holds the adjustment plate 160 such that the first insertion hole row 162A and the second insertion hole row 162B are respectively positioned in either the first insertable range 150A or the second insertable range 150B. The position adjustment section 125 enables the position of the front guide 26, to which the insertion portion 170 is attached, to be fixed.

The insertion projection 172A (FIG. 12) of the insertion portion 170 is positioned within the first insertable range 150A of the holder 150, and the insertion projections 172B, 172C, and 172D are positioned within the second insertable range 150B of the holder 150.

First, consider a case in which the position adjustment section 125 is in the first holding mode (FIG. 15A), namely when the first face 160S1 of the adjustment plate 160 faces upward and the first edge 160E1 is in contact with the holder reference point Q.

As illustrated in FIG. 15A, when, for example, the insertion projection 172A is positioned in the regions R2, R3, and R4 (FIG. 14C) of the insertion hole 161B, the insertion projections 172B, 172C, and 172D are respectively positioned in the regions R6, R1, and R5 of the insertion hole 161H. In this state, the front guide 26 and the front face line F of the insertion portion 170 are at a distance of length 7Y from the holder reference point Q.

In the first holding mode, the insertion projection 172A may be inserted into any one of the insertion holes 161A to 161E of the first insertion hole row 162A positioned within the first insertable range 150A. The insertion projections 172B, 172C, and 172D are inserted into the corresponding insertion hole 161G to 161L of the second insertion hole row 162B positioned within the second insertable range 150B.

This thereby enables the front guide 26 and the front face line F of the insertion portion 170 to be positioned at discrete locations at a cycle of length 4Y, namely at lengths 3Y, 7Y, 11Y, 15Y, and 19Y.

Next, consider a case in which the position adjustment section 125 is in the second holding mode (FIG. 15B), namely when the when the first face 160S1 of the adjustment plate 160 faces upward and the second edge 160E2 is in contact with the holder reference point Q.

As illustrated in FIG. 15B, when, for example, the insertion projection 172A is positioned in the regions R2, R3, and R4 (FIG. 14C) of the insertion hole 161L, the insertion projections 172B, 172C, and 172D are respectively positioned in the regions R6, R1, and R5 of the insertion hole 161E. In this state, the front guide 26 and the front face line F of the insertion portion 170 are at a distance of length 5Y from the holder reference point Q.

In the second holding mode, the insertion projection 172A may be inserted into any one of the insertion holes 161L to 161G of the second insertion hole row 162B positioned within the first insertable range 150A. The insertion projections 172B, 172C, and 172D are inserted into the corresponding insertion holes 161E to 161A of the first insertion hole row 162A positioned within the second insertable range 150B.

This thereby enables the front guide 26 and the front face line F of the insertion portion 170 to be positioned at discrete locations at a cycle of length 4Y, namely at lengths 5Y, 9Y, 13Y, 17Y, and 21Y.

Next, consider a case in which the position adjustment section 125 is in the third holding mode (FIG. 15C), namely when the when the second face 160S2 of the adjustment plate 160 faces upward and the first edge 160E1 is in contact with the holder reference point Q.

As illustrated in FIG. 15C, when, for example, the insertion projection 172A is positioned in the regions R2, R3, and R4 (FIG. 14C) of the insertion hole 161H, the insertion projection 172C is positioned in the region R1 of the insertion hole 161B, and the insertion projections 172B and 172D are respectively positioned in the regions R5 and R6 of the insertion hole 161C. In this state, the front guide 26 and the front face line F of the insertion portion 170 are at a distance of length 8Y from the holder reference point Q.

In the third holding mode, the insertion projection 172A may be inserted into any one of the insertion holes 161G to 161L of the second insertion hole row 162B positioned within the first insertable range 150A. The insertion projections 172B, 172C, and 172D are inserted into the corresponding insertion holes 161A to 161F of the first insertion hole row 162A positioned within the second insertable range 150B.

This thereby enables the front guide 26 and the front face line F of the insertion portion 170 to be positioned at discrete locations at a cycle of length 4Y, namely at lengths 4Y, 8Y, 12Y, 16Y, and 20Y.

Next, consider a case in which the position adjustment section 125 is in the fourth holding mode (FIG. 15D), namely when the when the second face 160S2 of the adjustment plate 160 faces upward and the second edge 160E2 is in contact with the holder reference point Q.

As illustrated in FIG. 15D, when, for example, the insertion projection 172A is positioned in the regions R2, R3, and R4 (FIG. 14C) of the insertion hole 161E, the insertion projection 172C is positioned in the region R1 of the insertion hole 161L, and the insertion projections 172B and 172D are respectively positioned in the regions R5 and R6 of the insertion hole 161K. In this state, the front guide 26 and the front face line F of the insertion portion 170 are at a distance of length 6Y from the holder reference point Q.

In the fourth holding mode, the insertion projection 172A may be inserted into any one of the insertion holes 161E to 161A of the first insertion hole row 162A positioned within the first insertable range 150A. The insertion projections 172B, 172C, and 172D are inserted into the corresponding insertion holes 161L to 161G of the second insertion hole row 162B positioned within the second insertable range 150B.

This thereby enables the front guide 26 and the front face line F of the insertion portion 170 to be positioned at discrete locations at a cycle of length 4Y, namely at lengths 6Y, 10Y, 14Y, 18Y, and 22Y.

Note that when the respective distances from the holder reference point Q to the front guide 26 and the front face line F of the insertion portion 170, namely the positions with respect to the holder reference point Q, are compared between the first holding mode to the fourth holding mode, the smallest distance between two positions, such as the lengths 3Y and 4Y, is the length Y, this being shorter than the length 4Y that is the cycle of the insertion holes 161 along the y direction.

In the position adjustment section 125, combining the first holding mode, the second holding mode, the third holding mode, and the fourth holding mode, in which the orientation direction and face of the adjustment plate 160 differs with respect to the holder 150, enables the front guide 26 and the front face line F of the insertion portion 170 to be positioned at discrete locations at intervals of length Y, namely at 3Y, 4Y, 5Y, 6Y, and so on, up to 19Y, 20Y, 21Y.

To look at it from another perspective, in the position adjustment section 125, similarly to in the first exemplary embodiment, due to manufacturing process limitations and the like, the respective insertion holes 161 formed in the first insertion hole row 162A and the second insertion hole row 162B of the adjustment plate 160 have a cycle of length 4Y in the y direction.

The position of the front guide 26 and the front face line F of the insertion portion 170 can therefore only be adjusted in intervals of length 4Y if the insertion positions of the insertion projections 172A to 172D are simply adjusted with respect to the first insertion hole row 162A and the second insertion hole row 162B of the adjustment plate 160 in the position adjustment section 125.

Thus, in the adjustment plate 160 (FIG. 14A), the distance from the first edge 160E1 to the insertion hole 161A and the distance from the second edge 160E2 to the insertion hole 161L differ by length 2Y, and the distance from the first edge 160E1 to the insertion hole 161F and the distance from the second edge 160E2 to the insertion hole 161G are made to differ by length 2Y.

The insertion holes 161A to 161F of the first insertion hole row 162A and the insertion holes 161G to 161L of the second insertion hole row 162B moreover are formed in the adjustment plate 160 with shapes each rotated by a half turn in the xy plane.

As illustrated by the first holding mode (FIG. 15A) and the second holding mode (FIG. 15B), in the position adjustment section 125 the distance from the holder reference point Q to the each of the respective insertion holes 161 can be made to differ by length 2Y by rotating the adjustment plate 160 by a half turn in the xy plane. A similar relationship is also achieved between the third holding mode (FIG. 15C) and the fourth holding mode (FIG. 15D).

As illustrated in FIG. 14B, in the adjustment plate 160, the insertion holes 161A etc. are formed such that the hole portion 161A2 is shifted (offset) by length Y in the y direction with respect to the hole portion 161A1 and the hole portion 161A3, all of which have a hole width of 2Y in the y direction.

Moreover, in the adjustment plate 160, the separation between adjacent insertion holes 161 in the y direction is set at exactly 2Y, such that, as viewed from the region R1 (FIG.

14C) of a given insertion hole 161, the distance in the y direction to the regions R5 and R6 of the same insertion hole 161, and the distance in the y direction to the regions R5 and R6 of the adjacent insertion hole 161 is length Y in each case (FIG. 14A).

In the insertion portion 170, the insertion projection 172C is positioned at a separation in the y direction of length Y with respect to the insertion projections 172B and 172D (FIG. 17).

Accordingly, in the position adjustment section 125, when the insertion projection 172C is inserted to be positioned in the region R1 (FIG. 14C) of a given insertion hole 161, the insertion projections 172B and 172D can be positioned in the regions R5 and R6 of the same insertion hole 161, or positioned in the regions R5 and R6 of the adjacent insertion hole 161, depending on the orientation direction of the adjustment plate 160.

In the adjustment plate 160, the regions R1 (FIG. 14C) of each of the insertion holes 161A to 161E of the first insertion hole row 162A are disposed offset in the y direction by the length Y with respect to the regions R1 of each of the insertion holes 161G to 161L of the second insertion hole row 162B (FIG. 14A).

Accordingly, in the position adjustment section 125, as illustrated by the first holding mode (FIG. 15A) and the third holding mode (FIG. 15C), rotating the adjustment plate 160 by a half turn about a rotation axis running in the front-rear direction to reverse the first insertion hole row 162A and the second insertion hole row 162B from left to right, the distance from the holder reference point Q to the each of the respective insertion holes 161 can be differed by Y. A similar relationship is also achieved between the second holding mode (FIG. 15B) and the fourth holding mode (FIG. 15D).

By switching between the four holding modes that are the first holding mode to the fourth holding mode as appropriate, the position adjustment section 125 enables the position of the front guide 26 and the front face line F of the insertion portion 170 to be adjusted in intervals of length Y, this being much shorter than the length 4Y that is the cycle of the respective insertion holes 161 in the first insertion hole row 162A and the second insertion hole row 162B.

The holder 150 is formed with the holding claws 151C and 152C at the respective leading ends of the holding arms 151 and 152, and is flexible. Thus in the position adjustment section 125, the adjustment plate 160 can be held in the holder 150 by simply applying external force so as to move apart the holding claws 151C and 152C in the left-right direction and releasing the external force, without performing an attachment operation or a removal operation for a fixing screw 55, such as in the first exemplary embodiment.

In the adjustment plate 160, when holding modes are switched, and the distances from the holder reference point Q to the front face line F are respectively made Y+n×4Y, 2Y+n×4Y, 3Y+n×4Y, and n×4Y (wherein n is an integer), the numbers on the engravings 160L1 to 160L4 facing the front on the adjustment plate 160 are "1", "2", "3", and "4", namely the numbers correspond to the remainder when the distance is divided by 4Y.

Accordingly, for the position adjustment section 125, a maintenance technician or the like is able to directly ascertain the facing and direction of the adjustment plate 160 corresponding to the distance from the holder reference point Q to the front face line F when switching between the holding modes of the adjustment plate 160, enabling the operation to be carried out efficiently.

In other respects, the position adjustment section 125 according to the second exemplary embodiment exhibits similar operation and advantageous effects to the position adjustment section 25 according to the first exemplary embodiment.

According to the above configuration, in the position adjustment section 125 of the second exemplary embodiment, the insertion holes 161 formed in the adjustment plate 160 are crank shaped, and are respectively arrayed in cycles of length 4Y along the y direction, in directions reversed with respect to each other between the first insertion hole row 162A and the second insertion hole row 162B. Moreover, the distances from the first edge 160E1 and the second edge 160E2 to the respective insertion holes 161 differs between the insertion hole rows. The holder 150 can hold the adjustment plate 160 in four holding modes, of different orientation direction and face. By switching between the first holding mode to the fourth holding mode as appropriate, the position adjustment section 125 accordingly enables the position of the front face line F to be adjusted in units of length Y when the respective insertion projections 172A to 172D of the insertion portion 170 attached to the front guide 26 are inserted into the respective insertion holes 161.

3. Third Exemplary Embodiment

In a third exemplary embodiment, the position of the front guides 26 is adjusted using position adjustment sections 225 in place of the position adjustment sections 25 of the first exemplary embodiment.

3-1. Position Adjustment Section Configuration

Figure 18:
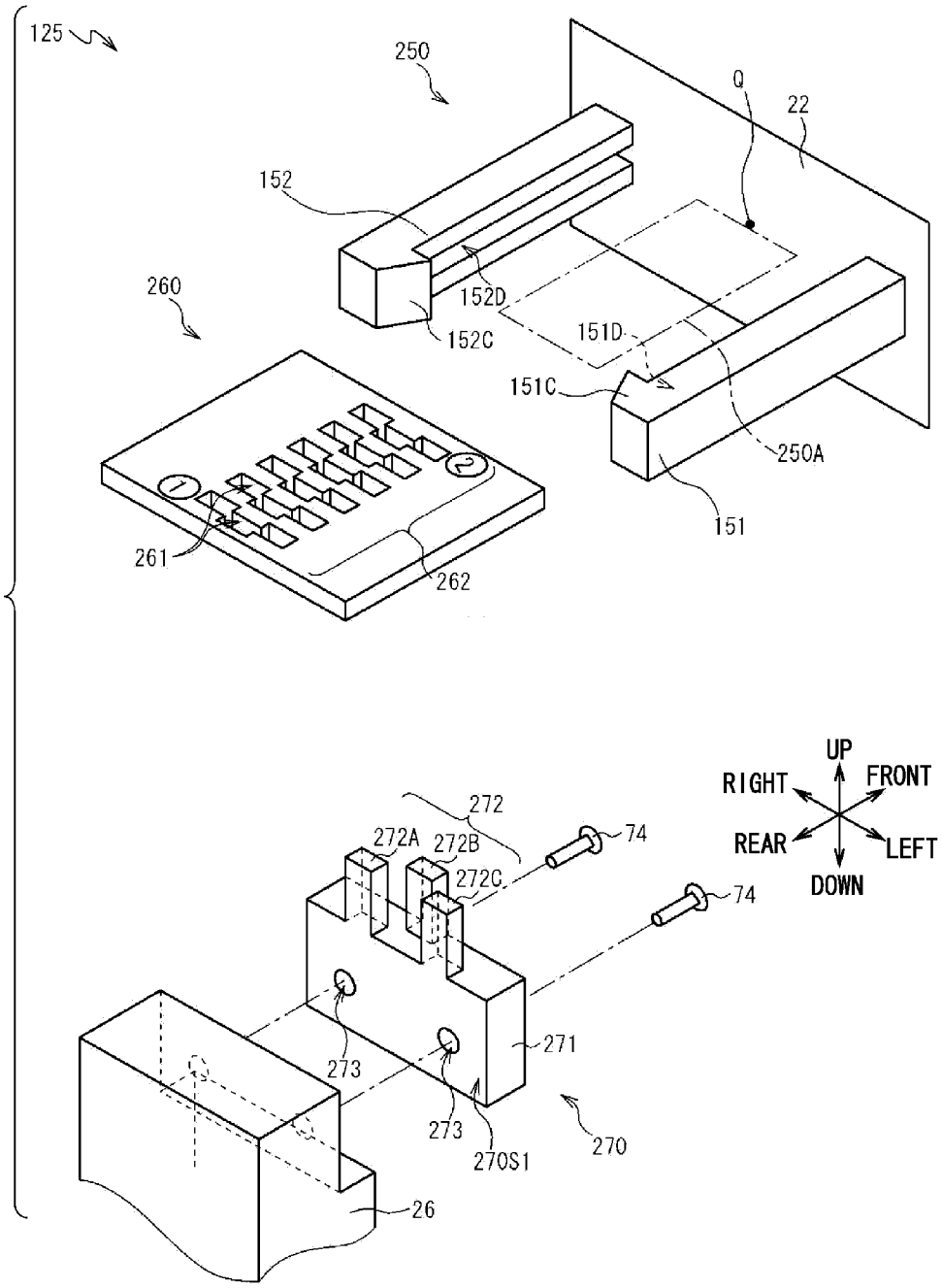
FIG. 18 is a schematic perspective view illustrating a configuration of a position adjustment section according to a third exemplary embodiment.

As illustrated in FIG. 18, corresponding to FIG. 6 and FIG. 12, each position adjustment section 225 is configured by a holder 250, an adjustment plate 260, and an insertion portion 270, respectively corresponding to the holder 50, the adjustment plate 60, and the insertion portion 70.

3-1-1. Holder Configuration

The holder 250 has substantially the same configuration as the holder 150 of the second exemplary embodiment, but differs in the respect that a single insertable range 250A is provided in place of the two insertable ranges, the first insertable range 150A and the second insertable range 150B.

The insertable range 250A is substantially the same as the insertable range 50A of the first exemplary embodiment, and is a range with length running from front to rear behind the holder reference point Q and between the grooves 151D and 152D.

3-1-2. Adjustment Plate Configuration

Figure 19:
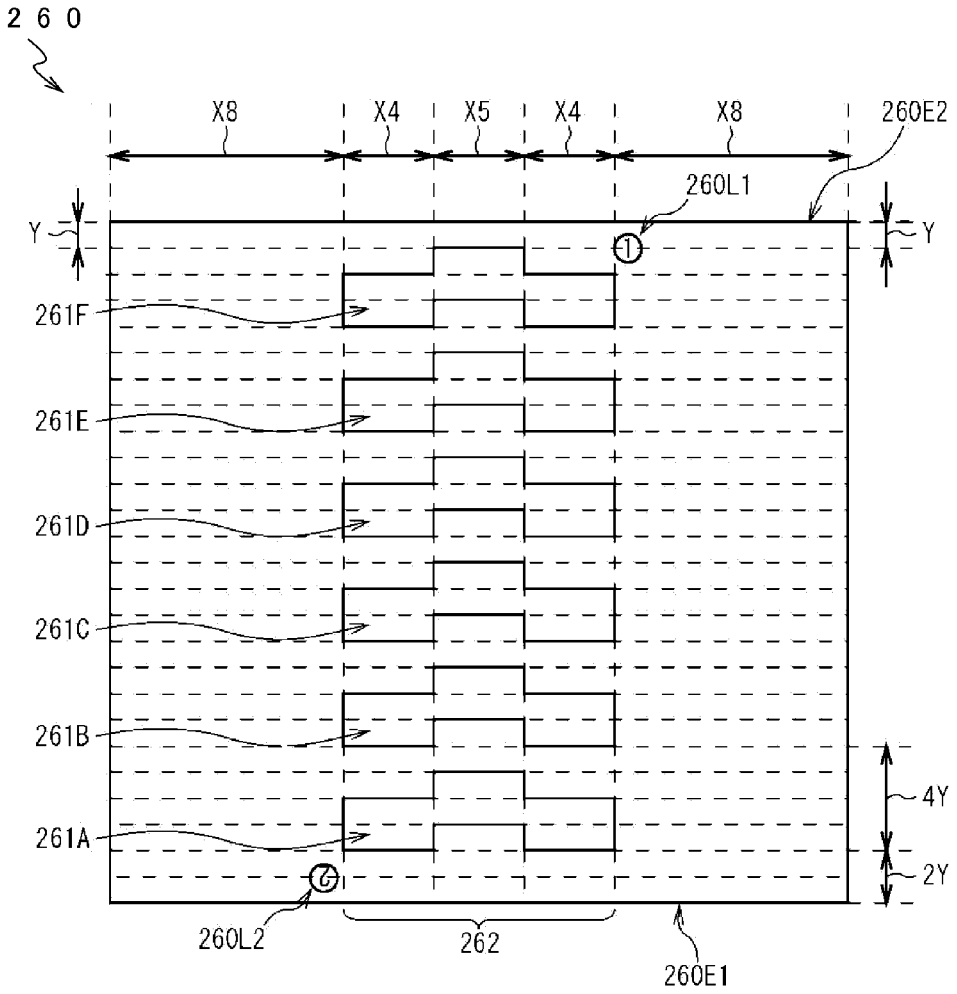
FIG. 19 is a schematic view illustrating a configuration of an adjustment plate according to the third exemplary embodiment.

The adjustment plate 260 is provided with an insertion hole row 262 including six insertion holes 261A to 261F, as illustrated in FIG. 19 that corresponds to FIG. 14A.

The adjustment plate 260 is configured by omitting the insertion holes 161G to 161L of the second insertion hole row 162B from the adjustment plate 160 of the second exemplary embodiment (FIG. 12, FIG. 14A, FIG. 14B, and FIG. 14C), and moving the insertion holes 161A to 161F of the first insertion hole row 162A to the x direction center.

The shape of each of the insertion holes 261A to 261F is the same as that of the insertion hole 161A of the second exemplary embodiment, and the separations between adjacent insertion holes 261 in the y direction is length 2Y, similarly to in the second exemplary embodiment.

However, in the third exemplary embodiment, the length in the x direction of portions corresponding to the hole portion 161A3 of the insertion hole 161A of the second exemplary embodiment (FIG. 14B) is length X4, equivalent to the hole portion 161A1, rather than length X6 (FIG. 19).

Similarly to the adjustment plate 60 of the first exemplary embodiment, the adjustment plate 260 is engraved with an engraving 260L1 configured by the number 1 enclosed in a circle in the vicinity of a second edge 260E2, and engraved with an engraving 260L2 configured by the number 2 enclosed in a circle in the vicinity of a first edge 260E1.

Figure 20A:
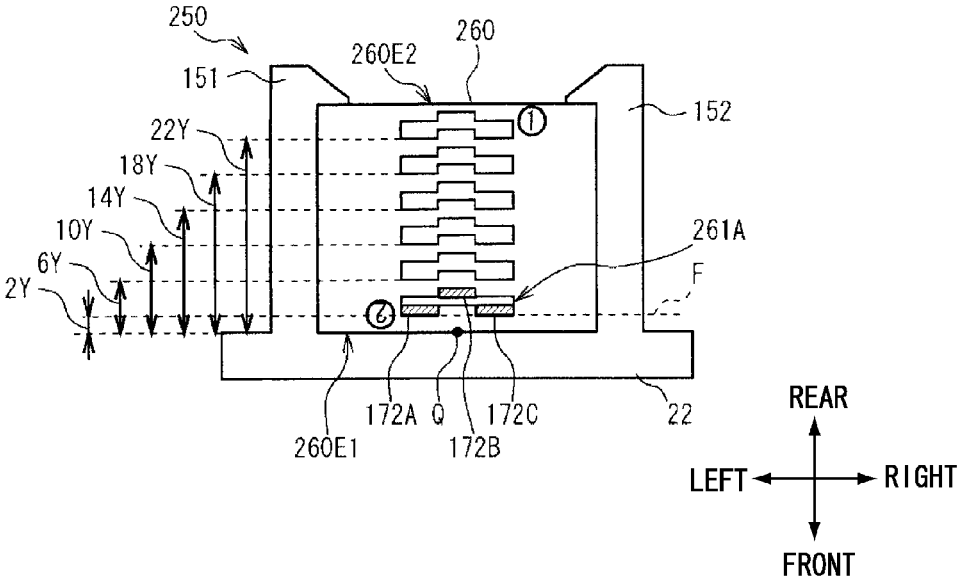
FIG. 20A is a schematic view illustrating a holding mode in the third exemplary embodiment.
Figure 20B:
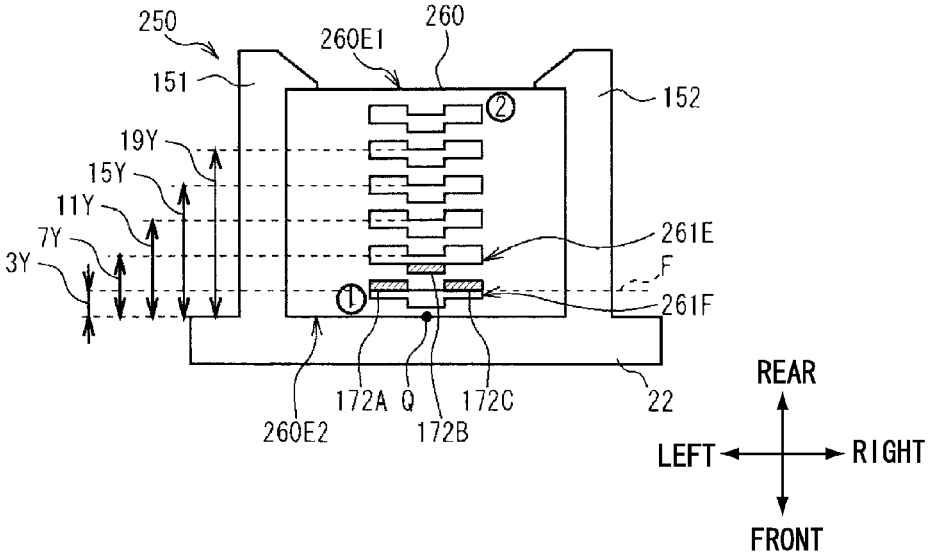
FIG. 20B is a schematic view illustrating a holding mode in the third exemplary embodiment.

The holder 250 can hold the adjustment plate 260 in two holding modes, as illustrated in FIG. 20A and FIG. 20B that respectively correspond to FIG. 15A and FIG. 15B.

The insertion hole row 262 of the adjustment plate 260 is positioned within the insertable range 250A regardless of the holding mode.

FIG. 20A illustrates a holding mode in which the first edge 260E1 of the adjustment plate 260 faces toward the front and is in contact with the holder reference point Q of the front side plate 22, and the second edge 260E2 faces toward the rear. This holding mode is referred to as the first holding mode of the present exemplary embodiment in the following explanation.

In the first holding mode, the distance from the holder reference point Q to regions R5 and R6 (FIG. 14C) of the respective insertion holes 261A to 261E is respectively 2Y, 6Y, and so on, up to 22Y.

Figure 20C:
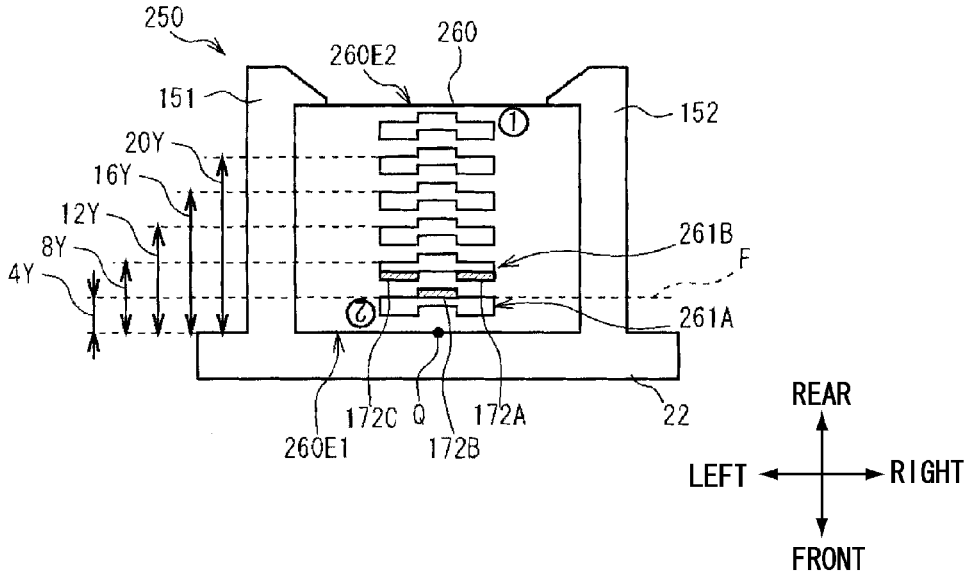
FIG. 20C is a schematic view illustrating a holding mode in the third exemplary embodiment.

Moreover, in the first holding mode, the distance from the holder reference point Q to a region R1 (FIG. 14C) of the respective insertion holes 261A to 261E is respectively 4Y, 8Y, and so on, up to 20Y, as illustrated in FIG. 20C corresponding to FIG. 20A.

FIG. 20B illustrates a holding mode in which the second edge 260E2 of the adjustment plate 260 faces toward the front and is in contact with the holder reference point Q of the front side plate 22, and the first edge 260E1 faces toward the rear. This holding mode is referred to as the second holding mode in the following explanation of the present exemplary embodiment.

In the second holding mode, the distance from the holder reference point Q to the regions R5 and R6 (FIG. 14C) of the respective insertion holes 261F to 261B is respectively 3Y, 7Y, and so on, up to 19Y.

Figure 20D:
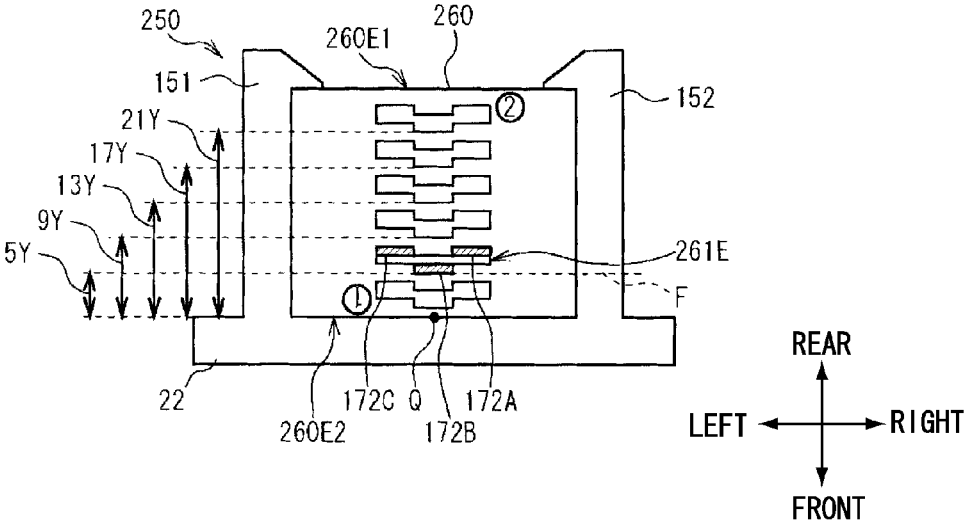
FIG. 20D is a schematic view illustrating a holding mode in the third exemplary embodiment.

Moreover, in the second holding mode, the distance from the holder reference point Q to the region R1 (FIG. 14C) of the respective insertion holes 261E to 261A is respectively 5Y, 7Y, and so on, up to 21Y, as illustrated in FIG. 20D corresponding to FIG. 20B.

In this manner, the insertion holes 261A to 261F of the insertion hole row 262 of the adjustment plate 260 are positioned in a cycle of length 4Y along the y direction, with the distance from the first edge 260E1 to the regions R5 and R6 of the insertion hole 261A and the distance from the second edge 260E2 to the regions R5 and R6 of the insertion hole 261F differing by length Y.

Accordingly, when the adjustment plate 260 is held by the holder 250 in the first holding mode and the second holding mode, the respective distances from the holder reference point Q to the regions R5 and R6 of each of the insertion holes 261A to 261F form equal cycles of length 4Y, and differ from each other by length Y.

Similarly to in the second exemplary embodiment, the distances from the holder reference point Q to the regions R5 and R6, and the distances to the region R1, of each of the respective insertion holes 261A to 261F, differ from each other by length 2Y between when the adjustment plate 260 is held by the holder 250 in the first holding mode and the second holding mode.

3-1-3. Insertion Portion Configuration

As illustrated in FIG. 18, configuration of the insertion portion 270 centers around a base 271 and an insertion projection 272.

For ease of explanation, the face facing toward the front in FIG. 18 is referred to as the first face 270S1 of the insertion portion 270, and the opposite face thereto is referred to as the second face 270S2.

Similarly to the base 71 of the first exemplary embodiment, the base 271 is formed in a rectangular block shape that is thin in the front-rear direction, and is formed with two screw holes 273 piercing through in the front-rear direction.

The insertion projection 272 is configured by three insertion projections 272A, 272B, and 272C. The insertion projection 272B is formed in a rectangular block shape that is thin in thickness from front to rear, and is a long thin shape running from top to bottom, installed upright so as to project upward from a substantially left-right central location of an upper face of the base 271, on the first face 270S1 side.

The insertion projections 272A and 272C are both, similarly to the insertion projection 272B, formed in rectangular block shapes that are thin in thickness from front to rear, and are long thin shapes running from top to bottom, installed upright so as to project upward from locations on both sides to the left and right of the insertion projection 272B on the upper face of the base 271, on the second face 270S2 side.

The thus configured insertion portion 270 is attached to the attachment portion 26A of the front guide 26 using two attachment screws 74, similarly to in the first and second exemplary embodiments.

Note that unlike in the first and second exemplary embodiments, the insertion portion 270 can be attached to the front guide 26 in two attachment directions.

Figure 21A:
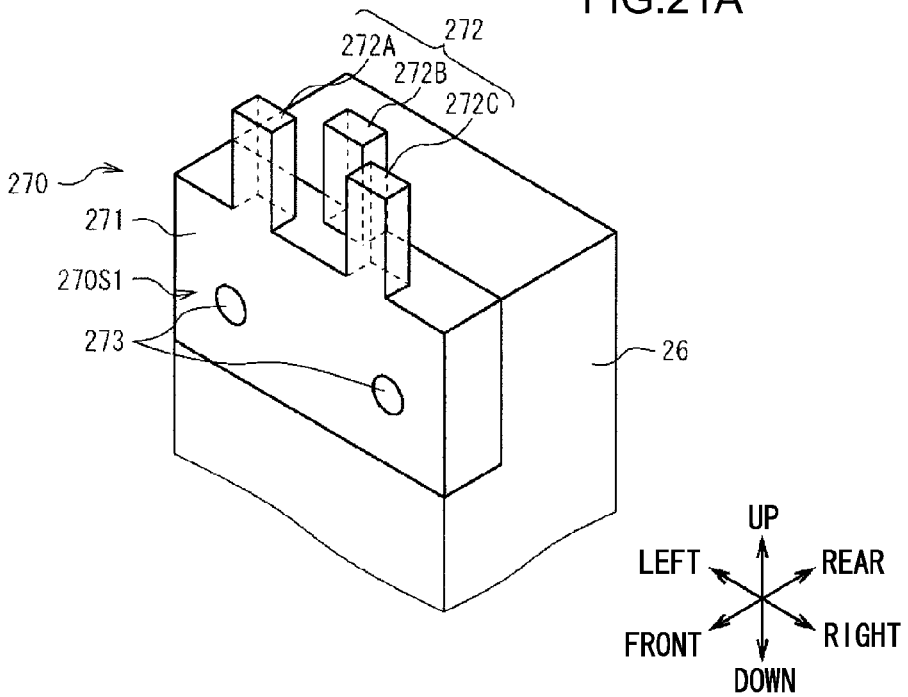
FIG. 21A is a schematic perspective view illustrating attachment of an insertion portion to a front guide in the third exemplary embodiment.

Namely, as illustrated in FIG. 21A, when the insertion portion 270 is attached to the front guide 26 in a state in which the first face 27051 faces toward the front, the insertion projections 272A and 272C are positioned toward the front, and the insertion projection 272B is positioned further toward the rear.

Figure 22A:
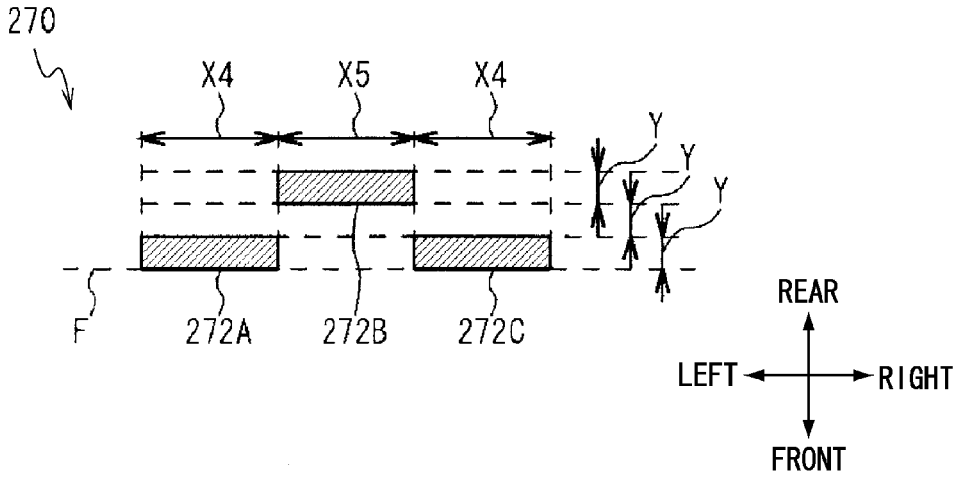
FIG. 22A is a schematic view illustrating a configuration of an insertion portion in the third exemplary embodiment.

As illustrated in FIG. 22A, front faces of the insertion projections 272A and 272C are positioned on a front face line F together with the front face of the front guide 26 in plan view. The state in which the insertion portion 270 is attached to the front guide 26 with the first face 27051 facing toward the front is referred to below as the first insertion mode.

Figure 21B:
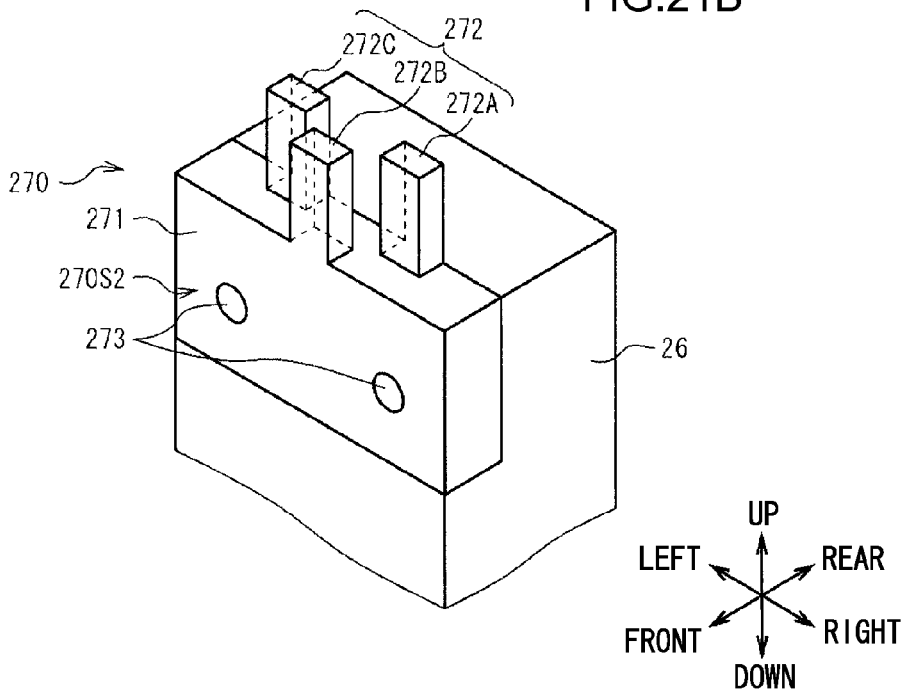
FIG. 21B is a schematic perspective view illustrating attachment of an insertion portion to a front guide in the third exemplary embodiment.

Moreover, as illustrated in FIG. 21B, when the insertion portion 270 is attached to the front guide 26 in a state in which the second face 270S2 faces toward the front, the insertion projection 272B is positioned toward the front, and the insertion projections 272A and 272C are positioned further toward the rear.

Figure 22B:
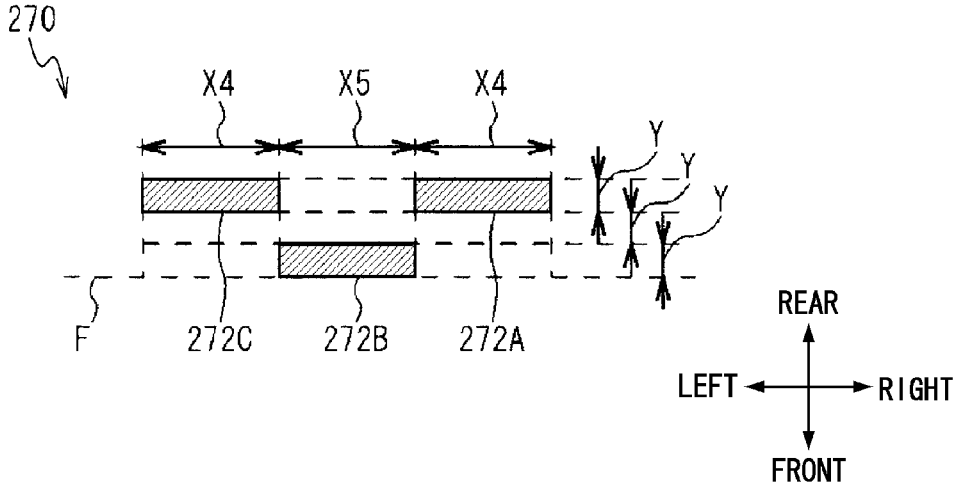
FIG. 22B is a schematic view illustrating a configuration of an insertion portion in the third exemplary embodiment.

As illustrated in FIG. 22B, in plan view a front face of the insertion projection 272B is accordingly positioned on a front face line F together with the front face of the front guide 26. The state in which the insertion portion 270 is attached to the front guide 26 with the second face 270S2 facing toward the front is referred to below as the second insertion mode.

By rotating the attachment direction of the insertion portion 270 to the front guide 26 by a half turn from front to rear, the insertion portion 270 can accordingly be switched between the first insertion mode in which the front faces of the insertion projections 272A and 272C are positioned on the front face line F, and the second insertion mode in which the front face of the insertion projection 272B is positioned on the front face line F.

3-2. Operation and Advantageous Effects

In the position adjustment sections 225 of the third exemplary embodiment configured as described above, the insertion projections 272A to 272C of the insertion portion 270 attached to the front guide 26 are inserted into any one of the insertion holes 261A to 261F of the insertion hole row 262 of the adjustment plate 260 at both the upper and lower side of the front guides 26.

The adjustment plate 160 is inserted between the grooves 151D and 152D in a state in which the holder 250 has been temporarily applied with external force so as to move apart the holding claws 151C and 152C of the holding arms 151 and 152 in the left-right direction, and the external force is then released.

The holder 250 holds the adjustment plate 260 such that the insertion hole row 262 is positioned within the insertable range 250A. The position adjustment section 225 enables the position of the front guide 26 to which the insertion portion 270 is attached to be fixed.

First, consider a case of the position adjustment section 225 in which the insertion portion 270 is in the first insertion mode (FIG. 21A), such that the insertion projections 272A and 272C are further toward the front than the insertion projection 272B.

In the first insertion mode, with the holder 250 and the adjustment plate 260 in the first holding mode (FIG. 20A), the first edge 260E1 of the adjustment plate 260 faces toward the front and contacts the holder reference point Q, and the second edge 260E2 faces toward the rear.

As illustrated in FIG. 20A, for example, when the insertion projections 272A, 272C, and 272B are respectively positioned in the regions R5, R6, and R1 (FIG. 14C) of the insertion hole 261A, the distance of the front guide 26 and the front face line F of the insertion portion 270 from the holder reference point Q is 2Y.

The front guide 26 and the front face line F of the insertion portion 270 can moreover be positioned at discrete locations at a cycle of length 4Y, namely at lengths 2Y, 6Y, 10Y, 14Y, 18Y, or 22Y, by inserting the insertion projections 272A to 272C into any one of the insertion holes 261A to 261F of the insertion hole row 262.

Next, when the insertion portion 270 is in the first insertion mode, and the holder 250 and the adjustment plate 260 are in the second holding mode (FIG. 20B), the second edge 260E2 of the adjustment plate 260 faces toward the front and contacts the holder reference point Q, and the first edge 260E1 faces toward the rear.

As illustrated in FIG. 20B, for example, when the insertion projections 272A and 272C are respectively positioned in the regions R6 and R5 (FIG. 14C) of the insertion hole 261F, and the insertion projection 272B is positioned in the region R1 of the insertion hole 261E, the distance of the front guide 26 and the front face line F of the insertion portion 270 from the holder reference point Q is 3Y.

The front guide 26 and the front face line F of the insertion portion 270 can moreover be positioned at discrete locations at a cycle of length 4Y, namely at lengths 3Y, 7Y, 11Y, 15Y, or 19Y, by inserting the insertion projections 272A to 272C into any one of the insertion holes 261A to 261F of the insertion hole row 262.

Next, consider a case in the position adjustment section 225 in which the insertion portion 270 is in the second insertion mode (FIG. 21B), such that the insertion projection 272B is further toward the front than the insertion projections 272A and 272C.

In the second insertion mode, with the holder 250 and the adjustment plate 260 in the first holding mode (FIG. 20C), similarly to in FIG. 20A, the first edge 260E1 of the adjustment plate 260 faces toward the front and contacts the holder reference point Q, and the second edge 260E2 faces toward the rear.

As illustrated in FIG. 20C, for example, when the insertion projection 272B is positioned in the region R1 of the insertion hole 261A (FIG. 14C), and the insertion projections 272C and 272A are positioned in the regions R5 and R6 of the insertion hole 261B, the distance of the front guide 26 and the front face line F of the insertion portion 270 from the holder reference point Q is 4Y.

The front guide 26 and the front face line F of the insertion portion 270 can moreover be positioned at discrete locations at a cycle of length 4Y, namely at lengths 4Y, 8Y, 12Y, 16Y, or 20Y, by inserting the insertion projections 272A to 272C into any one of the insertion holes 261A to 261F of the insertion hole row 262.

Next, when the insertion portion 270 is in the second insertion mode, and the holder 250 and the adjustment plate 260 are in the second holding mode (FIG. 20D), the second edge 260E2 of the adjustment plate 260 faces toward the front and contacts the holder reference point Q, and the first edge 260E1 faces toward the rear, similarly to the case in FIG. 20B.

As illustrated in FIG. 20D, for example, when the insertion projections 272B, 272C, and 272A are respectively positioned in the regions R1, R5, and R6 (FIG. 14C) of the insertion hole 261E, the distance of the front guide 26 and the front face line F of the insertion portion 270 from the holder reference point Q is 5Y.

The front guide 26 and the front face line F of the insertion portion 270 can moreover be positioned at discrete locations at a cycle of length 4Y, namely at lengths 5Y, 9Y, 13Y, 17Y, or 21Y, by inserting the insertion projections 272A to 272C into any one of the insertion holes 261A to 261F of the insertion hole row 262.

Note that when the respective distances from the holder reference point Q to the front guide 26 and the front face line F of the insertion portion 270, namely the positions with respect to the holder reference point Q, are compared between combinations of each of the holding modes and each of the insertion modes, the smallest distance between two positions is the length Y, such as in the case of the lengths 3Y and 4Y, this being shorter than the length 4Y that is the cycle of the insertion holes 161 along the y direction.

In the position adjustment section 225, combining the first holding mode and the second holding mode, between which the orientation direction of the adjustment plate 160 differs with respect to the holder 150, with the first insertion mode and the second insertion mode between which the attachment direction of the insertion portion 270 to the front guide 26 differs, accordingly enables the front guide 26 and the front face line F of the insertion portion 170 to be positioned at discrete locations at intervals of length Y, namely at 2Y, 3Y, 4Y, and so on, up to 21Y and 22Y.

To look at it from another perspective, in the position adjustment section 225, similarly to in the first exemplary embodiment, due to manufacturing process limitations and the like, the respective insertion holes 261 formed in the insertion hole row 262 of the adjustment plate 260 are disposed at a cycle of length 4Y in the y direction.

The position of the front guide 26 and the front face line F of the insertion portion 70 can therefore only be adjusted in intervals of length 4Y if the insertion position of the insertion projections 272A to 172C are simply adjusted with respect to the insertion hole row 262 of the adjustment plate 260 in the position adjustment section 225.

In the adjustment plate 260 (FIG. 19), the shape of the insertion holes 261 and the separation between adjacent insertion holes 261 are set similarly to in the second exemplary embodiment, and the distance from the first edge 260E1 to the insertion hole 261A differs from the distance from the second edge 260E2 to the insertion hole 161F.

Accordingly, in the position adjustment section 225, as illustrated in the case of the first holding mode with the first insertion mode (FIG. 20A) and the case of the second holding mode with the first insertion mode (FIG. 20B), the distance from the holder reference point Q to each of the respective insertion holes 161 can be made to differ by length Y by rotating the adjustment plate 260 by a half turn in the xy plane. A similar relationship is achieved between the first holding mode with the second insertion mode (FIG. 20C), and the second holding mode with the second insertion mode (FIG. 20D).

In the adjustment plate 260, the respective insertion holes 261 of the insertion hole row 262 are formed so as to achieve similar shapes and placement separations to the insertion holes 161 of the first insertion hole row 162A of the second exemplary embodiment.

In the adjustment plate 260, similarly to in the second exemplary embodiment, as viewed from the region R1 (FIG. 14C) of a given insertion hole 261, the distance in the y direction to the regions R5 and R6 of the same insertion hole 261, and the distance in the y direction to the regions R5 and R6 of the adjacent insertion hole 161 is length Y in each case (FIG. 19).

However, reversing the attachment direction of the insertion portion 270 with respect to the front guide 26 enables switching between the first insertion mode in which the insertion projection 272A and the insertion projection 272C are aligned with the front face line F, and the second insertion mode in which the insertion projection 272B is aligned with the front face line F (FIG. 21A, FIG. 21B, FIG. 22A, and FIG. 22B).

Accordingly, in the position adjustment section 225, as illustrated in the case of the first holding mode with the first insertion mode (FIG. 20A) and the case of the first holding mode with the second insertion mode (FIG. 20C), the distance from the holder reference point Q to the front guide 26 the front face line F of the insertion portion 270 can be made to differ by length 2Y by switching between the first insertion mode and the second insertion mode. A similar relationship is also achieved between the case of the second holding mode with the first insertion mode (FIG. 20B) and the case of the second holding mode with the second insertion mode (FIG. 20D).

By switching between the two holding modes and the two insertion modes as appropriate, the position adjustment section 225 enables the position of the front guide 26 and the front face line F of the insertion portion 270 to be adjusted in intervals of length Y, this being much shorter than the length 4Y that is the cycle of the respective insertion holes 261 in the insertion hole row 262.

In other respects, the position adjustment section 225 of the third exemplary embodiment exhibits similar operation and advantageous effects to the position adjustment section 25 of the first exemplary embodiment.

According to the above configuration, in the position adjustment section 225 of the third exemplary embodiment, the respective insertion holes 261 of the insertion hole row 262 of the adjustment plate 260 are disposed with a cycle of length 4Y in the y direction, and the distance from the first edge 260E 1 and the second edge 260E2 to each of the respective insertion holes 261 differs by length Y. The holder 250 holds the adjustment plate 260 in the two holding modes of differing direction. The insertion portion 270 can moreover be switched between two insertion modes in which the attachment direction with respect to the front guide 26 is reversed front and rear. By switching between the first holding mode and the second holding mode, and the first insertion mode and the second insertion mode as appropriate, the position adjustment section 225 enables the position of the front face line F to be adjusted in units of length Y when inserting the insertion projections 272A to 272C of the insertion portion 270 attached to the front guide 26 into a given insertion hole 161.

4. Fourth Exemplary Embodiment

Note that in the first exemplary embodiment described above, explanation has been given regarding a case in which the insertion holes 61 have a rectangular shape in the xy plane.

The present invention is not, however, limited thereto, and the insertion holes 61 may be configured with various shapes in the xy plane, for example square shapes, polygonal shapes, or circular shapes, or crank shapes such as in the second and third exemplary embodiments.

In the first exemplary embodiment described above, explanation has been given regarding a case in which the shape of the upper face of the insertion projection 72 is substantially the same as the shape of the insertion holes 61 in the xy plane.

The present invention is not, however, limited thereto, and, as in the third exemplary embodiment, the upper faces of the insertion projections 272A to 272C may differ from the shape of the upper shape of the insertion holes 261 in the xy plane. Namely, in such cases, it is sufficient that the position of the insertion portion 270 with respect to the adjustment plate 260 can be fixed when the insertion projections 272A to 272C are inserted into the insertion holes 261.

In the first exemplary embodiment described above, explanation has been given regarding a case in which only a single insertion hole row 62 is provided to the adjustment plate 60, and the insertion hole row 62 is commonly employed in both holding modes when the attachment direction of the adjustment plate 60 is rotated by a half turn with respect to the holder 50 to configure the two holding modes.

The present invention is not, however, limited thereto, and configuration may be made such that some of the insertion holes are commonly employed when the attachment direction of the adjustment plate 60 to the holder 50 is rotated through various other angle units to configure plural holding modes, or configuration may be made such that different insertion hole rows are be employed for each holding mode.

Figure 23:
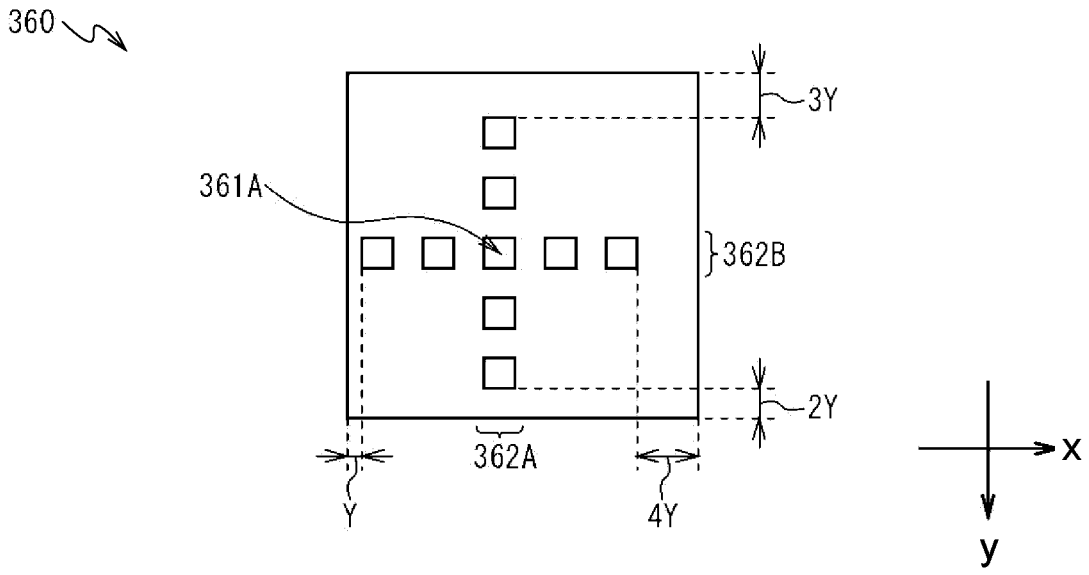
FIG. 23 is a schematic view illustrating a configuration of an adjustment plate according to another exemplary embodiment.

For example, as illustrated in FIG. 23, an adjustment plate 360 may be configured by a square plate shape, and both an insertion hole row 362A in the y direction and an insertion hole row 362B in the x direction may be respectively provided, with a commonly employed insertion hole 361 at a position where the two intersect.

In the adjustment plate 360, each insertion row may be configured at a different separation from the respective edge, such as at lengths Y, 2Y, 3Y, and 4Y, thereby enabling adjustment of the distance from the holder reference point Q to each respective insertion hole in the insertable range 50A in units of length Y when switching between four holding modes by varying the insertion direction with respect to the holder 50 (FIG. 6) etc. by 90 degrees at a time.

Figure 24A:
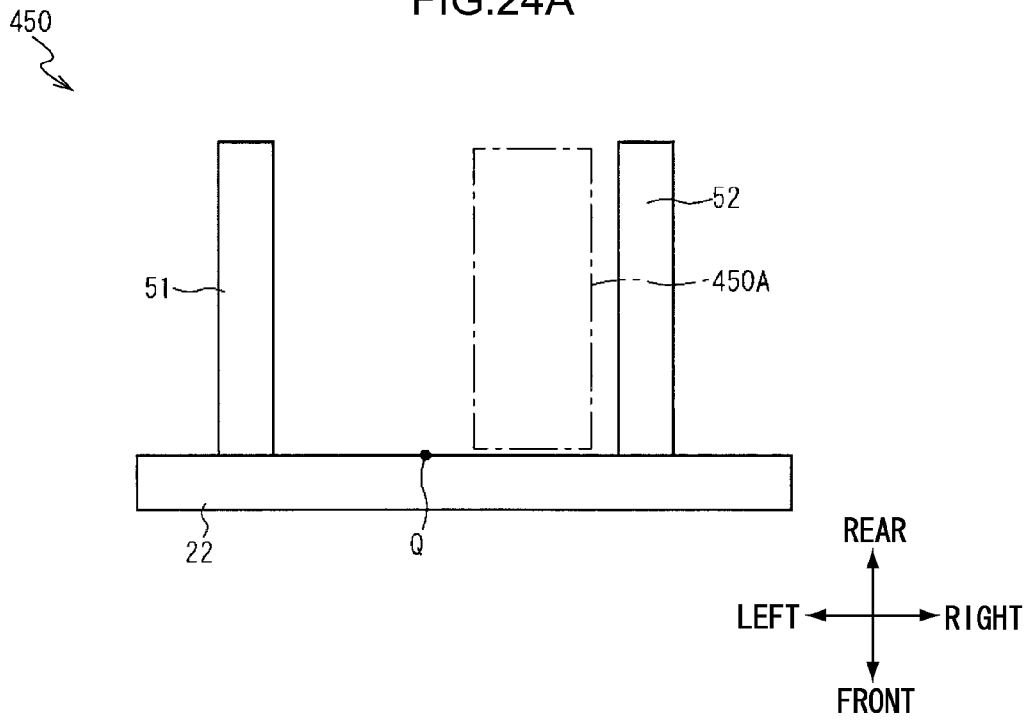
FIG. 24A is a schematic view illustrating a configuration of a holder and an adjustment plate according to another exemplary embodiment.
Figure 24B:
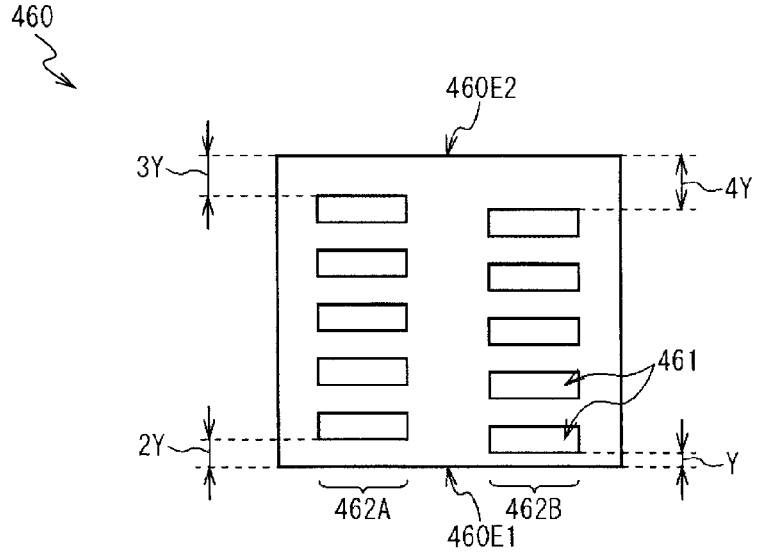
FIG. 24B is a schematic view illustrating a configuration of a holder and an adjustment plate according to another exemplary embodiment.
Figure 25:
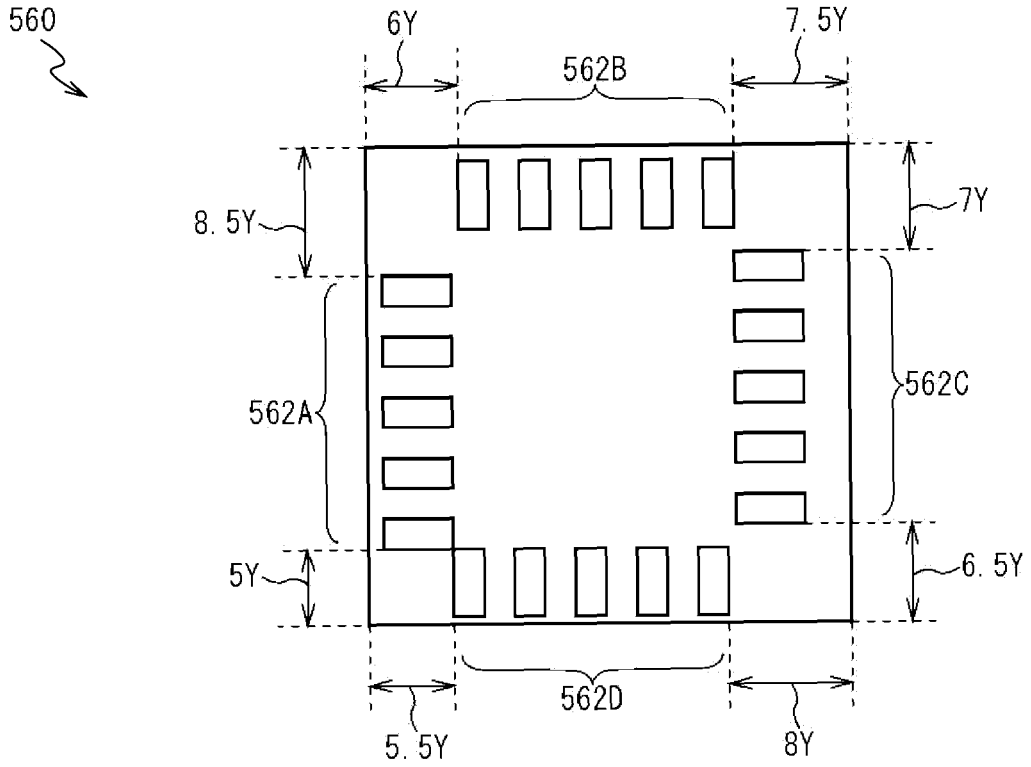
FIG. 25 is a schematic view illustrating a configuration of an adjustment plate according to another exemplary embodiment.

As another example, such as that illustrated in FIG. 24A, in a holder 450 corresponding to the holder 50, an insertable range 450A is set at a location toward the right of the middle between the holding arms 51 and 52. As illustrated in FIG. 24B that corresponds to FIG. 7, an adjustment plate 460 corresponding to the adjustment plate 60 is formed with two insertion hole rows 462A and 462B, and the separations from edges 460E1 and 460E2 to each of respective insertion holes 461 are configured at four different lengths Y, 2Y, 3Y, and 4Y.

Either one of the insertion hole rows 462A or 462B is positioned within the insertable range 450A by reversing the orientation direction and face of the adjustment plate 460 when holding the adjustment plate 460 in the holder 450. This thereby enables the distances from the holder reference point Q to each of the respective insertion holes 461 in the insertable range 450A (FIG. 24A) to be adjusted in units of length Y In such a configuration, in place of the adjustment plate 460, an adjustment plate 560 may be provided in which four insertion hole rows 562A, 562B, 562C, and 562D are provided running along each of four edges, with the distance from the respective edges to each of the respective insertion holes configured at eight different distances, thereby enabling adjustment of the distances from the holder reference point Q to each of the respective insertion holes within the insertable range 450A (FIG. 24A) in units of length 0.5Y while switching through the eight holding modes.

Namely, the present invention enables fine adjustment of the position of the insertion portion by lengths of 1/n of the cycle, by configuring an adjustment plate to be capable of n holding modes (wherein n is an integer of 2 or more) by differing the orientation direction and face of the adjustment plate with respect to a holder, and differing the position of each respective insertion hole by 1/n of the cycle of the insertion holes at a time for each holding mode when each insertion hole row is within the insertable range.

In the first exemplary embodiment described above, explanation has been given regarding a case in which the adjustment plate 60 is configured in a flattened rectangular block shape, namely in a rectangular plate shape, and the respective insertion holes 61 are formed piercing through the adjustment plate 60 in the thickness direction.

The present invention is not, however, limited thereto, and, for example, the adjustment plate 60 may be configured in various multifaceted solid shapes such as a cube shape, and the holder 50 may be configured so as to be capable of holding such a multifaceted solid shape. In such configurations, the insertion holes 61 formed in the adjustment plate 60 may be holes of a sufficient depth to enable sufficient insertion of the insertion projection 72 of the insertion portion 70, and do not need to pierce through the adjustment plate 60. Similar also applies to the second and third exemplary embodiments.

In the first exemplary embodiment described above, explanation has been given regarding a case in which the distance from the first edge 60E1 of the adjustment plate 60 to the insertion hole 61A differs from the distance from the second edge 60E2 to the insertion hole 61E, such that the distance from the holder reference point Q to each of the respective insertion holes 61 differs between each holding mode when the adjustment plate 60 is held by the xxxx.

The present invention is not, however, limited thereto, and the separation from the holder reference point Q to each of the respective insertion holes 61 may be made to differ between each holding mode using various methods.

Figure 26A:
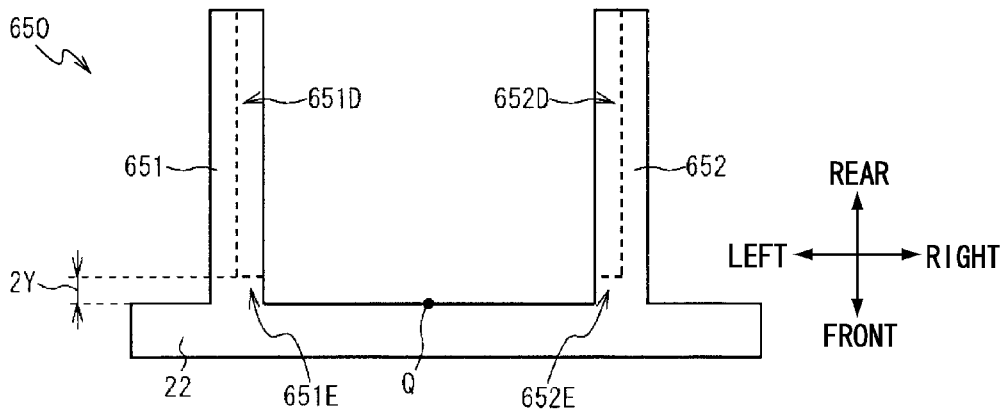
FIG. 26A is a schematic view illustrating a configuration of a holder and an adjustment plate according to another exemplary embodiment.

For example, as illustrated in FIG. 26A, a holder 650 corresponding to the holder 50 (FIG. 6) includes holding arms 651 and 652 corresponding to the holding arms 51 and 52. Grooves 651D and 652D formed to the holding arms 651 and 652 have portions near to their front ends filled-in by positioning portions 651E and 652E, corresponding to portions of a length 2Y to the rear of the holder reference point Q on the front side plate 22.

Figure 26B:
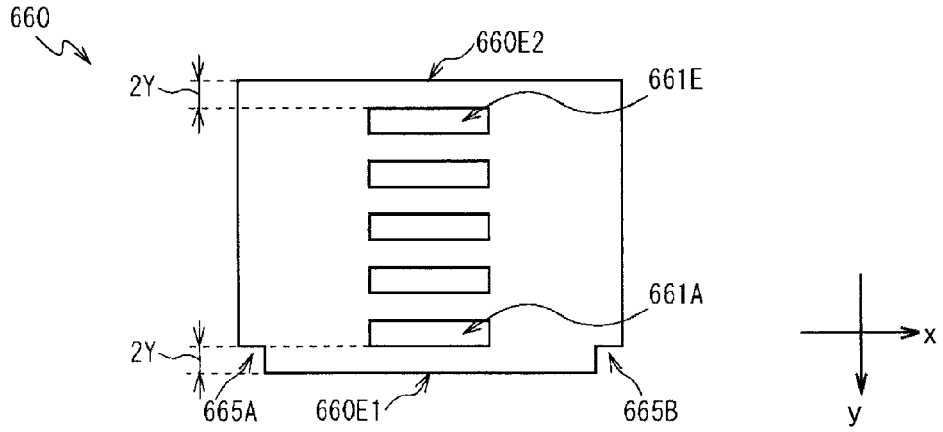
FIG. 26B is a schematic view illustrating a configuration of a holder and an adjustment plate according to another exemplary embodiment.

As illustrated in FIG. 26B corresponding to FIG. 7, in an adjustment plate 660 corresponding to the adjustment plate 60, both the separation from a first edge 660E1 to an insertion hole 661A, and the separation from a second edge 660E2 to an insertion hole 661E, are made the same as each other, a length 2Y. However, respective cutaways 665A and 665B in which the length of 2Y has been cut away along the y direction are formed at both ends of the first edge 660E1 only.

Figure 27A:
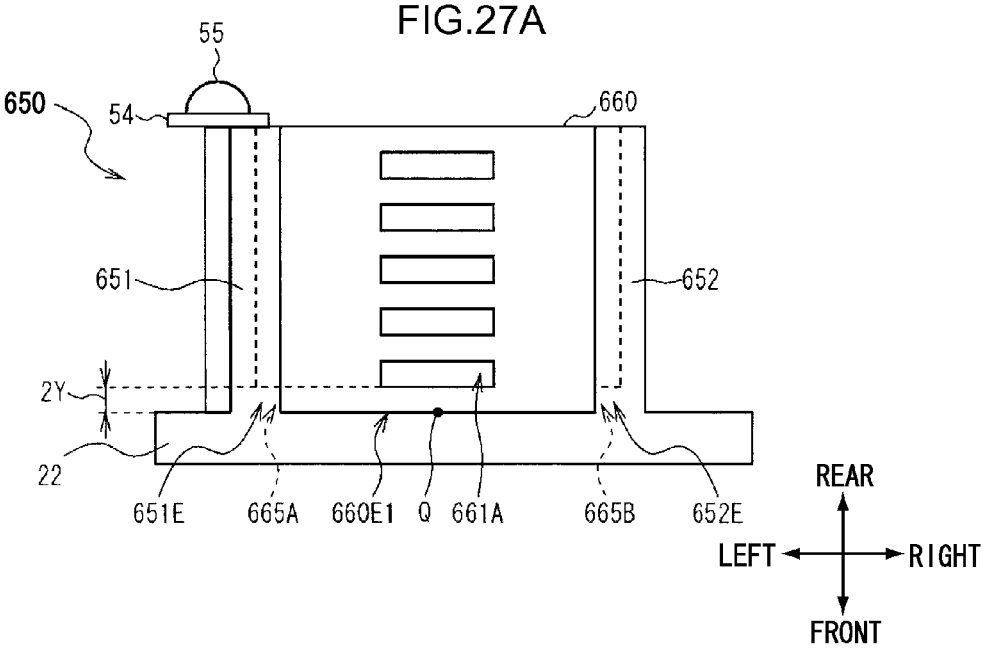
FIG. 27A is a schematic view illustrating a holding mode according to another exemplary embodiment.

When the thus configured holder 650 holds the adjustment plate 660 such that the first edge 660E1 side faces toward the front, as in the first holding mode illustrated in FIG. 27A, contact with the positioning portions 651E and 652E is avoided due to the respective cutaways 665A and 665B. The first edge 660E1 of the adjustment plate 660 accordingly contacts the front side plate 22, and the distance from the holder reference point Q to the insertion hole 661A is length 2Y.

Figure 27B:
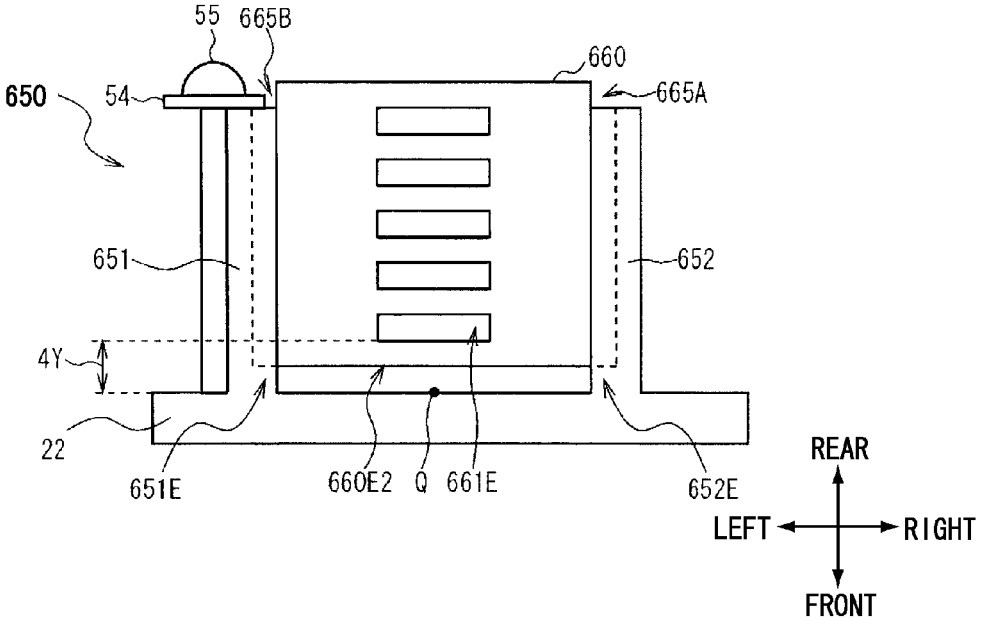
FIG. 27B is a schematic view illustrating a holding mode according to another exemplary embodiment.

However, when the holder 650 holds the adjustment plate 660 such that the second edge 660E2 side faces toward the front, as in the second holding mode illustrated in FIG. 27B, both end portions of the second edge 660E2 contact the respective positioning portions 651E and 652E. The second edge 660E2 is accordingly held in a state away from (separated from) the front side plate 22 by length 2Y, and the separation from the holder reference point Q to the insertion hole 661E is length 4Y.

The holder 650 and the adjustment plate 660 accordingly enable the separation from the holder reference point Q to the insertion holes to be made to differ by configuring a different distance from the holder reference point Q to the adjustment plate 660 for each holding mode. Similar also applies in the second and third exemplary embodiments.

In the second exemplary embodiment described above, explanation has been given regarding a case in which the insertion portion 170 is formed with the four insertion projections 172A to 172D, each of which is inserted into the respective insertion holes 161 of the adjustment plate 160.

The present invention is not, however, limited thereto, and, for example, the insertion projection 172A may be omitted to configure only the three insertion projections 172B to 172D that are inserted into the respective insertion holes 161 of the adjustment plate 160. In such a configuration, in each of the holding modes, the respective insertion holes within the first insertable range 150A are not used in practice, with only the respective insertion holes within the second insertable range 150B being used.

Moreover, in the second exemplary embodiment described above, explanation has been given regarding a case in which the two insertion hole rows of the first insertion hole row 162A and the second insertion hole row 162B are provided to the adjustment plate 160.

The present invention is not, however, limited thereto, and, for example, the adjustment plate 160 may be provided with three or more insertion hole rows.

In the third exemplary embodiment described above, explanation has been given regarding a case in which the three insertion projections 272A to 272C are provided to the insertion portion 270, and are inserted into the respective insertion holes 261 of the adjustment plate 260.

Figure 28A:
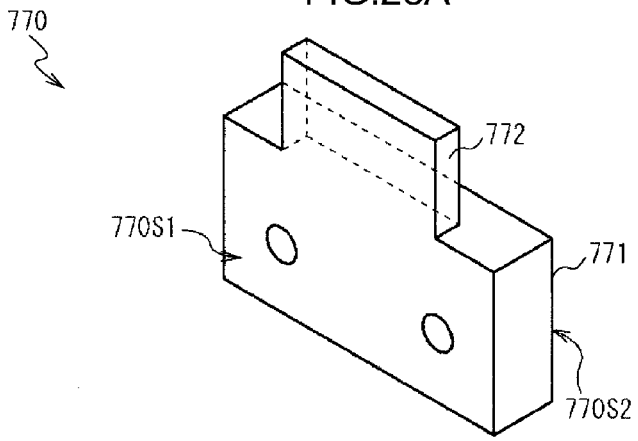
FIG. 28A is a schematic view illustrating a configuration of an insertion portion according to another exemplary embodiment.

The present invention is not, however, limited thereto, and for example, as illustrated in FIG. 28A corresponding to a portion of FIG. 18, in place of the insertion portion 270, an insertion portion 770 may be provided with only a single insertion projection 772 at an upper face of a base 771.

The insertion projection 772 is of substantially the same configuration as the insertion projection 172A of the second exemplary embodiment, and is installed upright on an upper face of the base 771 at a position offset such that the front face is aligned with a first face 770S1, this being the face on the front side in FIG. 28A.

Figure 28B:
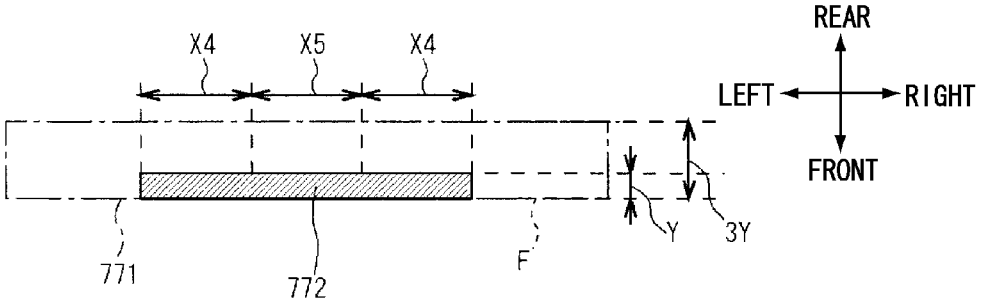
FIG. 28B is a schematic view illustrating a configuration of an insertion portion according to another exemplary embodiment.
Figure 28C:
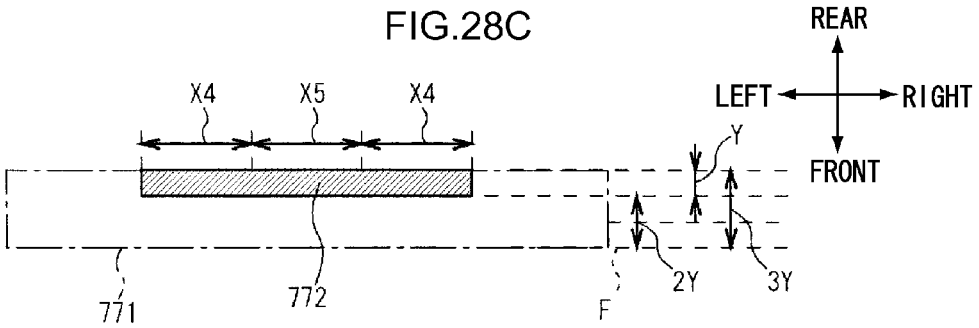
FIG. 28C is a schematic view illustrating a configuration of an insertion portion according to another exemplary embodiment.
Figure 29A:
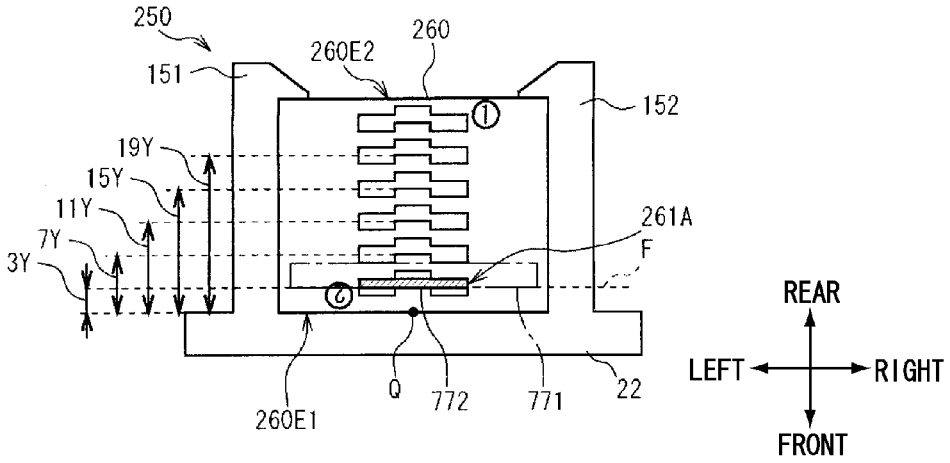
FIG. 29A is a schematic view illustrating a holding mode according to another exemplary embodiment.
Figure 29B:
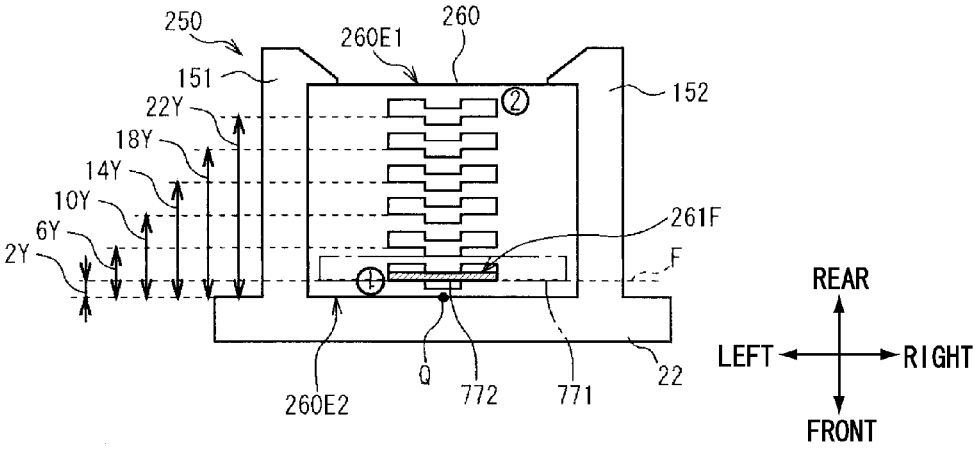
FIG. 29B is a schematic view illustrating a holding mode according to another exemplary embodiment.
Figure 29C:
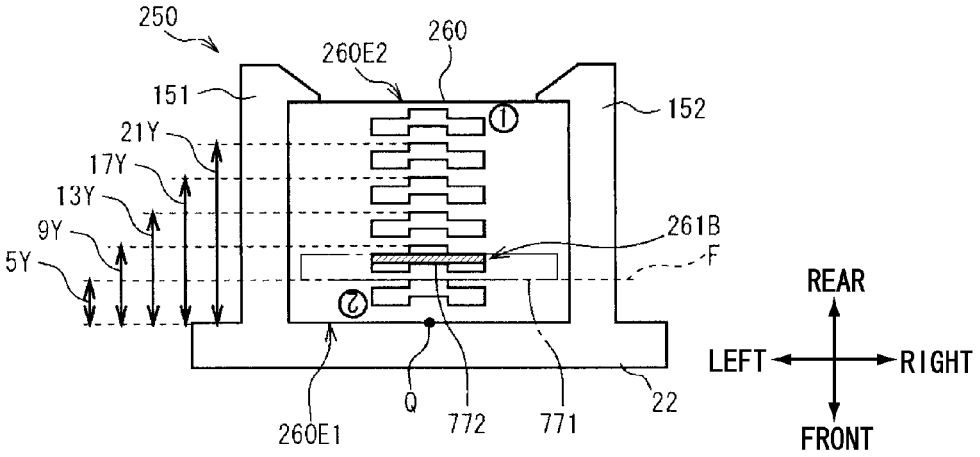
FIG. 29C is a schematic view illustrating a holding mode according to another exemplary embodiment.
Figure 29D:
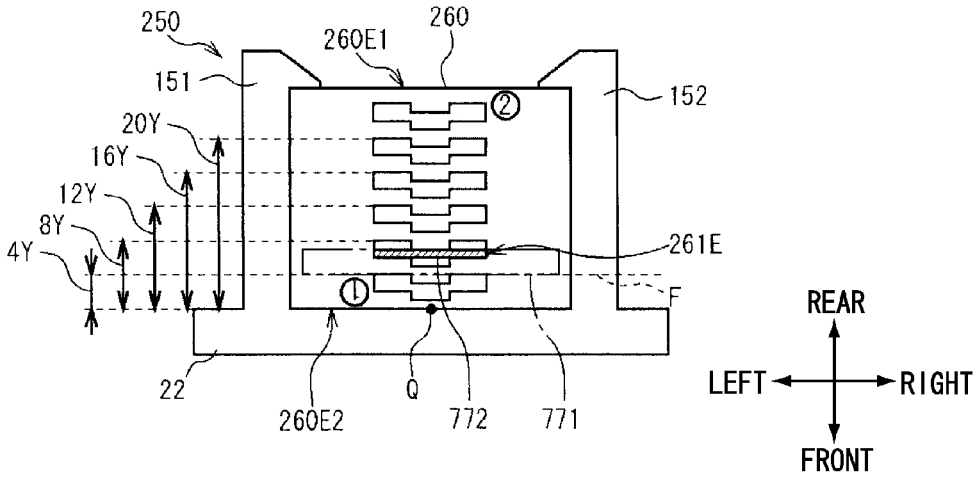
FIG. 29D is a schematic view illustrating a holding mode according to another exemplary embodiment.

Moreover, similarly to the insertion portion 270 (FIG. 21A and FIG. 21B), the insertion portion 770 can be attached to the front guide 26 in two attachment directions. Namely, as illustrated in the plan view of FIG. 28B corresponding to FIG. 22A, in a first insertion mode of the insertion portion 770, the front face of the insertion projection 772 is aligned with the front face line F. As illustrated in the plan view of FIG. 28C corresponding to FIG. 22B, in a second insertion mode of the insertion portion 770, the front face of the insertion projection 772 is separated from the front face line F by a length 2Y.

As illustrated in FIG. 29A to FIG. 29D, corresponding to FIG. 20A to FIG. 20D, similarly to in the third exemplary embodiment, the thus configured insertion portion 770 enables the front face line F to be positioned at discrete locations of length Y, namely 2Y, 3Y, and so on up to 21Y and 22Y from the holder reference point Q, similarly to in the third exemplary embodiment, by switching between the first holding mode and the second holding mode, and between the first insertion mode and the second insertion mode, as appropriate.

In the third exemplary embodiment described above, explanation has been given regarding a case in which the attachment direction when attaching the insertion portion 270 to the front guide 26 is varied by 180 degrees (namely reversed in the front-rear direction) so as to switch between the two insertion modes.

The present invention is not, however, limited thereto, and for example, the attachment direction may be varied by 90 degrees each time in four directions when attaching the insertion portion 270 to the front guide 26, so as to be switchable between various numbers of insertion modes corresponding to the number of attachable directions, such as switchable between four insertion modes. In such a configuration, for each insertion mode, the position of the front face line F when the insertion projection 272A etc. are inserted into the insertion holes 261 can preferably be made to differ by a distance shorter than the cycle (for example length 4Y) of the insertion holes 261 of the insertion hole row 262.

Moreover, in the first exemplary embodiment described above, explanation has been given regarding a case in which the insertion projection 72 provided to the insertion portion 70 has a long thin rectangular block shape running from top to bottom, and the insertion holes 61 of the adjustment plate 60 are formed as angular holes in the up-down direction, and the insertion projection 72 is inserted into any one of the insertion holes 61 of the insertion hole row 62.

The present invention is not, however, limited thereto, and for example, a screw hole portion formed with a screw hole at an upper face may be attached to the front guide 26 in place of the insertion portion 70, and plural circular insertion holes of a specific diameter may be formed in place of the respective insertion holes 61 of the adjustment plate 60. An attachment screw may then be screwed into the screw hole portion through any one of the insertion holes of the adjustment plate 60 in place of the insertion projection 72, so as to adjust and fix the position of the screw hole portion in the front-rear direction with respect to the adjustment plate 60.

Figure 30A:
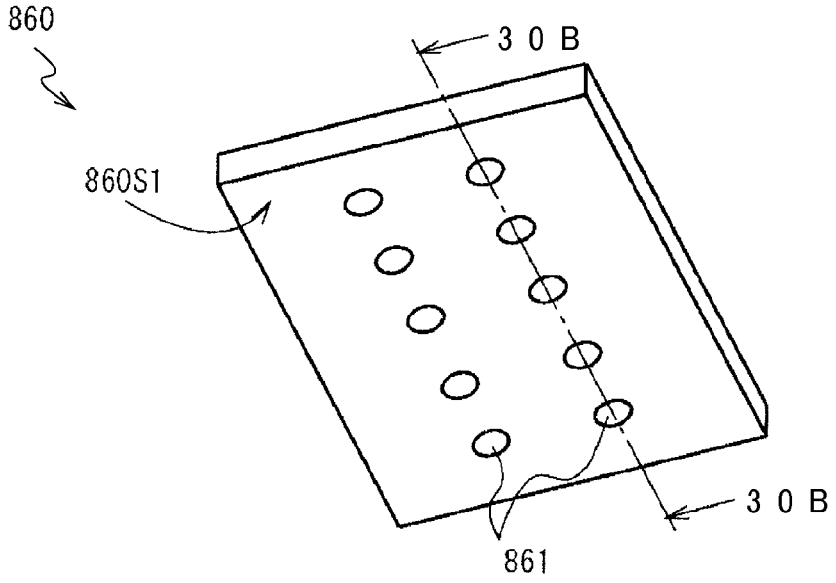
FIG. 30A is a schematic view illustrating a configuration of an adjustment plate according to another exemplary embodiment.
Figure 30B:
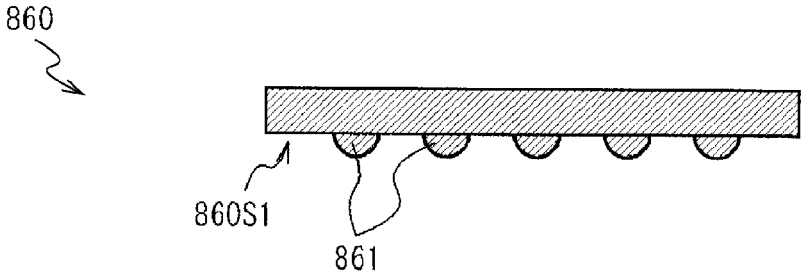
FIG. 30B is a schematic view illustrating a configuration of an adjustment plate according to another exemplary embodiment.
Figure 31A:
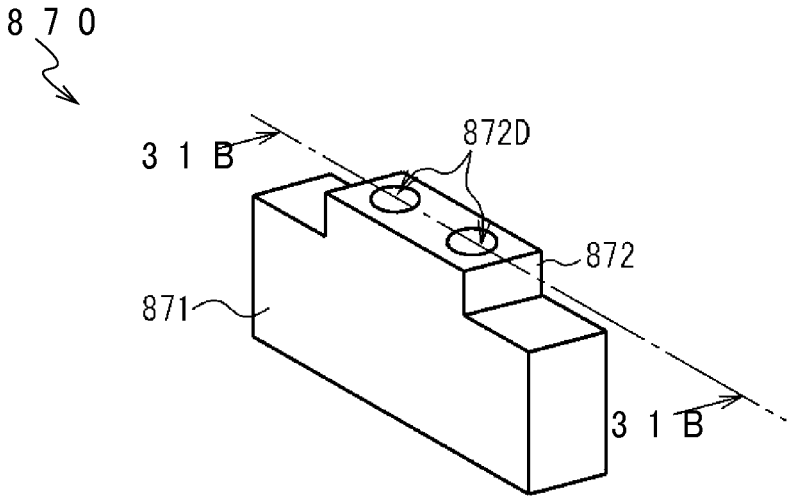
FIG. 31A is a schematic view illustrating a configuration of an adjustable body according to another exemplary embodiment.
Figure 31B:
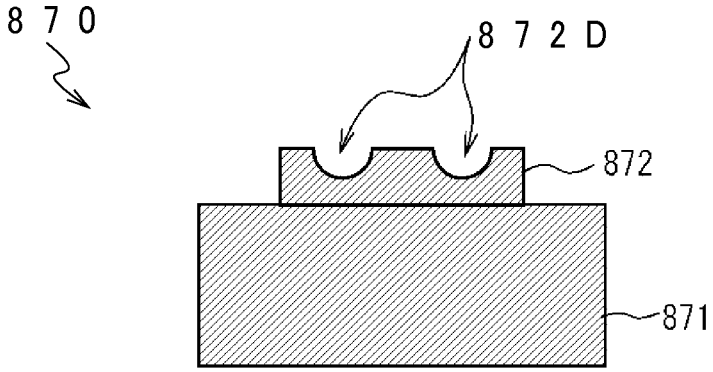
FIG. 31B is a schematic view illustrating a configuration of an adjustable body according to another exemplary embodiment.
Figure 32:
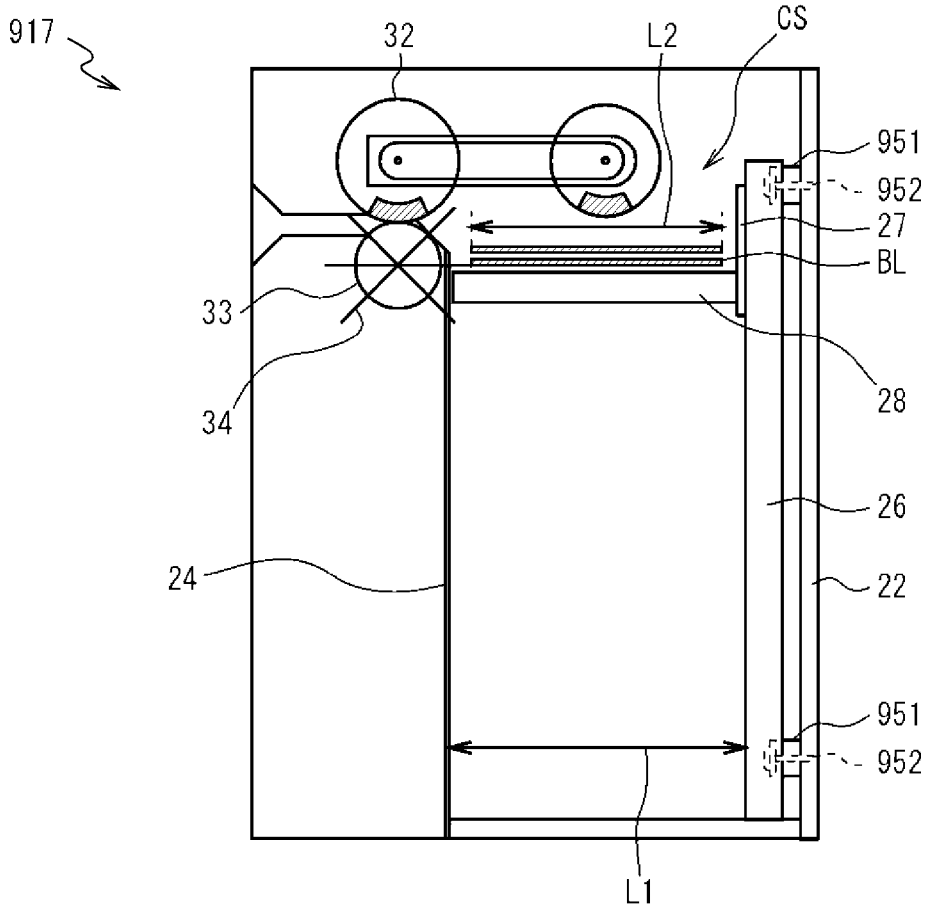
FIG.32 RELATED ART
FIG. 32 is a schematic view illustrating a configuration of a banknote cassette of related technology.
Figure 33A:
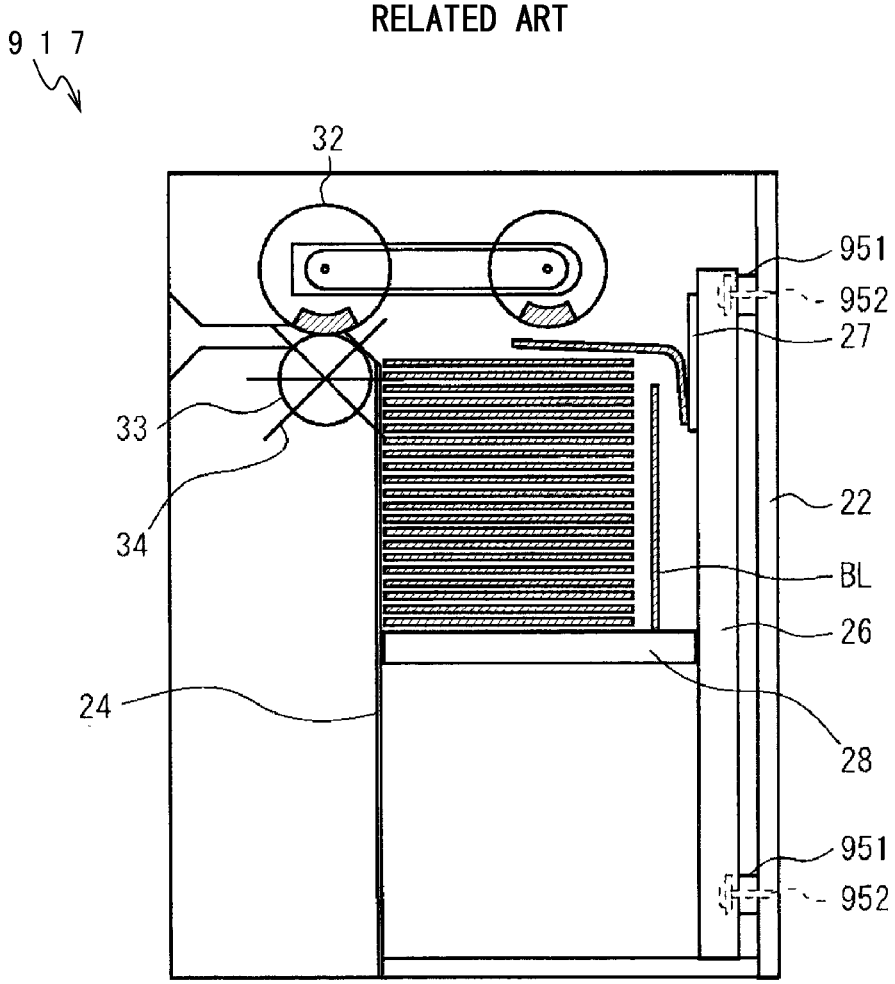
FIG.33A RELATED ART
FIG. 33A is a schematic view illustrating a collection problem in a banknote cassette of related technology.
Figure 33B:
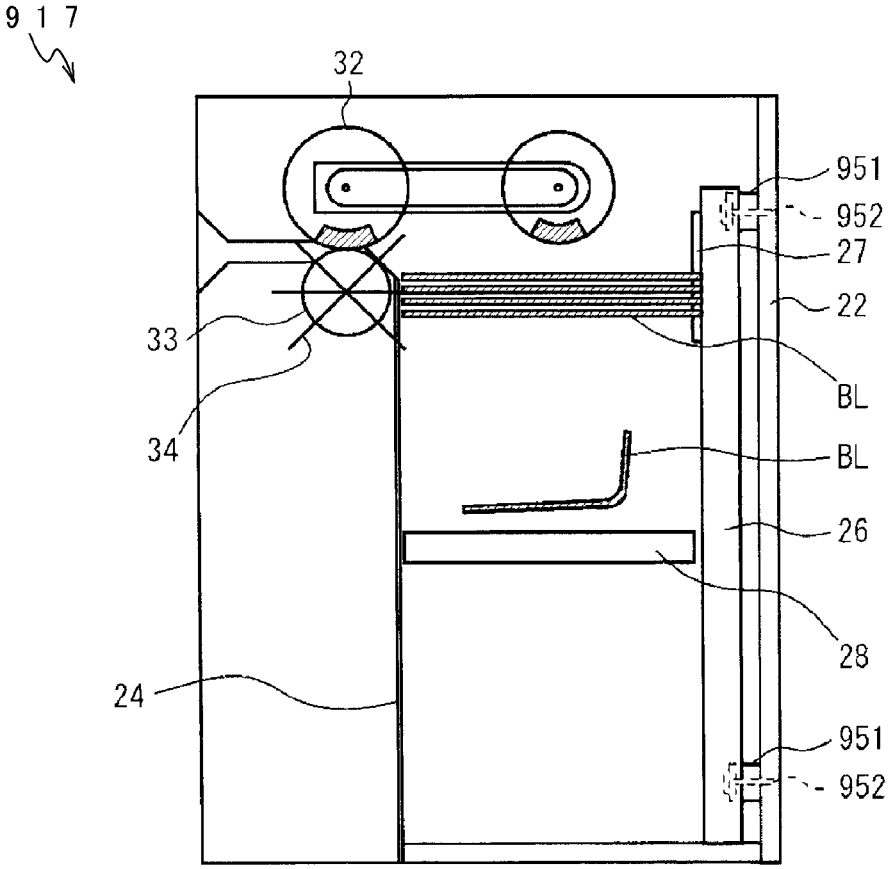
FIG.33B RELATED ART
FIG. 33B is a schematic view illustrating a collection problem in a banknote cassette of related technology.

As illustrated in FIG. 30A and FIG. 30B, for example, in an adjustment plate 860 used in place of the adjustment plate 60, in place of the respective insertion holes 61, plural fitting projections 861 that are small semispherical shaped projections may be formed on a lower face 860S1. In such a configuration, as illustrated in FIG. 31A and FIG. 31B, in place of the insertion portion 70, an adjustable body 870 is provided with a projection 872 with a rectangular block shape, short from top to bottom, at an upper face of a base 871, and formed with fitting recesses 872D with shapes that fit together with the fitting projections 861 on an upper face of the projection 872. In such a configuration, fitting the fitting recesses 872D together with any of the fitting projections 861 in the position adjustment sections provided at the top and bottom of the front guides 26 enables the position of the adjustable body 870 in the front-rear direction to be adjusted and fixed with respect to the holder 50 holding the adjustment plate 860.

In this manner, in the present invention, it is sufficient to fit together one of plural variously shaped fitting portions disposed on the adjustment plate 60 with a variously shaped fitted portion formed to the insertion portion 70 or the adjustable body 870 attached to the front guide 26 to enable the position of the front guides 26 to be adjusted in the front-rear direction and easily fixed so as not to move with respect to the adjustment plate 60 held by the holder 50. Similar also applies in the second and third exemplary embodiments.

Explanation has been given in the first exemplary embodiment described above regarding a case employing the washer 54 and the fixing screw 55, and explanation has been given in the second exemplary embodiment regarding a case employing the holding claws 151C and 152C to detachably hold the adjustment plate 60 etc. in the holder 50 etc.

The present invention is not, however, limited thereto, and the adjustment plate 60 etc. may be detachably held by the holder 50 etc. using various other methods.

Explanation has been given in the first exemplary embodiment described above regarding a case in which two position adjustment sections 25 are provided, at the upper end and lower end, of each single front guide 26.

The present invention is not, however, limited thereto, and one, or three or more, position adjustment sections 25 may be provided to each single front guide 26. Similar applies in the second and third exemplary embodiments.

In the first exemplary embodiment described above, explanation has been given regarding a case in which the position of the front guide 26 is adjusted in the front-rear direction inside the banknote cassettes 17 installed in the automated teller machine 1.

The present invention is not, however, limited thereto, and it may be applied so as to adjust the position of various components in various devices. In particular, the present invention is suitably applied, such as with the adjustment plate 60, in situations where there are limitations to a minimum separation between insertion holes 61, namely a minimum cycle, to adjust positions in shorter separations than the minimum cycle.

In the first exemplary embodiment described above, explanation has been given regarding a case in which a position adjustment device is configured by the position adjustment section 25 in which an adjustment body is configured by the adjustment plate 60, a holder is configured by the holder 50, and the adjustable body is configured by the insertion portion 70.

The present invention is not, however, limited thereto, and a position adjustment device may be configured by adjustment bodies, holders, and adjustable bodies of various other configurations.

In the first exemplary embodiment described above, explanation has been given regarding a case in which a paper sheet processing device is configured by the automated teller machine 1 in which a fixed side portion is configured by the reverse guide 24, an adjustment body is configured by the adjustment plate 60, a holder is configured by the holder 50, an adjustable body is configured by the insertion portion 70, and a movable side portion is configured by the front guide 26.

The present invention is not, however, limited thereto, a paper sheet processing device may be configured by fixed side portions, adjustment bodies, holders, adjustable bodies, and movable side portions of various other configurations.

INDUSTRIAL APPLICABILITY

The present invention may be employed in various devices in which the position of a component is adjusted with respect to a main body with finer precision than a cycle capable of being manufactured.

The disclosure of Japanese Patent Application No. 2012-249636 is incorporated into the present specification in its entirety by reference.

All publications, patent applications and technical standards mentioned in the present specification are incorporated by reference in the present specification to the same extent as if the individual publication, patent application, or technical standard was specifically and individually indicated to be incorporated by reference.

The invention claimed is:

1. A position adjustment device comprising:

an adjustment body including a row of fitting portions in which a plurality of fitting portions of a specific shape are disposed every specific fitting cycle along a specific direction;

a holder that holds the adjustment body in one of a plurality of holding modes, such that the fitting portion row faces in a specific holding direction and is positioned within a fittable range set running along a specific adjustment direction; and an adjustable body whose position with respect to the holder is determined by fitting a fitted portion that is fittable with the fitting portions together with one of the fitting portions in the fitting portion row within the fittable range, wherein the fitting portion row is disposed such that the minimum distance between a position of the adjustable body with the fitted portion fitted together with one fitting portion in the fitting portion row within the fittable range when the adjustment body is held in a first holding mode by the holder, and a position of the adjustable body with the fitted portion fitted together with one of the fitting portions in the fitting portion row within the fittable range when the adjustment body is held in a second holding mode by the holder, is shorter than the specific fitting cycle.

2. The position adjustment device of claim 1, wherein:

a plurality of the fitting portion rows are disposed on the same side face of the adjustment body; and the holder configures mutually different holding modes that are modes in which a first side face of the adjustment body faces in the specific holding direction, and a second side face of the adjustment body respectively faces in a plurality of mutually different directions.

3. The position adjustment device of claim 2, wherein:

the fitting portions respectively fit together with the fitted portion in the plurality of holding modes in which the second side face faces in different directions.

4. The position adjustment device of claim 2, wherein:

the holder configures two mutually different holding modes in which the first side face of the adjustment body faces in the specific holding direction, and the second side face of the adjustment body faces in the opposite direction to the specific holding direction; and a difference between a distance from a first edge of the adjustment body that contacts a specific reference point on the holder in the first holding mode to the nearest fitting portion within the fittable range, and a distance from a second edge of the adjustment body that contacts the reference point in the second holding mode to the nearest fitting portion within the fittable range, is shorter than the fitting cycle.

5. The position adjustment device of claim 1, wherein the fitting portion row is respectively disposed on a plurality of side faces of the adjustment body.

6. The position adjustment device of claim 5, wherein the fitting portion row is respectively disposed on two side faces of the adjustment body, facing in mutually opposite directions.

7. The position adjustment device of claim 1, wherein:

the adjustment body includes a plurality of the fitting portion rows disposed parallel to each other; and the adjustable body includes a plurality of fitted portions that respectively fit together with the respective fitting portions of each of the plurality of fitting portion rows.

8. The position adjustment device of claim 1, wherein:

the holder configures two mutually different holding modes in which a first side face of the adjustment body faces in the specific holding direction, and a second side face of the adjustment body faces in the opposite direction to the specific holding direction; and the adjustment body is configured such that the shapes of the respective fitting portions configuring a first fitting portion row match the shapes of the respective fitting portions configuring a second fitting portion row rotated by a half turn about an axis running along the specific holding direction.

9. The position adjustment device of claim 1, wherein:

the adjustment body is formed in a plate shape;

the fitting portions are insertion holes piercing through a plate face of the adjustment body; and the fitted portion is an insertion projection that is inserted into the insertion hole.

10. The position adjustment device of claim 1, wherein:

the adjustable body includes a plurality of insertion modes in which the fitted portion faces in mutually different directions with respect to the specific adjustment direction, and the position of the adjustable body in the specific adjustment direction is varied by a shorter distance than the fitting cycle by varying the insertion mode when fitting the fitted portion together with the fitting portions of the adjustment body.

11. A paper sheet processing device comprising:

a fixed side portion that is one side face of a collection space in which a paper sheet shaped medium is collected;

an adjustment body including a row of fitting portions, in which a plurality of fitting portions of a specific shape are disposed every specific fitting cycle along a specific direction;

a holder that holds the adjustment body in one of a plurality of holding modes such that any of the fitting portion rows faces in a specific holding direction and is positioned within a fittable range set running along an adjustment direction that is a direction heading toward and away from the fixed side portion;

an adjustable body whose position with respect to the holder is determined by fitting a fitted portion that is fittable with the fitting portions together with one of the fitting portions in the fitting portion row that is within the fittable range; and a movable side portion that is attached to the adjustable body, and that is a side face of the collection space facing the fixed side portion, wherein the fitting portion row is disposed such that the minimum distance between a position of the adjustable body with the fitted portion fitted together with one fitting portion in the fitting portion row within the fittable range when the adjustment body is held in a first holding mode by the holder, and a position of the adjustable body with the fitted portion fitted together with one of the fitting portions in the fitting portion row within the fittable range when the adjustment body is held in a second holding mode by the holder, is shorter than the specific fitting cycle.

* * * * *